US005759729A

United States Patent [19]

Martin et al.

[11] Patent Number: 5,759,729

[45] Date of Patent: Jun. 2, 1998

[54] PHOTOCHROMIC ELECTROSTATIC TONER COMPOSITIONS

[75] Inventors: Trevor I. Martin, Burlington; Carol A. Jennings, Etobicoke, both of Canada; Eric G. Johnson, Plant City, Fla.; John F. Oliver, Calgary, Canada

[73] Assignee: Xerox Corporation, Stamford, Conn.

[21] Appl. No.: 839,533

[22] Filed: Apr. 14, 1997

Related U.S. Application Data

[63] Continuation of Ser. No. 567,589, Dec. 5, 1995, abandoned.

[51] Int. Cl.[6] ..... G03G 9/09; G03G 9/097

[52] U.S. Cl. ..... 430/106; 430/110; 430/97; 430/45; 430/120

[58] Field of Search ..... 430/106, 110, 430/45, 120, 97

[56] References Cited

U.S. PATENT DOCUMENTS

| | | | |
|---|---|---|---|
| 5,045,420 | 9/1991 | Hosono et al. | 430/45 |
| 5,051,779 | 9/1991 | Hikawa | 355/200 |
| 5,091,966 | 2/1992 | Bloomberg et al. | 382/21 |
| 5,128,525 | 7/1992 | Stearns et al. | 235/454 |
| 5,168,147 | 12/1992 | Bloomberg | 235/456 |
| 5,291,243 | 3/1994 | Heckman et al. | 355/201 |
| 5,337,361 | 8/1994 | Wang et al. | 380/51 |
| 5,607,803 | 3/1997 | Murofushi et al. | 430/106 |

FOREIGN PATENT DOCUMENTS

| | | |
|---|---|---|
| 0459792 | 4/1991 | European Pat. Off. . |
| 0469864 | 5/1992 | European Pat. Off. . |
| 1-103631 | 4/1989 | Japan . |
| 3-287174 | 12/1991 | Japan . |
| 7-281473 | 10/1995 | Japan . |

OTHER PUBLICATIONS

Aldrich Catalog, p. 540, 1996.

Diamond, Arthur S. Handbook of Imaging Materials,. Marcel–Dekker, Inc. NY., pp. 168–169, 1991.

English translation of JP 7–281473, Oct. 1995.

English translation of JP 1–103631, Apr. 1989.

*Primary Examiner*—Christohper D. Rodee
*Attorney, Agent, or Firm*—Judith L. Byorick

[57] ABSTRACT

Disclosed is a toner composition for the development of electrostatic latent images which comprises particles comprising a mixture of a resin and a photochromic material. Another embodiment of the present invention is directed to a liquid developer composition for the development of electrostatic latent images which comprises a nonaqueous liquid vehicle and a photochromic material, wherein the liquid developer has a resistivity of from about $10^8$ to about $10^{11}$ ohm-cm and a viscosity of from about 25 to about 500 centipoise. Yet another embodiment of the present invention is directed to a liquid developer composition for the development of electrostatic latent images which comprises a nonaqueous liquid vehicle, a charge control agent, and toner particles comprising a mixture of a resin and a photochromic material.

20 Claims, No Drawings

PHOTOCHROMIC ELECTROSTATIC TONER COMPOSITIONS

This application is a continuation of application Ser. No. 08/567,589, filed Dec. 5, 1995 now abandoned.

BACKGROUND OF THE INVENTION

The present invention is directed to developer compositions. More specifically, the present invention is directed to dry and liquid electrographic toners containing specific colorants. One embodiment of the present invention is directed to a toner composition for the development of electrostatic latent images which comprises particles comprising a mixture of a resin and a photochromic material. Another embodiment of the present invention is directed to a liquid developer composition for the development of electrostatic latent images which comprises a nonaqueous liquid vehicle and a photochromic material, wherein the liquid developer has a resistivity of from about $10^8$ to about $10^{11}$ ohm-cm and a viscosity of from about 25 to about 500 centipoise. Yet another embodiment of the present invention is directed to a liquid developer composition for the development of electrostatic latent images which comprises a nonaqueous liquid vehicle, a charge control agent, and toner particles comprising a mixture of a resin and a photochromic material.

The formation and development of images on the surface of photoconductive materials by electrostatic means is well known. The basic electrophotographic imaging process, as taught by C. F. Carlson in U.S. Pat. No. 2,297,691, entails placing a uniform electrostatic charge on a photoconductive insulating layer known as a photoconductor or photoreceptor, exposing the photoreceptor to a light and shadow image to dissipate the charge on the areas of the photoreceptor exposed to the light, and developing the resulting electrostatic latent image by depositing on the image a finely divided electroscopic material known as toner. Toner typically comprises a resin and a colorant. The toner will normally be attracted to those areas of the photoreceptor which retain a charge, thereby forming a toner image corresponding to the electrostatic latent image. This developed image may then be transferred to a substrate such as paper. The transferred image may subsequently be permanently affixed to the substrate by heat, pressure, a combination of heat and pressure, or other suitable fixing means such as solvent or overcoating treatment.

Another known process for forming electrostatic images is ionography. In ionographic imaging processes, a latent image is formed on a dielectric image receptor or electroreceptor by ion deposition, as described, for example, in U.S. Pat. Nos. 3,564,556, 3,611,419, 4,240,084, 4,569,584, 2,919,171, 4,524,371, 4,619,515, 4,463,363, 4,254,424, 4,538,163, 4,409,604, 4,408,214, 4,365,549, 4,267,556, 4,160,257, and 4,155,093, the disclosures of each of which are totally incorporated herein by reference. Generally, the process entails application of charge in an image pattern with an ionographic writing head to a dielectric receiver that retains the charged image. The image is subsequently developed with a developer capable of developing charge images.

Many methods are known for applying the electroscopic particles to the electrostatic latent image to be developed. One development method, disclosed in U.S. Pat. No. 2,618,552, the disclosure of which is totally incorporated herein by reference, is known as cascade development. Another technique for developing electrostatic images is the magnetic brush process, disclosed in U.S. Pat. No. 2,874,063. This method entails the carrying of a developer material containing toner and magnetic carrier particles by a magnet. The magnetic field of the magnet causes alignment of the magnetic carriers in a brushlike configuration, and this "magnetic brush" is brought into contact with the electrostatic image bearing surface of the photoreceptor. The toner particles are drawn from the brush to the electrostatic image by electrostatic attraction to the undischarged areas of the photoreceptor, and development of the image results. Other techniques, such as touchdown development, powder cloud development, and jumping development are known to be suitable for developing electrostatic latent images.

Liquid developers and liquid development processes for the development of electrostatic latent images are also known. In electrophoretic developers and processes, the liquid developers generally comprise a liquid vehicle and colored toner particles, and frequently also contain a charge control agent. The colored toner particles become charged, and upon contacting the electrostatic latent image with the liquid developer, the particles migrate through the liquid vehicle toward the charged image, thereby effecting development. Any residual liquid vehicle remaining on the image subsequent to development is evaporated or absorbed into the receiving sheet. Typically, liquid developers employ hydrocarbon liquid vehicles, most commonly high boiling aliphatic hydrocarbons that are relatively high in resistivity and nontoxic. Developers and processes of this type are disclosed in, for example, U.S. Pat. Nos. 4,476,210, 2,877,133, 2,890,174, 2,899,335, 2,892,709, 2,913,353, 3,729,419, 3,841,893, 3,968,044, 4,794,651, 4,762,764, 4,830,945, 4,686,936, 4,766,049, 4,707,429, 4,780,388, 3,976,808, 4,877,698, 4,880,720, 4,880,432, and 5,030,535, the disclosures of each of which are totally incorporated herein by reference.

In polarizable liquid development processes, as disclosed in U.S. Pat. No. 3,084,043 (Gundlach), the disclosure of which is totally incorporated herein by reference, liquid developers having relatively low viscosity and low volatility and relatively high electrical conductivity (relatively low volume resistivity) are deposited on a gravure roller to fill the depressions in the roller surface. Excess developer is removed from the lands between the depressions, and as a receiving surface charged in image configuration passes near the gravure roller, liquid developer is attracted from the depressions onto the receiving surface in image configuration by the charged image. Developers and processes of this type are disclosed in, for example, U.S. Pat. No. 4,047,943, U.S. Pat. No. 4,059,444, U.S. Pat. No. 4,822,710, U.S. Pat. No. 4,804,601, U.S. Pat. No. 4,766,049, Canadian Patent 937,823, Canadian Patent 926,182, Canadian Patent 942,554, British Patent 1,321,286, and British Patent 1,312,844, the disclosures of each of which are totally incorporated herein by reference.

Photochromism in general is a reversible change of a single chemical species between two states having distinguishably different absorption spectra, wherein the change is induced in at least one direction by the action of electromagnetic radiation. The inducing radiation, as well as the changes in the absorption spectra, are usually in the ultraviolet, visible, or infrared regions. In some instances, the change in one direction is thermally induced. The single chemical species can be a molecule or an ion, and the reversible change in states may be a conversion between two molecules or ions, or the dissociation of a single molecule or ion into two or more species, with the reverse change being a recombination of the two or more species thus formed into the original molecule or ion. Photochromic phenomena are observed in both organic compounds, such as anils, disulfoxides, hydrazones, osazones, semicarbazones, stilbene derivatives, o-nitrobenzyl derivatives, spiro compounds, and the like, and in inorganic compounds, such as metal oxides, alkaline earth metal sulfides, titanates, mercury compounds, copper compounds, minerals, transition metal compounds such as carbonyls, and the like. Photochromic materials are known in applications such as photochromic glasses, which are useful as, for example, ophthalmic lenses.

Methods for encoding machine-readable information on documents, packages, machine parts, and the like, are known. One-dimensional symbologies, such as those employed in bar codes, are known. Two-dimensional symbologies generally are of two types—matrix codes and stacked bar codes. Matrix codes typically consist of a random checker board of black and white squares. Alignment features such as borders, bullseyes, start and stop bits, and the like, are included in the matrix to orient the matrix during scanning. Stacked bar codes consist of several one-dimensional bar codes stacked together. Two-dimensional symbologies have an advantage over one-dimensional symbologies of enabling greater data density. For example, a typical bar code can contain from about 9 to about 20 characters per inch, while a typical two-dimensional symbology can contain from about 100 to about 800 characters per square inch. Many two-dimensional symbologies also utilize error correction codes to increase their robustness. Examples of two-dimensional symbologies include PDF417, developed by Symbol Technologies, Inc., Data Matrix, developed by International Data Matrix, Vericode, developed by Veritec, Inc., CP Code, developed by Teiryo, Inc. and Integrated Motions, Inc., Maxicode, developed by the United Parcel Service, Softstrip, developed by Softstrip, Inc., Code One, developed by Laserlight Systems, Supercode, developed by Metanetics Inc., DataGlyph, developed by Xerox Corporation, and the like. One-dimensional and two-dimensional symbologies can be read with laser scanners or with video cameras. The scanners typically consist of an imaging detector coupled to a microprocessor for decoding. Scanners can be packaged into pen-like pointing devices or guns. Bar-like codes and methods and apparatus for coding and decoding information contained therein are disclosed in, for example, U.S. Pat. No. 4,692,603, 4,665,004, 4,728,984, 4,728,783, 4,754,127, and 4,782,221, the disclosures of each of which are totally incorporated herein by reference.

European Patent Application 469,864-A2 (Bloomberg et al.), the disclosure of which is totally incorporated herein by reference, discloses self-clocking glyph shape codes for encoding digital data in the shapes of glyphs that are suitable for printing on hardcopy recording media. Advantageously, the glyphs are selected so that they tend not to degrade into each other when they are degraded and/or distorted as a result, for example, of being photocopied, transmitted via facsimile, and/or scanned into an electronic document processing system. Moreover, for at least some applications, the glyphs desirably are composed of printed pixel patterns containing nearly the same number of on pixels and nearly the same number of off pixels, such that the code that is rendered by printing such glyphs on substantially uniformly spaced centers appears to have a generally uniform texture. In the case of codes printed at higher spatial densities, this texture is likely to be perceived as a generally uniform gray tone. Binary image processing and convolution filtering techniques for decoding such codes are also disclosed.

European Patent Application 459,792-A2 (Zdybel et al.), the disclosure of which is totally incorporated herein by reference, discloses the provision in electronic document processing systems for printing unfiltered or filtered machine-readable digital representations of electronic documents, and human-readable renderings of them on the same record medium using the same printing process. The integration of machine-readable digital representations of electronic documents with the human-readable hardcopy renderings of them may be employed, for example, not only to enhance the precision with which the structure and content of such electronic documents can be recovered by scanning such hardcopies into electronic document processing systems, but also as a mechanism for enabling recipients of scanned-in versions of such documents to identify and process annotations that were added to the hardcopies after they were printed and/or for alerting the recipients of the scanned-in documents to alterations that may have been made to the original human-readable content of the hardcopy renderings. In addition to storage of the electronic representation of the document, provision is made for encoding information about the electronic representation of the document itself, such as file name, creation and modification dates, access and security information, and printing histories. Provision is also made for encoding information which is computed from the content of the document and other information, for purposes of authentication and verification of document integrity. Provision is also made for the encoding of information which relates to operations which are to be performed depending on handwritten marks made upon a hardcopy rendering of the document; for example, encoding instructions of what action is to be taken when a box on a document is checked. Provision is also made for encoding in the hardcopy another class of information; information about the rendering of the document specific to that hardcopy, which can include a numbered copy of that print, the identification of the machine which performed that print, the reproduction characteristics of the printer, and the screen frequency and rotation used by the printer in rendering halftones. Provision is also made for encoding information about the digital encoding mechanism itself, such as information given in standard-encoded headers about subsequently compressed or encrypted digital information.

U.S. Pat. No. 5,128,525 (Stearns et al.), the disclosure of which is totally incorporated herein by reference, discloses weighted and unweighted convolution filtering processes for decoding bitmap image space representations of self-clocking glyph shape codes and for tracking the number and locations of the ambiguities or "errors" that are encountered during the decoding. This error detection may be linked to or compared against the error statistics from an alternative decoding process, such as the binary image processing techniques that are described to increase the reliability of the decoding that is obtained.

U.S. Pat. No. 5,291,243 (Heckman et al.), the disclosure of which is totally incorporated herein by reference, discloses a system for printing security documents which have copy detection or tamper resistance in plural colors with a single pass electronic printer printing an integrated image controlled by an image generation system which electronically generates a safety background image pattern with first and second interposed color patterns which is electronically merged with alphanumeric information and a protected signature into an integrated electronic image for the printer. The single pass printer preferably has an imaging surface upon which two latent images thereof are interposed, developed with two differently colored developer materials, and simultaneously transferred to the substrate in a single pass. The color patterns are preferably oppositely varying density patterns of electronically generated pixel dot images with varying spaces therebetween. Preferably a portion of the alphanumeric information is formed by a special secure font, such as a low density shadow copy. The validating signature also preferably has two intermixed color halftone patterns with halftone density gradients varying across the signature in opposite directions, but differently from the background. Also electronically superimposed in the safety background pattern may be substantially invisible latent image pixel patterns which become visible when copied, and/or are machine readable even in copies.

U.S. Pat. No. 5,168,147 (Bloomberg), the disclosure of which is totally incorporated herein by reference, discloses binary image processing techniques for decoding bitmap image space representations of self-clocking glyph shape codes of various types (e.g., codes presented as original or degraded images, with one or a plurality of bits encoded in each glyph, while preserving the discriminability of glyphs that encode different bit values) and for tracking the number and locations of the ambiguities (sometimes referred to herein as "errors") that are encountered during the decoding of such codes. A substantial portion of the image processing that is performed in the illustrated embodiment of the invention is carried out through the use of morphological filtering operations because of the parallelism that is offered by such operations. Moreover, the error detection that is performed in accordance with this invention may be linked to or compared against the error statistics from one or more alternative decoding process, such as the convolution filtering process that is disclosed herein, to increase the reliability of the decoding that is obtained.

U.S. Pat. No. 5,091,966 (Bloomberg et al.), the disclosure of which is totally incorporated herein by reference, discloses weighted and unweighted convolution filtering processes for decoding bitmap image space representations of self-clocking glyph shape codes and for tracking the number and locations of the ambiguities or "errors" that are encountered during the decoding. This error detection may be linked to or compared against the error statistics from an alternative decoding process, such as the binary image processing techniques that are described to increase the reliability of the decoding that is obtained.

U.S. Pat. No. 5,051,779 (Hikawa), the disclosure of which is totally incorporated herein by reference, discloses an image processing system which specifies input image information on the basis of existence of a special mark or patterns printed on a job control sheet. Selected one of various image processings is executed in accordance with the existence of the special mark or patterns to thereby obtain output image information. Each of the special marks or patterns are line drawings, each drawn so as to have a certain low correlative angle to the longitudinal and transverse directions of an image provided with the special mark or patterns.

U.S. Pat. No. 5,337,361 (Wang et al.), the disclosure of which is totally incorporated herein by reference, discloses a record which contains a graphic image and an information area which are interrelated to discourage misuse of the record. The information area can overlay the graphic image and include information encoded in an error-correctable, machine-readable format which allows recovery of the information despite distortion due to the underlying graphic image. The record may also represent the image by words similar in form to words in the information area. Both the information and graphic words can then be altered when an action regarding the record takes place.

Copending application U.S. Ser. No. 08/567,786, filed concurrently herewith, entitled "Method for Embedding and Recovering Machine-Readable Information," with the named inventors Trevor I. Martin and John F. Oliver, the disclosure of which is totally incorporated herein by reference, discloses a method of embedding and recovering machine readable information on a substrate which comprises (a) writing data in a predetermined machine readable code format on the substrate with a photochromic marking material having a first state corresponding to a first absorption spectrum and a second state corresponding to a second absorption spectrum; and (b) thereafter effecting a photochromic change in the photochromic marking material from the first state to the second state.

Copending application U.S. Ser. No. 08/567,637, filed concurrently herewith, entitled "Ink Compositions With Liposomes Containing Photochromic Compounds," with the named inventors Carol A. Jennings, Marcel P. Breton, Mary A. Isabella, Eric G. Johnson, Trevor I. Martin, and John F. Oliver, the disclosure of which is totally incorporated herein by reference, discloses an ink composition which comprises an aqueous liquid vehicle, a photochromic material, and a vesicle-forming lipid, wherein vesicles of the lipid are present in the ink.

Copending application U.S. Ser. No. 08/567,456, filed concurrently herewith, entitled "Photochromic Microemulsion Ink Compositions," with the named inventors John F. Oliver, Trevor I. Martin, Carol A. Jennings, Eric G. Johnson, and Marcel P. Breton, the disclosure of which is totally incorporated herein by reference, discloses an ink composition which comprises an aqueous phase, an oil phase, a photochromic material, and a surfactant, said ink exhibiting a liquid crystalline gel phase at a first temperature and a liquid microemulsion phase at a second temperature higher than the first temperature.

Copending application U.S. Ser. No. 08/567,457, filed concurrently herewith, entitled "Photochromic Hot Melt Ink Compositions," with the named inventors John F. Oliver, Trevor I. Martin, Carol A. Jennings, Eric G. Johnson, and Stephan V. Drappel, the disclosure of which is totally incorporated herein by reference, discloses a hot melt ink composition comprising (a) an ink vehicle, said ink vehicle being a solid at about 25° C. and having a viscosity of from about 1 to about 20 centipoise at a temperature suitable for hot melt ink jet printing, said temperature being greater than about 45° C., (b) a photochromic material, and (c) an optional propellant.

While known compositions and processes are suitable for their intended purposes, a need remains for improved electrostatic toner compositions. In addition, there is a need for dry toner compositions with photochromic characteristics. Further, there is a need for liquid toner compositions with photochromic characteristics. Additionally, processes for preparing documents with images having photochromic characteristics. In addition, there is a need for toner compositions which enable production of photochromic documents wherein the stimulus required to invoke the photochromic response is relatively brief rather than continuous. Further, there is a need for processes and materials which enable the placement of encoded information on documents which is not detectable to the reader but which is machine readable.

SUMMARY OF THE INVENTION

It is an object of the present invention to provide electrostatic toner compositions with the above noted advantages.

It is another object of the present invention to provide dry toner compositions with photochromic characteristics.

It is yet another object of the present invention to provide liquid toner compositions with photochromic characteristics.

It is still another object of the present invention to provide processes for preparing documents with images having photochromic characteristics.

Another object of the present invention is to provide toner compositions which enable production of photochromic documents wherein the stimulus required to invoke the photochromic response is relatively brief rather than continuous.

Yet another object of the present invention is to provide processes and materials which enable the placement of encoded information on documents which is not detectable to the reader but which is machine readable.

These and other objects of the present invention (or specific embodiments thereof) can be achieved by providing a toner composition for the development of electrostatic latent images which comprises particles comprising a mixture of a resin and a photochromic material.

DETAILED DESCRIPTION OF THE INVENTION

Dry toner compositions of the present invention generally comprise a resin, a photochromic material, and an optional charge control agent. The photochromic material is present in any amount effective to impart to the toner the desired color and intensity under the appropriate light conditions. Typically, the photochromic material is present in the toner in an amount of from about 1 to about 20 percent by weight, preferably from about 5 to about 10 percent by weight, although the amount can be outside these ranges.

Typical toner resins include polyesters, such as those disclosed in U.S. Pat. No. 3,590,000, the disclosure of which is totally incorporated herein by reference, polyamides, epoxies, polyurethanes, diolefins, vinyl resins and polymeric esterification products of a dicarboxylic acid and a diol comprising a diphenol. Examples of vinyl monomers include styrene, p-chlorostyrene, vinyl naphthalene, unsaturated mono-olefins such as ethylene, propylene, butylene, isobutylene and the like; vinyl halides such as vinyl chloride, vinyl bromide, vinyl fluoride, vinyl acetate, vinyl propionate, vinyl benzoate, and vinyl butyrate; vinyl esters such as esters of monocarboxylic acids, including methyl acrylate, ethyl acrylate, n-butyl acrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate, and the like; acrylonitrile, methacrylonitrile, acrylamide, vinyl ethers, including vinyl methyl ether, vinyl isobutyl ether, and vinyl ethyl ether; vinyl ketones such as vinyl methyl ketone, vinyl hexyl ketone, and methyl isopropenyl ketone; N-vinyl indole and N-vinyl pyrrolidene; styrene butadienes, including those disclosed in U.S. Pat. No. 4,560,635, the disclosure of which is totally incorporated herein by reference; mixtures of these monomers; and the like. The resins are present in the toner in any effective amount, typically from about 75 to about 98 percent by weight, preferably from about 90 to about 98 percent by weight, and more preferably from about 95 to about 96 percent by weight, although the amount can be outside these ranges.

Examples of suitable photochromic materials include compounds that undergo heterolytic cleavage, such as spiropyrans and related compounds, and the like; compounds that undergo homolytic cleavage, such as bis-imidazole compounds, bis-tetraphenylpyrrole, hydrazine compounds, aryl disulfide compounds, and the like; compounds that undergo cis-trans isomerization, such as stilbene compounds, photoisomerizable azo compounds, and the like; compounds that undergo photochromic tautomerism, including those that undergo hydrogen transfer phototautomerism, those that undergo photochromic valence tautomerism, and the like; and others.

More specifically, examples include spiropyrans, of the general formula

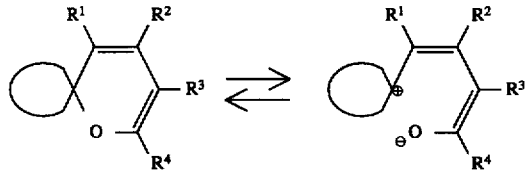

wherein $R^1$, $R^2$, $R^3$, and $R^4$ each, independently of the others, can be (but are not limited to) hydrogen, alkyl, including cyclic alkyl groups, such as cyclopropyl, cyclohexyl, and the like, and including unsaturated alkyl groups, such as vinyl ($H_2C{=}CH{-}$), allyl ($H_2C{=}CH{-}CH_2{-}$), propynyl ($HC{\equiv}C{-}CH_2{-}$), and the like, preferably with from 1 to about 50 carbon atoms and more preferably with from 1 to about 30 carbon atoms, aryl, preferably with from about 5 to about 30 carbon atoms and more preferably with from about 5 to about 20 carbon atoms, arylalkyl, preferably with from about 6 to about 50 carbon atoms and more preferably with from about 6 to about 30 carbon atoms, silyl groups, nitro groups, cyano groups, halide atoms, such as fluoride, chloride, bromide, iodide, and astatide, amine groups, including primary, secondary, and tertiary amines, hydroxy groups, alkoxy groups, preferably with from 1 to about 50 carbon atoms and more preferably with from 1 to about 30 carbon atoms, aryloxy groups, preferably with from about 5 to about 30 carbon atoms and more preferably with from about 5 to about 20 carbon atoms, alkylthio groups, preferably with from 1 to about 50 carbon atoms and more preferably with from 1 to about 30 carbon atoms, arylthio groups, preferably with from about 5 to about 30 carbon atoms and more preferably with from about 5 to about 20 carbon atoms, aldehyde groups, ketone groups, ester groups, amide groups, carboxylic acid groups, sulfonic acid groups, and the like. The alkyl, aryl, and arylalkyl groups can also be substituted with groups such as, for example, silyl groups, nitro groups, cyano groups, halide atoms, such as fluoride, chloride, bromide, iodide, and astatide, amine groups, including primary, secondary, and tertiary amines, hydroxy groups, alkoxy groups, preferably with from 1 to about 20 carbon atoms and more preferably with from 1 to about 10 carbon atoms, aryloxy groups, preferably with from about 5 to about 20 carbon atoms and more preferably with from about 5 to about 10 carbon atoms, alkylthio groups, preferably with from 1 to about 20 carbon atoms and more preferably with from 1 to about 10 carbon atoms, arylthio groups, preferably with from about 5 to about 20 carbon atoms and more preferably with from about 5 to about 10 carbon atoms, aldehyde groups, ketone groups, ester groups, amide groups, carboxylic acid groups, sulfonic acid groups, and the like. Further, two or more R groups can be joined together to form a ring.

Also suitable are spirooxazines, of the general formula

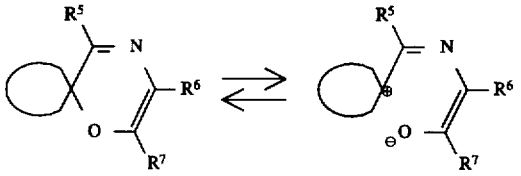

wherein $R^5$, $R^6$, and $R^7$ each, independently of the others, can be (but are not limited to) hydrogen, alkyl, including cyclic alkyl groups, such as cyclopropyl, cyclohexyl, and the like, and including unsaturated alkyl groups, such as vinyl ($H_2C{=}CH{-}$), allyl ($H_2C{=}CH{-}CH_2{-}$), propynyl ($HC{\equiv}C{-}CH_2{-}$), and the like, preferably with from 1 to about 50 carbon atoms and more preferably with from 1 to about 30 carbon atoms, aryl, preferably with from about 5 to about 30 carbon atoms and more preferably with from about 5 to about 20 carbon atoms, arylalkyl, preferably with from about 6 to about 50 carbon atoms and more preferably with from about 6 to about 30 carbon atoms, silyl groups, nitro groups, cyano groups, halide atoms, such as fluoride, chloride, bromide, iodide, and astatide, amine groups, including primary, secondary, and tertiary amines, hydroxy groups, alkoxy groups, preferably with from 1 to about 50 carbon atoms and more preferably with from 1 to about 30 carbon atoms, aryloxy groups, preferably with from about 5 to about 30 carbon atoms and more preferably with from about 5 to about 20 carbon atoms, alkylthio groups, preferably with from 1 to about 50 carbon atoms and more preferably with from 1 to about 30 carbon atoms, arylthio groups, preferably with from about 5 to about 30 carbon atoms and more preferably with from about 5 to about 20 carbon atoms, aldehyde groups, ketone groups, ester groups, amide groups, carboxylic acid groups, sulfonic acid groups, and the like. The alkyl, aryl, and arylalkyl groups can also be substituted with groups such as, for example, silyl groups, nitro groups, cyano groups, halide atoms, such as fluoride, chloride, bromide, iodide, and astatide, amine groups, including primary, secondary, and tertiary amines, hydroxy groups, alkoxy groups, preferably with from 1 to about 20 carbon atoms and more preferably with from 1 to about 10 carbon atoms, aryloxy groups, preferably with from about 5 to about 20 carbon atoms and more preferably with from about 5 to about 10 carbon atoms, alkylthio groups, preferably with from 1 to about 20 carbon atoms and more preferably with from 1 to about 10 carbon atoms, arylthio groups, preferably with from about 5 to about 20 carbon atoms and more preferably with from about 5 to about 10 carbon atoms, aldehyde groups, ketone groups, ester groups, amide groups, carboxylic acid groups, sulfonic acid groups, and the like. Further, two or more R groups can be joined together to form a ring.

Also suitable are spirothiopyrans, of the general formula

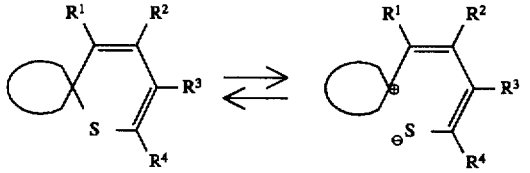

wherein $R^1$, $R^2$, $R^3$, and $R^4$ each, independently of the others, can be (but are not limited to) hydrogen, alkyl, including cyclic alkyl groups, such as cyclopropyl, cyclohexyl, and the like, and including unsaturated alkyl groups, such as vinyl ($H_2C{=}CH{-}$), allyl ($H_2C{=}CH{-}CH_2{-}$), propynyl ($HC{\equiv}C{-}CH_2{-}$), and the like, preferably with from 1 to about 50 carbon atoms and more preferably with from 1 to about 30 carbon atoms, aryl, preferably with from about 5 to about 30 carbon atoms and more preferably with from about 5 to about 20 carbon atoms, arylalkyl, preferably with from about 6 to about 50 carbon atoms and more preferably with from about 6 to about 30 carbon atoms, silyl groups, nitro groups, cyano groups, halide atoms, such as fluoride, chloride, bromide, iodide, and astatide, amine groups, including primary, secondary, and tertiary amines, hydroxy groups, alkoxy groups, preferably with from 1 to about 50 carbon atoms and more preferably with from 1 to about 30 carbon atoms, aryloxy groups, preferably with from about 5 to about 30 carbon atoms and more preferably with from about 5 to about 20 carbon atoms, alkylthio groups, preferably with from 1 to about 50 carbon atoms and more preferably with from 1 to about 30 carbon atoms, arylthio groups, preferably with from about 5 to about 30 carbon atoms and more preferably with from about 5 to about 20 carbon atoms, aldehyde groups, ketone groups, ester groups, amide groups, carboxylic acid groups, sulfonic acid groups, and the like. The alkyl, aryl, and arylalkyl groups can also be substituted with groups such as, for example, silyl groups, nitro groups, cyano groups, halide atoms, such as fluoride, chloride, bromide, iodide, and astatide, amine groups, including primary, secondary, and tertiary amines, hydroxy groups, alkoxy groups, preferably with from 1 to about 20 carbon atoms and more preferably with from 1 to about 10 carbon atoms, aryloxy groups, preferably with from about 5 to about 30 carbon atoms and more preferably with from about 5 to about 20 carbon atoms, alkylthio groups, preferably with from 1 to about 20 carbon atoms and more preferably with from 1 to about 10 carbon atoms, arylthio groups, preferably with from about 5 to about 20 carbon atoms and more preferably with from about 5 to about 10 carbon atoms, aldehyde groups, ketone groups, ester groups, amide groups, carboxylic acid groups, sulfonic acid groups, and the like. Further, two or more R groups can be joined together to form a ring.

Examples of spiropyrans include spiro[2H-1-benzopyran-2,2'-indolines], including those of the general formula

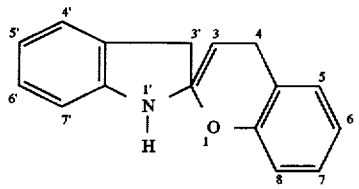

wherein substituents can be present on one or more of the 1', 3', 4', 5', 6', 7', 3, 4, 5, 6, 7, and 8 positions, spiroindolinonaphthopyrans, including those of the general formula

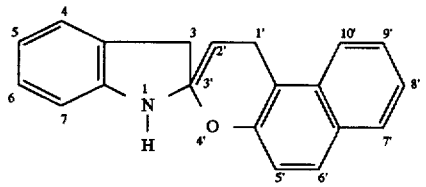

wherein substituents can be present on one or more of the 1, 3, 4, 5, 6, 7, 1', 2', 5', 6', 7', 8', 9', or 10' positions, spiro[2H-1-benzopyran-2,2'benzothiazolines], including those of the general formula

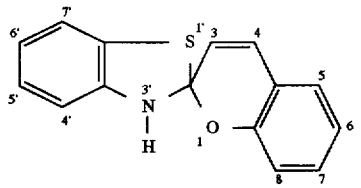

wherein substituents can be present on one or more of the 1', 3', 4', 5', 6', 7', 3, 4, 5, 6, 7, and 8 positions, spiro[2H-1-benzopyran-2,2'-benzoxazolines], including those of the general formula

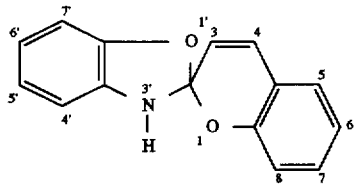

wherein substituents can be present on one or more of the 1', 3', 4', 5', 6', 7', 3, 4, 5, 6, 7, and 8 positions, spiropyranopyrans, including those of the general formula

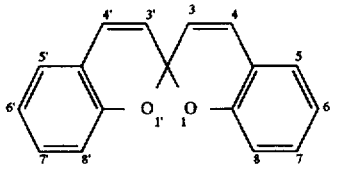

wherein substituents can be present on one or more of the 3, 4, 5, 6, 7, 8, 3', 4', 5', 6', 7', and 8' positions, azaspiroindolinopyrans, including those of the general formula

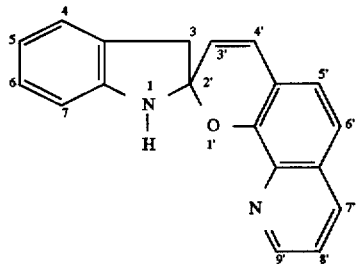

wherein substituents can be present on one or more of the 3, 4, 5, 6, 7, 3', 4', 5', 6', 7', 8', and 9' positions, spiro (quinolinopyrans), including those of the general formula

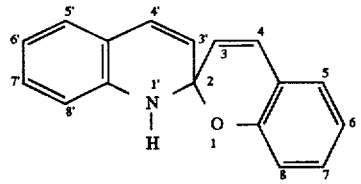

wherein substituents can be present on one or more of the 3, 4, 5, 6, 7, 8, 3', 4', 5', 6', 7', and 8' positions, spiro(pyridino pyrans), including those of the general formula

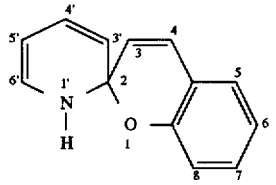

wherein substituents can be present on one or more of the 3, 4, 5, 6, 7, 8, 3', 4', 5', and 6' positions, and the like.

Examples of spirooxazines include spiro[indoline-2,3'-[3H]-naphtho[2,1-b]-1,4-oxazines], including those of the general formula

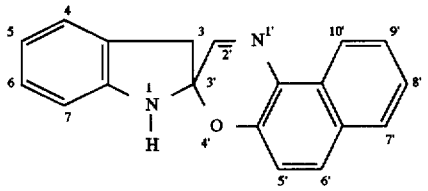

wherein substituents can be present on one or more of the 1, 3, 4, 5, 6, 7, 1', 2', 5', 6', 7', 8', 9', or 10' positions, spiro[2H-1,4-benzoxazine-2,2'-indolines], including those of the general formula

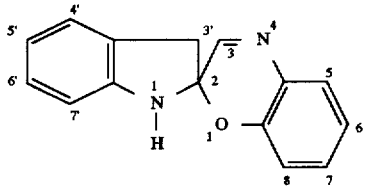

wherein substituents can be present on one or more of the 3, 5, 6, 7, 8, 1', 3', 4', 5', 6', and 7' positions, and the like.

Examples of spirothiopyrans include spiro[2H-1-benzothiopyran-2,2'-indolines], including those of the general formula

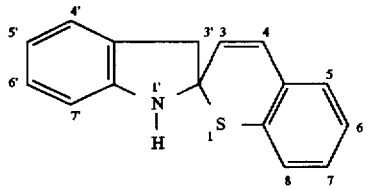

wherein substituents can be present on one or more of the 1', 3', 4', 5', 6', 7', 3, 4, 5, 6, 7, and 8 positions, and the like.

In all of the above examples of spiropyrans, spirooxazines, and spirothiopyrans, examples of substituents include (but are not limited to) alkyl, including cyclic alkyl groups, such as cyclopropyl, cyclohexyl, and the like, and including unsaturated alkyl groups, such as vinyl ($H_2C{=}CH{-}$), allyl ($H_2C{=}CH{-}CH_2{-}$), propynyl ($HC{\equiv}C{-}CH_2{-}$), and the like, preferably with from 1 to about 50 carbon atoms and more preferably with from 1 to about 30 carbon atoms, aryl, preferably with from about 5 to about 30 carbon atoms and more preferably with from about 5 to about 20 carbon atoms, arylalkyl, preferably with from about 6 to about 50 carbon atoms and more preferably with from about 6 to about 30 carbon atoms, silyl groups, nitro groups, cyano groups, halide atoms, such as fluoride, chloride, bromide, iodide, and astatide, amine groups, including primary, secondary, and tertiary amines, hydroxy groups, alkoxy groups, preferably with from 1 to about 50 carbon atoms and more preferably with from 1 to about 30 carbon atoms, aryloxy groups, preferably with from about 5 to about 30 carbon atoms and more preferably with from about 5 to about 20 carbon atoms, alkylthio groups, preferably with from 1 to about 50 carbon atoms and more preferably with from 1 to about 30 carbon atoms, arylthio groups, preferably with from about 5 to about 30 carbon atoms and more preferably with from about 5 to about 20 carbon atoms, aldehyde groups, ketone groups, ester groups, amide groups, carboxylic acid groups, sulfonic acid groups, and the like. The alkyl, aryl, and arylalkyl groups can also be substituted with groups such as, for example, silyl groups, nitro groups, cyano groups, halide atoms, such as fluoride, chloride, bromide, iodide, and astatide, amine groups, including primary, secondary, and tertiary amines, hydroxy groups, alkoxy groups, preferably with from 1 to about 30 carbon atoms and more preferably with from 1 to about 20 carbon atoms, aryloxy groups, preferably with from about 5 to about 30 carbon atoms and more preferably with from about 5 to about 20 carbon atoms, alkylthio groups, preferably with from 1 to about 30 carbon atoms and more preferably with from 1 to about 20 carbon atoms, arylthio groups, preferably with from about 5 to about 30 carbon atoms and more preferably with from about 5 to about 20 carbon atoms, aldehyde groups, ketone groups, ester groups, amide groups, carboxylic acid groups, sulfonic acid groups, and the like. Further, two or more substituents can be joined together to form a ring.

Substituents on the left ring of the spiropyrans, spirooxazines, and spirothiopyrans (represented by the loop in the generic structural formulae of these materials) can be adjusted to affect the color of the open form of the material. Substituents on the central moiety of the spiropyrans, spirooxazines, and spirothiopyrans or on alkyl or aryl groups attached thereto also affect the color of the open form of the material, although to a lesser degree than substituents on the left ring. Further, when the left ring contains a nitrogen atom, this atom or other atoms can be substituted to affect the solubility of the compound in various liquids and resins. For example, long chain hydrocarbons, such as those with 16 or 18 carbon atoms, can increase solubility in hydrocarbons. Sulfonate and carboxylate groups, for example, can enhance water solubility.

Specific examples of spiropyrans, spirooxazines, and spirothiopyrans include spiro[2H-1-benzopyran-2,2'-indoline]; 8-acetoxymercuri-6-nitro-1',3',3'-trimethylspiro[2H-1-benzopyran-2,2'-indoline]; 6-acetyl-1',3'3'-trimethylspiro[2H-1-benzopyran-2,2'-indoline]; 8-allyl-5'-chloro-6-nitro-1',3',3'-trimethylspiro[2H-1-benzopyran-2,2'-indoline]; 8-allyl-3',3'-dimethyl-6'-nitro-1'-phenylspiro[2H-1-benzopyran-2,2'-indoline]; 8-allyl-6-nitro-1',3,3',3'-tetramethylspiro[2H-1-benzopyran-2,2'-indoline]; 8-allyl-6-nitro-1',3',3'-trimethylspiro[2H-1-benzopyran-2,2'-indoline]; 8-allyl-1',3',3'-trimethylspiro[2H-1-benzopyran-2,2'-indoline]; 5'-amino-5,7-dichloro-6-nitro-1',3',3'-trimethylspiro[2H-1-benzopyran-2,2'-indoline]; 6-amino-7-hydroxy-1',3',3'-trimethylspiro[2H-1-benzopyran-2,2'-indoline]; 5'-amino-8-methoxy-6-nitro-1',3',3'-trimethylspiro[2H-1-benzopyran-2,2'-indoline]; 5-amino-8-methoxy-1',3',3'-trimethylspiro[2H-1-benzopyran-2,2'-indoline]; 5'-amino-8-methoxy-1',3',3'-trimethylspiro[2H-1-benzopyran-2,2'-indoline]; 5'-amino-6-nitro-1',3',3'-trimethylspiro[2H-1-benzopyran-2,2'-indoline]; 5'-amino-1',3',3'-trimethylspiro[2H-1-benzopyran-2,2'-indoline]; 6-amino-1',3',3'-trimethylspiro[2H-1-benzopyran-2,2'-indoline]; 8-amino-1',3',3'-trimethylspiro[2H-1-benzopyran-2,2'-indoline]; 1'-amyl-5-bromo-3',3'-dimethyl-8-methoxy-6-nitrospiro[2H-1-benzopyran-2,2'-indoline]; 1'-amyl-3',3'-dimethyl-8-methoxyspiro[2H-1-benzopyran-2,2'-indoline]; 1'-amyl-3',3-dimethyl-6-methoxy-8-nitrospiro[2H-1-benzopyran-2,2'-indoline]; 1'-amyl-3',3-dimethyl-5',6-dinitro-8-methoxyspiro[2H-1-benzopyran-2,2'-indoline]; 1'-amyl-3',3-dimethyl-8-methoxy-5,5',6-trinitrospiro[2H-1-benzopyran-2,2'-indoline]; 1'-amyl-3,3'-dimethyl-6-nitrospiro[2H-1-benzopyran-2,2'-indoline]; 6-bromo-1'-butyl-3',3'-dimethylspiro[2H-1-benzopyran-2,2'-indoline]; 8-bromo-1'-butyl-3',3'-dimethyl-6-nitrospiro[2H-1-benzopyran-2,2'-indoline]; 8-bromo-5'-chloro-5,7-dimethoxy-6-nitro-1',3',3'-trimethylspiro[2H-1-benzopyran-2,2'-indoline]; 8-bromo-5'-chloro-7-hydroxy-1',3',3'-trimethylspiro[2H-1-benzopyran-2,2'-indoline]; 5-bromo-5'-chloro-8-methoxy-1',3',3'-trimethylspiro[2H-1-benzopyran-2,2'-indoline]; 6-bromo-5'-chloro-8-methoxy-1',3',3'-trimethylspiro[2H-1-benzopyran-2,2'-indoline]; 5-bromo-6'-chloro-8-methoxy-6-nitro-1',3',3',7'-tetramethylspiro[2H-1-benzopyran-2,2'-indoline]; 5-bromo-5'-chloro-6-methoxy-8-nitro-1',3',3'-trimethylspiro[2H-1-benzopyran-2,2'-indoline]; 5-bromo-5'-chloro-8-methoxy-6-nitro-1',3',3'-trimethylspiro[2H-1-benzopyran-2,2'-indoline]; 5-bromo-7'-chloro-8-methoxy-6-nitro-1',3',3'-trimethylspiro[2H-1-benzopyran-2,2'-indoline]; 6-bromo-5'-chloro-8-nitro-1',3',3'-trimethylspiro[2H-1-benzopyran-2,2'-indoline]; 8-bromo-5'-chloro-6-nitro-1',3',3'-trimethylspiro[2H-1-benzopyran-2,2'-indoline]; 5-bromo-4',6'-dichloro-8-methoxy-6-nitro-1',3',3'-trimethylspiro[2H-1-benzopyran-2,2'-indoline]; 5-bromo-4',7'-dichloro-8-methoxy-6-nitro-1',3',3'-trimethylspiro[2H-1-benzopyran-2,2'-indoline]; 5-bromo-5',7'-dichloro-8-methoxy-6-nitro-1',3',3'-trimethylspiro[2H-1-benzopyran-2,2'-indoline]; 6-bromo-5'-chloro-1',3',3'-trimethylspiro[2H-1-benzopyran-2,2'-indoline]; 5-bromo-3',3'-diethyl-8-methoxy-1'-methyl-6-nitrospiro[2H-1-benzopyran-2,2'-indoline]; 5-bromo-5',8-dimethoxy-6-nitro-1',3',3'-trimethylspiro[2H-1-benzopyran-2,2'-indoline]; 5-bromo-7',8-dimethoxy-6-nitro-1',3',3'-trimethylspiro[2H-1-benzopyran-2,2'-indoline]; 6-bromo-5',8-dimethoxy-1',3',3'-trimethylspiro[2H-1-benzopyran-2,2'-indoline]; 6-bromo-3',3'-dimethyl-1'-ethylspiro[2H-1-benzopyran-2,2'-indoline]; 6-bromo-3',3'-dimethyl-1'-ethyl-8-methoxyspiro[2H-1-benzopyran-2,2'-indoline]; 5-bromo-1',3'-dimethyl-3'-ethyl-6-methoxy-8-nitrospiro[2H-1-benzopyran-2,2'-indoline]; 5-bromo-1', 3'-dimethyl-3'-ethyl-8-methoxy-6-nitrospiro[2H-1-benzopyran-2,2'-indoline]; 8-bromo-3',3'-dimethyl-1'-ethyl-6-nitrospiro[2H-1-benzopyran-2,2'-indoline]; 5-bromo-3',3'-dimethyl-1'-isoamyl-8-methoxy-6-nitrospiro[2H-1-benzopyran-2,2'-indoline]; 5-bromo-1',3'-dimethyl-6-methoxy-8-nitro-3'-phenylspiro[2H-1-benzopyran-2,2'-indoline]; 5-bromo-1',3'-dimethyl-8-methoxy-6-nitro-3'-phenylspiro[2H-1-benzopyran-2,2'-indoline]; 5-bromo-3',3'-dimethyl-6-methoxy-8-nitro-1'-phenylspiro[2H-1-benzopyran-2,2'-indoline]; 5-bromo-3',3'-dimethyl-8-methoxy-6-nitro-1'-phenylspiro[2H-1-benzopyran-2,2'-indoline]; 8-bromo-3',3'-dimethyl-6-nitro-1'-propylspiro[2H-1-benzopyran-2,2'-indoline]; 6-bromo-3',3'-dimethyl-1'-propylspiro[2H-1-benzopyran-2,2'-indoline]; 5-bromo-1'-dimethylamino-8-methoxy-3'-methyl-6-nitro-3'-phenylspiro[2H-1-benzopyran-2,2'-indoline]; 5-bromo-5',6-dinitro-8-methoxy-1',3',3'-trimethylspiro[2H-1-benzopyran-2,2'-indoline]; 5-bromo-3',3'-diphenyl-8-methoxy-1'-methyl-6-nitrospiro[2H-1-benzopyran-2,2'-indoline]; 5-bromo-4',6'-diphenyl-8-methoxy-6-nitro-1',3',3'-trimethylspiro[2H-1-benzopyran-2,2'-indoline]; 5-bromo-4'-fluoro-8-methoxy-6-nitro-1',3',3'-trimethylspiro[2H-1-benzopyran-2,2'-indoline]; 5-bromo-5'-fluoro-8-methoxy-6-nitro-1',3',3'-trimethylspiro[2H-1-benzopyran-2,2'-indoline]; 8-bromo-7-hydroxy-1',3',3'-trimethylspiro[2H-1-benzopyran-2,2'-indoline]; 5-bromo-8-methoxy-6-nitro-1',3',3',4',7'-pentamethylspiro[2H-1-benzopyran-2,2'-indoline]; 5-bromo-8-methoxy-6-nitro-1',3',3',5',7'-pentamethylspiro[2H-1-benzopyran-2,2'-indoline]; 5-bromo-6-methoxy-8-nitro-5'-phenyl-1',3',3'-trimethylspiro[2H-1-benzopyran-2,2'-indoline]; 5-bromo-6-methoxy-8-nitro-7'-phenyl-1',3',3'-trimethylspiro[2H-1-benzopyran-2,2'-indoline]; 5-bromo-8-methoxy-6-nitro-5'-phenyl-1',3',3'-trimethylspiro[2H-1-benzopyran-2,2'-indoline]; 5-bromo-8-methoxy-6-nitro-7'-phenyl-1',3',3'-trimethylspiro[2H-1-benzopyran-2,2'-indoline]; 5-bromo-8-methoxy-6-nitro-1',3,3',3'-tetramethylspiro[2H-1-benzopyran-2,2'-indoline]; 5-bromo-8-methoxy-6-nitro-1',3',3',5'-tetramethylspiro[2H-1-benzopyran-2,2'-indoline]; 5-bromo-8-methoxy-6-nitro-1',3',3',6'-tetramethylspiro[2H-1-benzopyran-2,2'-indoline]; 5-bromo-8-methoxy-6-nitro-1',3',3',7'-tetramethylspiro[2H-1-benzopyran-2,2'-indoline]; 5-bromo-6-methoxy-8-nitro-1',3',3'-trimethylspiro[2H-1-benzopyran-2,2'-indoline]; 5'-bromo-6-methoxy-8-nitro-1',3',3'-trimethylspiro[2H-1-benzopyran-2,2'-indoline]; 5-bromo-8-methoxy-6-nitro-1',3',3'-trimethylspiro[2H-1-benzopyran-2,2'-indoline]; 5'-bromo-8-methoxy-6-nitro-1',3',3'-trimethylspiro[2H-1-benzopyran-2,2'-indoline]; 6-bromo-8-methoxy-5-nitro-1',3',3'-trimethylspiro[2H-1-benzopyran-2,2'-indoline]; 5-bromo-8-methoxy-6-nitro-1',3',3'-trimethyl-4',6',7'-triphenylspiro[2H-1-benzopyran-2,2'-indoline]; 5-bromo-8-methoxy-1',3',3'-trimethylspiro[2H-1-benzopyran-2,2'-indoline]; 6-bromo-5'-methoxy-1',3',3'-trimethylspiro[2H-1-benzopyran-2,2'-indoline]; 6-bromo-8-methoxy-1',3',3'-trimethylspiro[2H-1-benzopyran-2,2'-indoline]; 6-bromo-8-nitro-1',3,3',3'-tetramethylspiro[2H-1-benzopyran-2,2'-indoline]; 8-bromo-6-nitro-1',3,3',3'-tetramethylspiro[2H-1-benzopyran-2,2'-indoline]; 5-bromo-6-nitro-4',6',8-trimethoxy-1',3',3'-trimethylspiro[2H-1-benzopyran-2,2'-indoline]; 5-bromo-6-nitro-4',7',8-trimethoxy-1',3',3'-trimethylspiro[2H-1-benzopyran-2,2'-indoline]; 5-bromo-6-nitro-1',3',3'-trimethylspiro[2H-1-benzopyran-2,2'-indoline]; 5'-bromo-6-nitro-1',3',3'-trimethylspiro[2H-1-benzopyran-2,2'-indoline]; 6-bromo-8-nitro-1',3',3'-trimethylspiro[2H-1-benzopyran-2,2'-indoline]; 8-bromo-6-nitro-1',3',3'-trimethylspiro[2H-1-benzopyran-2,2'-indoline]; 6-bromo-5'-nitro-1',3',3'-trimethylspiro[2H-1-benzopyran- 2,2'-indoline]; 6-bromo-1',3',3'-trimethylspiro[2H-1-benzopyran-2,2'-indoline]; 1'-butyl-6-chloro-3',3'-dimethyl-8-methoxyspiro[2H-1-benzopyran-2,2'-indoline]; 1'-butyl-3',3'-dimethylspiro[2H-1-benzopyran-2,2'-indoline]; 1'-butyl-3',3'-dimethyl-6,8-dinitrospiro[2H-1-benzopyran-2,2'-indoline]; 1'-butyl-3',3'-dimethyl-8-methoxyspiro[2H-1-benzopyran-2,2'-indoline]; 8-carbomethoxy-5'-chloro-1',3',3'-trimethylspiro[2H-1-benzopyran-2,2'-indoline]; 5'-carbomethoxy-6-nitro-1',3',3'-trimethylspiro[2H-1-benzopyran-2,2'-indoline]; 8-carbomethoxy-6-nitro-1',3',3'-trimethylspiro[2H-1-benzopyran-2,2'-indoline]; 6-carbomethoxy-1',3',3'-trimethylspiro[2H-1-benzopyran-2,2'-indoline]; 8-carbomethoxy-1',3',3'-trimethylspiro[2H-1-benzopyran-2,2'-indoline]; 6-carboxy-8-methoxy-1',3',3'-trimethylspiro[2H-1-benzopyran-2,2'-indoline]; 5'-carboxy-6-nitro-1',3',3'-trimethylspiro[2H-1-benzopyran-2,2'-indoline]; 6-carboxy-1',3',3'-trimethylspiro[2H-1-benzopyran-2,2'-indoline]; 7-carboxy-1',3',3'-trimethylspiro[2H-1-benzopyran-2,2'-indoline]; 8-carboxy-1',3',3'-trimethylspiro[2H-1-benzopyran-2,2'-indoline]; 5'-chloro-6,8-dibromo-1',3',3'-trimethylspiro[2H-1-benzopyran-2,2'-indoline]; 6'-chloro-5,7-dimethoxy-6-nitro-1',3',3',7'-tetramethylspiro[2H-1-benzopyran-2,2'-indoline]; 5'-chloro-5,7-dimethoxy-6-nitro-1',3',3'-trimethylspiro[2H-1-benzopyran-2,2'-indoline]; 5'-chloro-7,8-dimethoxy-6-nitro-1',3',3'-trimethylspiro[2H-1-benzopyran-2,2'-indoline]; 7'-chloro-5,7-dimethoxy-6-nitro-1',3',3'-trimethylspiro[2H-1-benzopyran-2,2'-indoline]; 5'-chloro-5,7-dimethoxy-1',3',3'-trimethylspiro[2H-1-benzopyran-2,2'-indoline]; 6-chloro-5',8-dimethoxy-1',3',3'-trimethylspiro[2H-1-benzopyran-2,2'-indoline]; 6-chloro-7',8-dimethoxy-1',3',3'-trimethylspiro[2H-1-benzopyran-2,2'-indoline]; 6-chloro-3',3'-dimethyl-1'-ethyl-8-methoxyspiro[2H-1-benzopyran-2,2'-indoline]; 5-chloro-1',3'-dimethyl-8-methoxy-6-nitro-3'-phenylspiro[2H-1-benzopyran-2,2'-indoline]; 6-chloro-3',3'-dimethyl-8-methoxy-1'-phenylspiro[2H-1-benzopyran-2,2'-indoline]; 6-chloro-3',3'-dimethyl-8-nitro-1'-phenylspiro[2H-1-benzopyran-2,2'-indoline]; 5'-chloro-5,6-dinitro-8-methoxy-1',3',3'-trimethylspiro[2H-1-benzopyran-2,2'-indoline]; 5'-chloro-6,6'-dinitro-8-methoxy-1',3',3'-trimethylspiro[2H-1-benzopyran-2,2'-indoline]; 5'-chloro-6,8-dinitro-7-methoxy-1',3',3'-trimethylspiro[2H-1-benzopyran- 2,2'-indoline]; 7'-chloro-5,6-dinitro-8-methoxy-1',3',3'-trimethylspiro[2H-1-benzopyran-2,2'-indoline]; 5'-chloro-6,6'-dinitro-1',3',3'-trimethylspiro[2H-1-benzopyran-2,2'-indoline]; 5'-chloro-6,8-dinitro-1',3',3'-trimethylspiro[2H-1-benzopyran-2,2'-indoline]; 6-chloro-5',8-dinitro-1',3',3'-trimethylspiro[2H-1-benzopyran-2,2'-indoline]; 5'-chloro-7-ethoxy-6-nitro-1',3',3'-trimethylspiro[2H-1-benzopyran-2,2'-indoline]; 5-chloro-8-ethoxy-6-nitro-1',3',3'-trimethylspiro[2H-1-benzopyran-2,2'-indoline]; 5'-chloro-8-ethoxy-6-nitro-1',3',3'-trimethylspiro[2H-1-benzopyran-2,2'-indoline]; 5'-chloro-8-ethoxy-1',3',3'-trimethylspiro[2H-1-benzopyran-2,2'-indoline]; 6-chloro-8-ethoxy-1',3',3'-trimethylspiro[2H-1-benzopyran-2,2'-indoline]; 5'-chloro-8-fluoro-6-nitro-1',3',3'-trimethylspiro[2H-1-benzopyran-2,2'-indoline]; 5'-chloro-8-fluoro-1',3',3'-trimethylspiro[2H-1-benzopyran-2,2'-indoline]; 5'-chloro-6-formyl-1',3',3'-trimethylspiro[2H-1-benzopyran-2,2'-indoline]; 5'-chloro-6-hydroxy-8-methoxy-1',3',3'-trimethylspiro[2H-1-benzopyran-2,2'-indoline]; 5'-chloro-6-iodo-8-nitro-1',3',3'-trimethylspiro[2H-1-benzopyran-2,2'-indoline]; 5'-chloro-8-iodo-6-nitro-1',3',3'-trimethylspiro[2H-1-benzopyran-2,2'-indoline]; 5'-chloro-7-methoxy-6-nitro-1',3',3',5-tetramethylspiro[2H-1-benzopyran-2,2'-indoline]; 5-chloro-8-methoxy-6-nitro-1',3',3'-trimethylspiro[2H-1-benzopyran-2,2'-indoline]; 5'-chloro-6-methoxy-8-nitro-1',3',3'-trimethylspiro[2H-1-benzopyran-2,2'-indoline]; 5'-chloro-7-methoxy-6-nitro-1',3',3'-trimethylspiro[2H-1-benzopyran-2,2'-indoline]; 5'-chloro-8-methoxy-5-nitro-1',3',3'-trimethylspiro[2H-1-benzopyran-2,2'-indoline]; 5'-chloro-8-methoxy-6-nitro-1',3',3'-trimethylspiro[2H-1-benzopyran-2,2'-indoline]; 6-chloro-5'-methoxy-8-nitro-1',3',3'-trimethylspiro[2H-1-benzopyran-2,2'-indoline]; 7'-chloro-6-methoxy-8-nitro-1',3',3'-trimethylspiro[2H-1-benzopyran-2,2'-indoline]; 7'-chloro-8-methoxy-6-nitro-1',3',3'-trimethylspiro[2H-1-benzopyran-2,2'-indoline]; 5'-chloro-6-methoxy-1',3',3'-trimethylspiro[2H-1-benzopyran-2,2'-indoline]; 5-chloro-8-methoxy-1',3',3'-trimethylspiro[2H-1-benzopyran-2,2'-indoline]; 5'-chloro-8-methoxy-1',3',3'-trimethylspiro[2H-1-benzopyran-2,2'-indoline]; 6-chloro-5'-methoxy-1',3',3'-trimethylspiro[2H-1-benzopyran-2,2'-indoline]; 6-chloro-8-methoxy-1',3',3'-trimethylspiro[2H-1-benzopyran-2,2'-indoline]; 7-chloro-7'-methoxy-1',3',3'-trimethylspiro[2H- 1-benzopyran-2,2'-indoline]; 5'-chloro-8-methoxy-1',3',3'-trimethyl-5,6,6'-trinitrospiro[2H-1-benzopyran-2,2'-indoline]; 5'-chloro-6-nitro-1',3',3',5,7-pentamethylspiro[2H-1-benzopyran-2,2'-indoline]; 5'-chloro-6-nitro-1',3',3',5,8-pentamethylspiro[2H-1-benzopyran-2,2'-indoline]; 6-chloro-8-nitro-1',3',3',5,7-pentamethylspiro[2H-1-benzopyran-2,2'-indoline]; 7-chloro-6-nitro-1',3,3',3'-tetramethylspiro[2H-1-benzopyran-2,2'-indoline]; 4'-chloro-6-nitro-1',3',3'-trimethylspiro[2H-1-benzopyran-2,2'-indoline]; 5-chloro-6-nitro-1',3',3'-trimethylspiro[2H-1-benzopyran-2,2'-indoline]; 5'-chloro-6-nitro-1',3',3'-trimethylspiro[2H-1-benzopyran-2,2'-indoline]; 5'chloro-8-nitro-1',3',3'-trimethylspiro[2H-1-benzopyran-2,2'-indoline]; 6'-chloro-6-nitro-1',3',3'-trimethylspiro[2H-1-benzopyran-2,2'-indoline]; 6-chloro-8-nitro-1',3',3'-trimethylspiro[2H-1-benzopyran-2,2'-indoline]; 7-chloro-6-nitro-1',3',3'-trimethylspiro[2H-1-benzopyran-2,2'-indoline]; 7'-chloro-6-nitro-1',3',3'-trimethylspiro[2H-1-benzopyran-2,2'-indoline]; 7-chloro-8-nitro-1',3',3'-trimethylspiro[2H-1-benzopyran-2,2'-indoline]; 8-chloro-6-nitro-1',3',3'-trimethylspiro[2H-1-benzopyran-2,2'-indoline]; 5'-chloro-6-(β-nitrovinyl)-1',3',3'-trimethylspiro[2H-1-benzopyran-2,2'-indoline]; 5'-chloro-1',3',3',5,7-pentamethylspiro[2H-1-benzopyran-2,2'-indoline]; 6-chloro-4',7',8-trimethoxy-1',3',3'-trimethylspiro[2H-1-benzopyran-2,2'-indoline]; 5-chloro-1',3',3'-trimethylspiro[2H-1-benzopyran-2,2'-indoline]; 5'-chloro-1',3',3'-trimethylspiro[2H-1-benzopyran-2,2'-indoline]; 6-chloro-1',3',3'-trimethylspiro[2H-1-benzopyran-2,2'-indoline]; 7-chloro-1',3',3'-trimethylspiro[2H-1-benzopyran-2,2'-indoline]; 8-chloro-1',3',3'-trimethylspiro[2H-1-benzopyran-2,2'-indoline]; 6-cyano-1',3',3'-trimethylspiro[2H-1-benzopyran-2,2'-indoline]; 6,8-diallyl-1',3',3'-trimethylspiro[2H-1-benzopyran-2,2'-indoline]; 5,6-dibromo-8-methoxy-1',3',3'-trimethylspiro[2H-1-benzopyran-2,2'-indoline]; 6,8-dibromo-5'-methoxy-1',3',3'-trimethylspiro[2H-1-benzopyran-2,2'-indoline]; 6,8-dibromo-5-nitro-1',3',3'-trimethylspiro[2H-1-benzopyran-2,2'-indoline]; 6,8-dibromo-1',3',3'-trimethylspiro[2H-1-benzopyran-2,2'-indoline]; 4',7'-dichloro-5,7-dimethoxy-6-nitro-1',3',3'-trimethylspiro[2H-1-benzopyran-2,2'-indoline]; 5',8-dichloro-5,7-dimethoxy-6-nitro-1',3',3'-trimethylspiro[2H-1-benzopyran-2,2'-indoline]; 5,6-dichloro-3',3'-dimethyl-8-ethoxy-1'-phenylspiro[2H-1-benzopyran-2,2'-indoline]; 5,7-dichloro-1',3'-dimethyl-6-nitro-3'-phenylspiro[2H-1-benzopyran-2,2'-indoline]; 5,7-dichloro-3',3'-dimethyl-6-nitro-1'-phenylspiro[2H-1-benzopyran-2,2'-indoline]; 4',7'-dichloro-5,6-dinitro-8-methoxy-1',3',3'-trimethylspiro[2H-1-benzopyran-2,2'-indoline]; 4',7'-dichloro-7,8-dinitro-6-methoxy-1',3',3'-trimethylspiro[2H-1-benzopyran-2,2'-indoline]; 5,7-dichloro-5',6-dinitro-1',3',3'-trimethylspiro[2H-1-benzopyran-2,2'-indoline]; 5,7-dichloro-4',6'-diphenyl-6-nitro-1',3',3'-trimethylspiro[2H-1-benzopyran-2,2'-indoline]; 5,6-dichloro-8-ethoxy-1',3',3'-trimethylspiro[2H-1-benzopyran-2,2'-indoline]; 4',7'-dichloro-8-methoxy-6-nitro-1',3',3'-trimethylspiro[2H-1-benzopyran-2,2'-indoline]; 5,7-dichloro-5'-methoxy-6-nitro-1',3',3'-trimethylspiro[2H-1-benzopyran-2,2'-indoline]; 5,7-dichloro-7'-methoxy-6-nitro-1',3',3'-trimethylspiro[2H-1-benzopyran-2,2'-indoline]; 4',7'-dichloro-8-methoxy-1',3',3'-trimethylspiro[2H-1-benzopyran-2,2'-indoline]; 5,6-dichloro-8-methoxy-1',3',3'-trimethylspiro[2H-1-benzopyran-2,2'-indoline]; 5',6-dichloro-8-methoxy-1',3',3'-trimethylspiro[2H-1-benzopyran-2,2'-indoline]; 6,7'-dichloro-8-methoxy-1',3',3'-trimethylspiro[2H-1-benzopyran-2,2'-indoline]; 5,7-dichloro-6-nitro-1',3',3',4',7'-pentamethylspiro[2H-1-benzopyran-2,2'-indoline]; 5,7-dichloro-6-nitro-1',3',3',5',7'-pentamethylspiro[2H-1-benzopyran-2,2'-indoline]; 5,7-dichloro-6-nitro-7'-phenyl-1',3',3'-trimethylspiro[2H-1-benzopyran-2,2'-indoline]; 5,7-dichloro-6-nitro-4',5',6',7'-tetrafluoro-1',3,3'-trimethylspiro[2H-1-benzopyran-2,2'-indoline]; 4',6'-dichloro-6-nitro-1',3',3'-trimethylspiro[2H-1-benzopyran-2,2'-indoline]; 4',7'-dichloro-6-nitro-1',3',3'-trimethylspiro[2H-1-benzopyran-2,2'-indoline]; 5,7-dichloro-6-nitro-1',3',3',5'-tetramethylspiro[2H-1-benzopyran-2,2'-indoline]; 5,5'-dichloro-6-nitro-1',3',3'-trimethylspiro[2H-1-benzopyran-2,2'-indoline]; 5',6-dichloro-8-nitro-1',3',3'-trimethylspiro[2H-1-benzopyran-2,2'-indoline]; 5,7-dichloro-6-nitro-1',3',3'-trimethylspiro[2H-1-benzopyran-2,2'-indoline]; 5,8-dichloro-6-nitro-1',3',3'-trimethylspiro[2H-1-benzopyran-2,2'-indoline]; 5',7'-dichloro-6-nitro-1',3',3'-trimethylspiro[2H-1-benzopyran-2,2'-indoline]; 5',8-dichloro-6-nitro-1',3',3'-trimethylspiro[2H-1-benzopyran-2,2'-indoline]; 6,8-dichloro-5-nitro-1,3',3'-trimethylspiro[2H-1-benzopyran-2,2'-indoline]; 7,8-dichloro-6-nitro-1',3',3'-trimethylspiro[2H-1-benzopyran-2,2'-indoline]; 5,7-dichloro-6-nitro-1',3',3'-trimethyl-4',6',7'-triphenylspiro[2H-1-benzopyran-2,2'-indoline]; 5',6-dichloro-1',3',3'-trimethylspiro[2H-1-benzopyran-2,2'-indoline]; 5,7-dichloro-1',3',3'-trimethylspiro[2H-1-benzopyran-2,2'-indoline]; 5',7-dichloro-1',3',3'-trimethylspiro[2H-1-benzopyran-2,2'-indoline]; 6,8-dichloro-1',3',3'-trimethylspiro[2H-1-benzopyran-2,2'-indoline]; 7,8-dichloro-1',3',3'-trimethylspiro[2H-1-benzopyran-2,2'-indoline]; 4',7'-diethoxy-8-methoxy-1',3',3'-trimethylspiro[2H-1-benzopyran-2,2'-indoline]; 3',3'-diethyl-6-methoxy-1'-methyl-8-nitrospiro[2H-1-benzopyran-2,2'-indoline]; 3',3'-diethyl-8-methoxy-1'-methyl-6-nitrospiro[2H-1-benzopyran-2,2'-indoline]; 3',3'-diethyl-1'-methyl-6-nitrospiro[2H-1-benzopyran-2,2'-indoline]; 1',3'-diethyl-3'-methyl-4',7',8'-trimethoxyspiro[2H-1-benzopyran-2,2'-indoline]; 7-diethylamino-1',3',3'-trimethylspiro[2H-1-benzopyran-2,2'-indoline]; 5,7-dihydroxy-1',3',3'-trimethylspiro[2H-1-benzopyran-2,2'-indoline]; 6,8-diiodo-1',3',3'-trimethylspiro[2H-1-benzopyran-2,2'-indoline]; 5',8'-dimethoxy3',3'-dimethyl-1'-ethylspiro[2H-1-benzopyran-2,2'-indoline]; 5,7-dimethoxy-3',3'-dimethyl-5',6-dinitro-1'-isoamylspiro[2H-1-benzopyran-2,2'-indoline]; 5,7-dimethoxy-1',3'-dimethyl-6-nitro-3'-phenylspiro[2H-1-benzopyran-2,2'-indoline]; 5,7-dimethoxy-3',3'-dimethyl-6-nitro-1'-phenylspiro[2H-1-benzopyran-2,2'-indoline]; 1',8-dimethoxy-5,6-dinitro-3'-methyl-3'-phenylspiro[2H-1-benzopyran-2,2'-indoline]; 4',7'-dimethoxy-6,8-dinitro-1',3',3'-trimethylspiro[2H-1-benzopyran-2,2'-indoline]; 5,7-dimethoxy-6,8-dinitro-1',3',3'-trimethylspiro[2H-1-benzopyran-2,2'-indoline]; 5',8-dimethoxy-5,6-dinitro-1',3',3'-trimethylspiro[2H-1-benzopyran-2,2'-indoline]; 6',8-dimethoxy-5,6-dinitro-1',3',3'-trimethylspiro[2H-1-benzopyran-2,2'-indoline]; 7',8-dimethoxy-5,6-dinitro-1',3',3'-trimethylspiro[2H-1-benzopyran-2,2'-indoline]; 4',7'-dimethoxy-8-ethoxy-1',3',3'-trimethylspiro[2H-1-benzopyran-2,2'-indoline]; 5',7'-dimethoxy-8-ethoxy-1',3',3'-trimethylspiro[2H-1-benzopyran-2,2'-indoline]; 5,7-dimethoxy-4'-fluoro-6-nitro-1',3',3'-trimethylspiro[2H-1-benzopyran-2,2'-indoline]; 5,7-dimethoxy-5'-fluoro-6-nitro-1',3',3'-trimethylspiro[2H-1-benzopyran-2,2'-indoline]; 1',8-dimethoxy-3'-methyl-6-nitro-3'-phenylspiro[2H-1-benzopyran-2,2'-indoline]; 5,7-dimethoxy-6-nitro-7'-phenyl-1',3',3'-trimethylspiro[2H-1-benzopyran-2,2'-indoline]; 4',7'-dimethoxy-6-nitro-1',3',3'-trimethylspiro[2H-1-benzopyran-2,2'-indoline]; 4',7'-dimethoxy-8-nitro-1',3',3'-trimethylspiro[2H-1-benzopyran-2,2'-indoline]; 5',6-dimethoxy-8-nitro-1',3',3'-trimethylspiro[2H-1-benzopyran-2,2'-indoline]; 5,7-dimethoxy-6-nitro-1',3',3'-trimethylspiro[2H-1-benzopyran-2,2'-indoline]; 5',8-dimethoxy-5-nitro-1',3',3'-trimethylspiro[2H-1-benzopyran-2,2'-indoline]; 5',8-dimethoxy-6-nitro-1',3',3'-trimethylspiro[2H-1-benzopyran-2,2'-indoline]; 6,7'-dimethoxy-8-nitro-1',3',3'-trimethylspiro[2H-1-benzopyran-2,2'-indoline]; 7',8-dimethoxy-5-nitro-1',3',3'-trimethylspiro[2H-1-benzopyran-2,2'-indoline]; 7',8-dimethoxy-6-nitro-1',3',3'-trimethylspiro[2H-1-benzopyran-2,2'-indoline]; 5,7-dimethoxy-6-nitro-1',3',3'-trimethyl-4',6',7'-triphenylspiro[2H-1-benzopyran-2,2'-indoline]; 5,7-dimethoxy-1',3',3'-trimethylspiro[2H-1-benzopyran-2,2'-indoline]; 5',8-dimethoxy-1',3',3'-trimethylspiro[2H-1-benzopyran-2,2'-indoline]; 7',8-dimethoxy-1',3',3'-trimethylspiro[2H-1-benzopyran-2,2'-indoline]; 1',3'-dimethyl-6,8-dinitro-3'-ethylspiro[2H-1-benzopyran-2,2'-indoline]; 3',3'-dimethyl-6,8-dinitro-1'-ethylspiro[2H-1-benzopyran-2,2'-indoline]; 3',3'-dimethyl-5,6-dinitro-1'-hexadecyl-8-methoxyspiro[2H-1-benzopyran-2,2'-indoline]; 3',3'-dimethyl-6,8-dinitro-1'-isoamylspiro[2H-1-benzopyran-2,2'-indoline]; 3',3'-dimethyl-5,6-dinitro-1'-isoamyl-8-methoxyspiro[2H-1-benzopyran-2,2'-indoline]; 3',3'-dimethyl-6,8-dinitro-1'-isoamyl-7-methoxyspiro[2H-1-benzopyran-2,2'-indoline]; 1',3'-dimethyl-5,6-dinitro-8-methoxy-3'-phenylspiro[2H-1-benzopyran-2,2'-indoline]; 1',3'-dimethyl-5',6-dinitro-8-methoxy-3'-phenylspiro[2H-1-benzopyran-2,2'-indoline]; 3,3'-dimethyl-5,6-dinitro-8-methoxy-1'-phenylspiro[2H-1-benzopyran-2,2'-indoline]; 3,3'-dimethyl-6,8-dinitro-7-methoxy-1'-phenylspiro[2H-1-benzopyran-2,2'-indoline]; 3',3'-dimethyl-7,8-dinitro-6-methoxy-1'-phenylspiro[2H-1-benzopyran-2,2'-indoline]; 1',3'-dimethyl-6,8-dinitro-3'-phenylspiro[2H-1-benzopyran-2,2'-indoline]; 3',3'-dimethyl-6,8-dinitro-1'-phenylspiro[2H-1-benzopyran-2,2'-indoline]; 3',3'-dimethyl-6,8-dinitro-1'-propylspiro[2H-1-benzopyran-2,2'-indoline]; 1',3'-dimethyl-3',7'-diphenyl-8-methoxy-6-nitrospiro[2H-1-benzopyran-2,2'-indoline]; 3',3'-dimethyl-8-ethoxy-1'-phenylspiro[2H-1-benzopyran-2,2'-indoline]; 1',3'-dimethyl-3'-ethylspiro[2H-1-benzopyran-2,2'-indoline]; 3',3'-dimethyl-1'-ethylspiro[2H-1-benzopyran-2,2'-indoline]; 1',3'-dimethyl-3'-ethyl-8-methoxyspiro[2H-1-benzopyran-2,2'-indoline]; 3',3'-dimethyl-1-ethyl-8-methoxyspiro[2H-1-benzopyran-2,2'-indoline]; 1',3'-dimethyl-3'-ethyl-6-methoxy-8-nitrospiro[2H-1-benzopyran-2,2'-indoline]; 1',3'-dimethyl-3'-ethyl-8-methoxy-5-nitrospiro[2H-1-benzopyran-2,2'-indoline]; 1',3'-dimethyl-3'-ethyl-8-methoxy-6-nitrospiro[2H-1-benzopyran-2,2'-indoline]; 3',3'-dimethyl-1'-ethyl-8-methoxy-6-nitrospiro[2H-1-benzopyran-2,2'-indoline]; 1',3'-dimethyl-3'-ethyl-6-nitrospiro[2H-1-benzopyran-2,2'-indoline]; 3',3'-dimethyl-1'-ethyl-6-nitrospiro[2H-1-benzopyran-2,2'-indoline]; 3',3'-dimethyl-1'-ethyl-8-nitrospiro[2H-1-benzopyran-2,2'-indoline]; 3',3'-dimethyl-1'-hexadecyl-6-nitrospiro[2H-1-benzopyran-2,2'-indoline]; 3',3'-dimethyl-1'-(β-hydroxyethyl)-6-nitrospiro[2H-1-benzopyran-2,2'-indoline]; 3,3'-dimethyl-1'-isoamyl-8-methoxy-5,5',6-trinitrospiro[2H-1-benzopyran-2,2'-indoline]; 3',3'-dimethyl-1'-isoamyl-6-nitrospiro[2H-1-benzopyran-2,2'-indoline]; 3',3'-dimethyl-1'-isoamyl-5',6,8-trinitrospiro[2H-1-benzopyran-2,2'-indoline]; 3',3'-dimethyl-1'-isopropyl-8-methoxy-6-nitrospiro[2H-1-benzopyran-2,2'-indoline]; 1',3'-dimethyl-6-methoxy-8-nitro-3'-phenylspiro[2H-1-benzopyran-2,2'-indoline]; 1',3'-dimethyl-8-methoxy-6-nitro-3'-phenylspiro[2H-1-benzopyran-2,2'-indoline]; 3',3'-dimethyl-6-methoxy-8-nitro-1'-phenylspiro[2H-1-benzopyran-2,2'-indoline]; 3',3'-dimethyl-7-methoxy-6-nitro-1'-phenylspiro[2H-1-benzopyran-2,2'-indoline]; 3',3'-dimethyl-8-methoxy-5-nitro-1'-phenylspiro[2H-1-benzopyran-2,2'-indoline]; 3',3'-dimethyl-8-methoxy-6-nitro-1'-phenylspiro[2H-1-benzopyran-2,2'-indoline]; 3',3'-dimethyl-8-methoxy-6-nitro-1'-propylspiro[2H-1-benzopyran-2,2'-indoline]; 1',3'-dimethyl-8-methoxy-3'-phenylspiro[2H-1-benzopyran-2,2'-indoline]; 3',3'-dimethyl-8-methoxy-1'-phenylspiro[2H-1-benzopyran-2,2'-indoline]; 3',3'-dimethyl-8-methoxy-1'-propylspiro[2H-1-benzopyran-2,2'-indoline]; 1',3'-dimethyl-6-nitro-3'-phenylspiro[2H-1-benzopyran-2,2'-indoline]; 1',3'-dimethyl-8-nitro-3'-phenylspiro[2H-1-benzopyran-2,2'-indoline]; 3',3'-dimethyl-6-nitro-1'-phenylspiro[2H-1-benzopyran-2,2'-indoline]; 3',3'-dimethyl-1'-phenylspiro[2H-1-benzopyran-2,2'-indoline]; 3',3'-dimethyl-1'-propylspiro[2H-1-benzopyran-2,2'-indoline]; 1'-dimethylamino-5,6-dinitro-8-methoxy-3'-methyl-3'-phenylspiro[2H-1-benzopyran-2,2'-indoline]; 1'-dimethylamino- 8-methoxy-3'-methyl-6-nitro-3'-phenylspiro[2H-1-benzopyran-2,2'-indoline]; 1'-dimethylamino-3'-methyl-6-nitro-3'-phenylspiro[2H-1-benzopyran-2,2'-indoline]; 5,6-dinitro-8-methoxy-1',3',3',4',7'-pentamethylspiro[2H-1-benzopyran-2,2'-indoline]; 5,6-dinitro-8-methoxy-7'-phenyl-1',3',3'-trimethylspiro[2H-1-benzopyran-2,2'-indoline]; 5,6-dinitro-8-methoxy-1',3,3',3'-tetramethylspiro[2H-1-benzopyran-2,2'-indoline]; 5,6-dinitro-8-methoxy-1',3',3',5'-tetramethylspiro[2H-1-benzopyran-2,2'-indoline]; 5,5'-dinitro-8-methoxy-1',3',3'-trimethylspiro[2H-1-benzopyran-2,2'-indoline]; 5,6-dinitro-8-methoxy-1',3',3'-trimethylspiro[2H-1-benzopyran-2,2'-indoline]; 5',8-dinitro-6-methoxy-1',3',3'-trimethylspiro[2H-1-benzopyran-2,2'-indoline]; 6,7'-dinitro-8-methoxy-1',3',3'-trimethylspiro[2H-1-benzopyran-2,2'-indoline]; 6,8-dinitro-5'-methoxy-1',3',3'-trimethylspiro[2H-1-benzopyran-2,2'-indoline]; 6,8-dinitro-7-methoxy-1',3',3'-trimethylspiro[2H-1-benzopyran-2,2'-indoline]; 5,6-dinitro-8-methoxy-1',3',3'-trimethyl-4',6',7'-triphenylspiro[2H-1-benzopyran-2,2'-indoline]; 6,8-dinitro-5'-phenyl-1',3',3'-trimethylspiro[2H-1-benzopyran-2,2'-indoline]; 6,8-dinitro-1',3,3',3'-tetramethylspiro[2H-1-benzopyran-2,2'-indoline]; 6,8-dinitro-1',3',3',7'-tetramethylspiro[2H-1-benzopyran-2,2'-indoline]; 5',6-dinitro-1',3',3'-trimethylspiro[2H-1-benzopyran-2,2'-indoline]; 6,8-dinitro-1',3',3'-trimethylspiro[2H-1-benzopyran-2,2'-indoline]; 4',6'-diphenyl-8-methoxy-6-nitro-1',3',3'-trimethylspiro[2H-1-benzopyran-2,2'-indoline]; 3',3'-diphenyl-1'-methyl-6-nitrospiro[2H-1-benzopyran-2,2'-indoline]; 4',6'-diphenyl-6-nitro-1',3',3'-trimethylspiro[2H-1-benzopyran-2,2'-indoline]; 5',7'-diphenyl-6-nitro-1',3',3'-trimethylspiro[2H-1-benzopyran-2,2'-indoline]; 6-ethoxy-8-nitro-1',3',3'-trimethylspiro[2H-1-benzopyran-2,2'-indoline]; 8-ethoxy-6-nitro-1',3',3'-trimethylspiro[2H-1-benzopyran-2,2'-indoline]; 8-ethoxy-1',3',3',4',7'-pentamethylspiro[2H-1-benzopyran-2,2'-indoline]; 8-ethoxy-5'-phenyl-1',3',3'-trimethylspiro[2H-1-benzopyran-2,2'-indoline]; 8-ethoxy-7'-phenyl-1',3',3'-trimethylspiro[2H-1-benzopyran-2,2'-indoline]; 8-ethoxy-1',3',3'-trimethylspiro[2H-1-benzopyran-2,2'-indoline]; 8-ethoxymethyl-6-nitro-1',3',3'-trimethylspiro[2H-1-benzopyran-2,2'-indoline]; 3'-ethyl-8-methoxy-3'-methyl-1'-phenylspiro[2H-1-benzopyran-2,2'-indoline]; 3'-ethyl-3'-methyl-6-nitro-1'-phenylspiro[2H-1-benzopyran- 2,2'-indoline]; 8-ethyl-6-nitro-1',3',3'-trimethylspiro[2H-1-benzopyran-2,2'-indoline]; 4'-fluoro-8-methoxy-6-nitro-1',3',3'-trimethylspiro[2H-1-benzopyran-2,2'-indoline]; 5'-fluoro-6-methoxy-8-nitro-1',3',3'-trimethylspiro[2H-1-benzopyran-2,2'-indoline]; 5'-fluoro-8-methoxy-6-nitro-1',3',3'-trimethylspiro[2H-1-benzopyran-2,2'-indoline]; 4'-fluoro-6-nitro-1',3',3'-trimethylspiro[2H-1-benzopyran-2,2'-indoline]; 5'-fluoro-6-nitro-1',3',3'-trimethylspiro[2H-1-benzopyran-2,2'-indoline]; 6-fluoro-8-nitro-1',3',3'-trimethylspiro[2H-1-benzopyran-2,2'-indoline]; 8-fluoro-6-nitro-1',3',3'-trimethylspiro[2H-1-benzopyran-2,2'-indoline]; 7-fluoro-1',3',3'-trimethylspiro[2H-1-benzopyran-2,2'-indoline];trimethylspioro-1',3',3'-trimethylspiro[2H-1-benzopyran-2,2'-indoline]; 8-Formyl-7-hydroxy-1',3',3'-trimethylspiro[2H-1-benzopyran-2,2'-indoline]; 6-formyl-8-methoxy-1',3',3'-trimethylspiro[2H-1-benzopyran-2,2'-indoline]; 6-formyl-1',3',3'-trimethylspiro[2H-1-benzopyran-2,2'-indoline]; 8-formyl-1',3',3'-trimethylspiro[2H-1-benzopyran-2,2'-indoline]; 1',3',3',5,5',7-hexamethyl-6-nitrospiro[2H-1-benzopyran-2,2'-indoline]; 1',3',3',5,7,8-hexamethyl-6-nitrospiro[2H-1-benzopyran-2,2'-indoline]; 5'-(β-hydroxyethyl)-8-methoxy-6-nitro-1',3',3'-trimethylspiro[2H-1-benzopyran-2,2'-indoline]; 5'-(β-hydroxyethyl)-8-methoxy-1',3',3'-trimethylspiro[2H-1-benzopyran-2,2'-indoline]; 5'-(β-hydroxyethyl)-6-nitro-1',3',3'-trimethylspiro[2H-1-benzopyran-2,2'-indoline]; 5'-(β-Hydroxyethyl)-1',3',3'-trimethylspiro[2H-1-benzopyran-2,2'-indoline]; 6-hydroxy-8-methoxy-1',3',3'-trimethylspiro[2H-1-benzopyran-2,2'-indoline]; 7-hydroxy-5'-nitro-1',3',3'-trimethylspiro[2H-1-benzopyran-2,2'-indoline]; 7-hydroxy-6-nitro-1',3',3'-trimethylspiro[2H-1-benzopyran-2,2'-indoline]; 6-hydroxy-1',3',3'-trimethylspiro[2H-1-benzopyran-2,2'-indoline]; 7-hydroxy-1',3',3'-trimethylspiro[2H-1-benzopyran-2,2'-indoline]; 8-hydroxy-1',3',3'-trimethylspiro[2H-1-benzopyran-2,2'-indoline]; 8-hydroxymethyl-6-nitro-1',3',3'-trimethylspiro[2H-1-benzopyran-2,2'-indoline]; 6-iodo-8-nitro-1',3',3'-trimethylspiro[2H-1-benzopyran-2,2'-indoline]; 8-iodo-6-nitro-1',3',3'-trimethylspiro[2H-1-benzopyran-2,2'-indoline]; 1'-methoxy-3'-methyl-6-nitro-3'-phenylspiro[2H-1-benzopyran-2,2'-indoline]; 5'-methoxy-6-nitro-1',3',3',5,7-pentamethylspiro[2H-1-benzopyran-2,2'-indoline]; 5'-methoxy-6-nitro-1',3',3',5,8-pentamethylspiro[2H-1-benzopyran-2,2'-indoline]; 7'-methoxy- 6-nitro-1',3',3',5,7-pentamethylspiro[2H-1-benzopyran-2,2'-indoline]; 7'-methoxy-6-nitro-1',3',3',5,8-pentamethylspiro[2H-1-benzopyran-2,2'-indoline]; 6-methoxy-8-nitro-5'-phenyl-1',3',3'-trimethylspiro[2H-1-benzopyran-2,2'-indoline]; 6-methoxy-8-nitro-7'-phenyl-1',3',3'-trimethylspiro[2H-1-benzopyran-2,2'-indoline]; 7-methoxy-6-nitro-7'-phenyl-1',3',3'-trimethylspiro[2H-1-benzopyran-2,2'-indoline]; 8-methoxy-5-nitro-5'-phenyl-1',3',3'-trimethylspiro[2H-1-benzopyran-2,2'-indoline]; 8-methoxy-5-nitro-7'-phenyl-1',3',3'-trimethylspiro[2H-1-benzopyran-2,2'-indoline]; 8-methoxy-6-nitro-3-phenyl-1',3',3'-trimethylspiro[2H-1-benzopyran-2,2'-indoline]; 8-methoxy-6-nitro-5'-phenyl-1',3',3'-trimethylspiro[2H-1-benzopyran-2,2'-indoline]; 8-methoxy-6-nitro-7'-phenyl-1',3',3'-trimethylspiro[2H-1-benzopyran-2,2'-indoline]; 6-methoxy-8-nitro-1',3,3',3'-tetramethylspiro[2H-1-benzopyran-2,2'-indoline]; 6-methoxy-8-nitro-1',3',3',5'-tetramethylspiro[2H-1-benzopyran-2,2'-indoline]; 6-methoxy-8-nitro-1',3',3',6'-tetramethylspiro[2H-1-benzopyran-2,2'-indoline]; 6-methoxy-8-nitro-1',3',3',7'-tetramethylspiro[2H-1-benzopyran-2,2'-indoline]; 7-methoxy-6-nitro-1',3,3',3'-tetramethylspiro[2H-1-benzopyran-2,2'-indoline]; 7-methoxy-6-nitro-1',3',3'5'-tetramethylspiro[2H-1-benzopyran-2,2'-indoline]; 8-methoxy-5-nitro-1',3,3',3'-tetramethylspiro[2H-1-benzopyran-2,2'-indoline]; 8-methoxy-5-nitro-1',3',3',6'-tetramethylspiro[2H-1-benzopyran-2,2'-indoline]; 8-methoxy-5-nitro-1',3',3',7'-tetramethylspiro[2H-1-benzopyran-2,2'-indoline]; 8-methoxy-6-nitro-1',3,3',3'-tetramethylspiro[2H-1-benzopyran-2,2'-indoline]; 8-methoxy-6-nitro-1',3',3',4'-tetramethylspiro[2H-1-benzopyran-2,2'-indoline]; 8-methoxy-6-nitro-1',3',3',5'-tetramethylspiro[2H-1-benzopyran-2,2'-indoline]; 8-methoxy-6-nitro-1',3',3',6'-tetramethylspiro[2H-1-benzopyran-2,2'-indoline]; 8-methoxy-6-nitro-1',3',3',7'-tetramethylspiro[2H-1-benzopyran-2,2'-indoline]; 8-methoxy-6-nitro-1',3',3'-triethylspiro[2H-1-benzopyran-2,2'-indoline]; 5'-methoxy-6-nitro-1',3',3'-trimethylspiro[2H-1-benzopyran-2,2'-indoline]; 5'-methoxy-8-nitro-1',3',3'-trimethylspiro[2H-1-benzopyran-2,2'-indoline]; 6-methoxy-8-nitro-1',3',3'-trimethylspiro[2H-1-benzopyran-2,2'-indoline]; 7-methoxy-6-nitro-1',3',3'-trimethylspiro[2H-1-benzopyran-2,2'-indoline]; 7-methoxy-6-nitro-1',3',3'-trimethylspiro[2H-1-benzopyran- 2,2'-indoline]; 7'-methoxy-8-nitro-1',3',3'-trimethylspiro[2H-1-benzopyran-2,2'-indoline]; 8-methoxy-5-nitro-1',3',3'-trimethylspiro[2H-1-benzopyran-2,2'-indoline]; 8-methoxy-5'-nitro-1',3',3'-trimethylspiro[2H-1-benzopyran-2,2'-indoline]; 8-methoxy-6-nitro-1',3',3'-trimethylspiro[2H-1-benzopyran-2,2'-indoline]; 7-methoxy-6-nitro-1',3',3'-trimethyl-4',6',7'-triphenylspiro[2H-1-benzopyran-2,2'-indoline]; 8-methoxy-6-nitro-1',3',3'-trimethyl-4',6',7'-triphenylspiro[2H-1-benzopyran-2,2'-indoline]; 8-methoxy-1',3',3',4',7'-pentamethylspiro[2H-1-benzopyran-2,2'-indoline]; 8-methoxy-5'-phenyl-1',3',3'-trimethylspiro[2H-1-benzopyran-2,2'-indoline]; 8-methoxy-7'-phenyl-1',3',3'-trimethylspiro[2H-1-benzopyran-2,2'-indoline]; 8-methoxy-1',3,3',3'-tetramethylspiro[2H-1-benzopyran-2,2'-indoline]; 8-methoxy-4',6,7'-trichloro-1',3',3'-trimethylspiro[2H-1-benzopyran-2,2'-indoline]; 5'-methoxy-1',3',3'-trimethylspiro[2H-1-benzopyran-2,2'-indoline]; 6-methoxy-1',3',3'-trimethylspiro[2H-1-benzopyran-2,2'-indoline]; 7-methoxy-1',3',3'-trimethylspiro[2H-1-benzopyran-2,2'-indoline]; 8-methoxy-1',3',3'-trimethylspiro[2H-1-benzopyran-2,2'-indoline]; 8-methoxy-1',3',3'-trimethyl-5,5',6-trinitrospiro[2H-1-benzopyran-2,2'-indoline]; 6-nitro-1',3',3',5,7-pentamethylspiro[2H-1-benzopyran-2,2'-indoline]; 6-nitro-1',3',3',5,8-pentamethylspiro[2H-1-benzopyran-2,2'-indoline]; 6-(o-nitrophenylazo)-1',3',3'-trimethylspiro[2H-1-benzopyran-2,2'-indoline]; 6-(p-nitrophenylazo)-1',3',3'-trimethylspiro[2H-1-benzopyran-2,2'-indoline]; 6-nitro-5'-phenyl-1',3',3'-trimethylspiro[2H-1-benzopyran-2,2'-indoline]; 6-nitro-7'-phenyl-1',3',3'-trimethylspiro[2H-1-benzopyran-2,2'-indoline]; 8-nitro-5'-phenyl-1',3',3'-trimethylspiro[2H-1-benzopyran-2,2'-indoline]; 8-nitro-7'-phenyl-1',3',3'-trimethylspiro[2H-1-benzopyran-2,2'-indoline]; 6-nitro-8-piperidinomethyl-1',3',3'-trimethylspiro[2H-1-benzopyran-2,2'-indoline]; 7-nitro-5,5',6,8-tetrachloro-1',3',3'-trimethylspiro[2H-1-benzopyran-2,2'-indoline]; 6-nitro-4',5',6',7'-tetrafluoro-1',3',3'-trimethylspiro[2H-1-benzopyran-2,2'-indoline]; 6-nitro-1',3,3',3'-tetramethylspiro[2H-1-benzopyran-2,2'-indoline]; 6-nitro-1',3',3',5'-tetramethylspiro[2H-1-benzopyran-2,2'-indoline]; 6-nitro-1',3',3',6'-tetramethylspiro[2H-1-benzopyran-2,2'-indoline]; 6-nitro-1',3',3',7'-tetramethylspiro[2H-1-benzopyran-2,2'-indoline]; 6-nitro-1',3',3',8-tetramethylspiro[2H-1-benzopyran-2,2'-indoline]; 8-nitro-1',3,3',3'-tetramethylspiro[2H-1-benzopyran-2,2'-indoline]; 8-nitro-1',3',3',6'-tetramethylspiro[2H-1-benzopyran-2,2'-indoline]; 8-nitro-1',3',3',7'-tetramethylspiro[2H-1-benzopyran-2,2'-indoline]; 5-nitro-5',6,8-trichloro-1',3',3'-trimethylspiro[2H-1-benzopyran-2,2'-indoline]; 6-nitro-5,5',7-trichloro-1',3',3'-trimethylspiro[2H-1-benzopyran-2,2'-indoline]; 6-nitro-5,5',8-trichloro-1',3',3'-trimethylspiro[2H-1-benzopyran-2,2'-indoline]; 6-nitro-5,7,7'-trichloro-1',3',3'-trimethylspiro[2H-1-benzopyran-2,2'-indoline]; 6-nitro-5',7,8-trichloro-1',3',3'-trimethylspiro[2H-1-benzopyran-2,2'-indoline]; 7-nitro-5,6,8-trichloro-1',3',3'-trimethylspiro[2H-1-benzopyran-2,2'-indoline]; 5-nitro-4',7',8-trimethoxy-1',3',3'-trimethylspiro

[2H-1-benzopyran-2,2'-indoline]; 6-nitro-4',6',8-trimethoxy-1',3',3'-trimethylspiro[2H-1-benzopyran-2,2'-indoline]; 6-nitro-4',7',8-trimethoxy-1',3',3'-trimethylspiro[2H-1-benzopyran-2,2'-indoline]; 8-nitro-4',6,7'-trimethoxy-1',3',3'-trimethylspiro[2H-1-benzopyran-2,2'-indoline]; 5-nitro-1',3',3'-trimethylspiro[2H-1-benzopyran-2,2'-indoline]; 5'-nitro-1',3',3'-trimethylspiro[2H-1-benzopyran-2,2'-indoline]; 6-nitro-1',3',3'-trimethylspiro[2H-1-benzopyran-2,2'-indoline]; 7-nitro-1',3',3'-trimethylspiro[2H-1-benzopyran-2,2'-indoline]; 8-nitro-1',3',3'-trimethylspiro[2H-1-benzopyran-2,2'-indoline]; 6-(β-nitrovinyl)-1',3',3'-trimethylspiro[2H-1-benzopyran-2,2'-indoline]; 6-nitro-1',3',3'trimethyl-4',6',7'-triphenylspiro[2H-1-benzopyran-2,2'-indoline]; 1',3',3',5,7-pentamethylspiro[2H-1-benzopyran-2,2'-indoline]; 1',3',3',6,8-pentamethylspiro[2H-1-benzopyran-2,2'-indoline]; 7'-phenyl-1',3',3'-trimethylspiro[2H-1-benzopyran-2,2'-indoline]; 6-phenylazo-1',3',3'-trimethylspiro[2H-1-benzopyran-2,2'-indoline]; 1',3,3',3'-tetramethylspiro[2H-1-benzopyran-2,2'-indoline]; 1',3',3',5'-tetramethylspiro[2H-1-benzopyran-2,2'-indoline]; 1',3',3',6-tetramethylspiro[2H-1-benzopyran-2,2'-indoline]; 1',3'3',7'-tetramethylspiro[2H-1-benzopyran-2,2'-indoline]; 1',3',3',8-tetramethylspiro[2H-1-benzopyran-2,2'-indoline]; 5,6,8-trichloro-1',3',3'-trimethylspiro[2H-1-benzopyran-2,2'-indoline]; 4',6',8-trimethoxy-1',3',3'-trimethylspiro[2H-1-benzopyran-2,2'-indoline]; 4',7',8-trimethoxy-1',3',3'-trimethylspiro[2H-1-benzopyran-2,2'-indoline]; 5',7',8-trimethoxy-1',3',3'-trimethylspiro[2H-1-benzopyran-2,2'-indoline]; 1',3',3'-trimethylspiro[2H-1-benzopyran-2,2'-indoline]; 1',3',3'-trimethyl-5',6,8-trinitrospiro[2H-1-benzopyran-2,2'-indoline]; 1',3',3'-trimethyl-4',6',7'-triphenylspiro[2H-1-benzopyran-2,2'-indoline]; spiro[2H-1-benzopyran-2,2'-[1H]-benzo[g]indoline]; 8-methoxy-6-nitro-1',3',3'-trimethylspiro[2H-1-benzopyran-2,2'-[1H]-benzo[glindoline]; 6-nitro-1',3',3'-trimethylspiro[2H-1-benzopyran-2,2'-[1H]-benzo[g]indoline]; spiro[2H-benzopyran-2,2,-[1H]-benzo[e]indoline]; 6-nitro-1',3',3'-trimethylspiro[2H-benzopyran-2,2,-[1H]-benzo[e]indoline]; spiro[indoline-2,3'-[3H]-naphtho[2,1-b]pyran]; 8'-bromo-1,3,3-trimethylspiro[indoline-2,3'-[3H]-naphtho[2,1-b]pyran]; 1-butyl-3,3-dimethylspiro[indoline-2,3'-[3H]-naphtho[2,1-bipyran]; 1-butyl-3,3-dimethyl-8-nitrospiro[indoline-2,3'-[3H]-naphtho[2,1-b]pyran]; 5'-carboxy-5-chloro-1,3,3-trimethylspiro[indoline-2,3'-[3H]-naphtho[2,1-b]pyran]; 5'-carboxy-1,3,3-trimethylspiro[indoline-2,3'-[3H]-naphtho[2,1-b]pyran]; 5-chloro-1,3,3-trimethylspiro[indoline-2,3'-[3H]-naphtho[2,1-b]pyran]; 5-chloro-8'-nitro-1,3,3-trimethylspiro[indoline-2,3'-[3H]-naphtho[2,1-b]pyran]; 4,7-dimethoxy-1,3,3-trimethylspiro[indoline-2,3'-[3H]-naphtho[2,1-b]pyran]; 1,3-dimethyl-3-ethylspiro[indoline-2,3'-[3H]-naphtho[2,1-b]pyran]; 3,3-dimethyl-1-ethylspiro[indoline-2,3'-[3H]-naphtho[2,1-b]pyran]; 3,3-dimethyl-1-ethyl-8'-nitrospiro[indoline-2,3'-[3H]-naphtho[2,1-b]pyran]; 3,3-dimethyl-1-propylspiro[indoline-2,3'-[3H]-naphtho[2,1-b]pyran]; 3,3-dimethyl-1-propyl-8'-nitrospiro[indoline-2,3'-[3H]-naphtho[2,1-b]pyran]; 9'-hydroxy-1,3,3-trimethylspiro[indoline-2,3'-[3H]-naphtho[2,1-b]pyran]; 5-(β-hydroxyethyl)-1,3,3-trimethylspiro[indoline-2,3'-[3H]-naphtho[2,1-b]pyran]; 5-methoxy-8'-nitro-1,3,3-trimethylspiro[indoline-2,3'-[3H]-naphtho[2,1-b]pyran]; 5'-methoxy-8'-nitro-1,3,3-trimethylspiro[indoline-2,3'-[3H]-naphtho[2,1-b]pyran]; 5'-methoxy-10'-nitro-1,3,3-trimethylspiro[indoline-2,3'-[3H]-naphtho[2,1-b]pyran]; 5-methoxy-1,3,3-trimethylspiro[indoline-2,3'-[3H]-naphtho[2,1-b]pyran]; 5'-methoxy-1,3,3-trimethylspiro[indoline-2,3'-[3H]-naphtho[2,1-b]pyran]; 7'-nitro-1,3,3-trimethylspiro[indoline-2,3'-[3H]-naphtho[2,1-b]pyran]; 8'-nitro-1,3,3-trimethylspiro[indoline-2,3'-[3H]-naphtho[2,1-b]pyran]; 10'-nitro-1,3,3-trimethylspiro[indoline-2,3'-[3H]-naphtho[2,1-b]pyran]; 1,3,3,4,7-pentamethylspiro[indoline-2,3'-[3H]-naphtho[2,1-b]pyran]; 1,3,3,5,7-pentamethylspiro[indoline-2,3'-[3H]-naphtho[2,1-b]pyran]; 5-phenyl-1,3,3-trimethylspiro[indoline-2,3'-[3H]-naphtho[2,1-b]pyran]; 7-phenyl-1,3,3-trimethylspiro[indoline-2,3'-[3H]-naphtho[2,1-b]pyran]; 1,2',3,3-tetramethylspiro[indoline-2,3'-[3H]-naphtho[2,1-b]pyran]; 1,3,3,5-tetramethylspiro[indoline-2,3'-[3H]-naphtho[2,1-b]pyran]; 1,3,3,7-tetramethylspiro[indoline-2,3'-[3H]-naphtho[2,1-b]pyran]; 1,3,3,-trimethylspiro[indoline-2,3'-[3H]-naphtho[2,1-b]pyran]; spiro[indoline-2,2'-[2H]-phenanthro[2,1-b]pyran]; 1,3,3,-trimethylspiro[indoline-2,2'-[2H]-phenanthro[2,1-b]pyran]; spiro[3H-anthra[2,1-b]pyran-3,2'-indoline]; 1',3',3'-trimethylspiro[3H-anthra[2,1-b]pyran-3,2'-indoliine]; spiro[indoline-2,3'-(3H]-phenanthro[3,4-b]pyran]; 1,3,3-trimethylspiro[indoline-2,3'-(3H]-phenanthro[3,4-b]pyran]; spiro[indoline-2,2'-[2H]-naphtho[1,2-b]pyran]; 6'-chloro-1,3,3-trimethylspiro[indoline-2,2'-[2H]-naphtho[1,2-b]pyran]; 6'-nitro-1,3,3-trimethylspiro[indoline-2,2'-[2H]-naphtho[1,2-b]pyran]; 1,3,3-trimethylspiro[indoline-2,2'-[2H]-naphtho[1,2-b]pyran]; spiro[indoline-2,2'-[2H]-naphtho[2,3-b]pyran]; 10'-nitro-1,3,3-trimethylspiro[indoline-2,2'-[2H]-naphtho[2,3-b]pyran]; 1,3,3-trimethylspiro[indoline-2,2'-[2H]-naphtho[2,3-b]pyran]; spiro[2H-1-benzopyran-2,2'-benzothiazoline]; 6'-acetamido-3,3'-dimethyl-6-nitrospiro[2H-1-benzopyran-2,2'-benzothiazoline]; 6'-amino-3,3'-dimethyl-6-nitrospiro[2H-1-benzopyran-2,2'-benzothiazoline]; 6-bromo-3,3'-dimethylspiro[2H-1-benzopyran-2,2'-benzothiazoline]; 6-bromo-3,3'-dimethyl-6'-methoxyspiro[2H-1-benzopyran-2,2'-benzothiazoline]; 6'-bromo-3,3'-dimethyl-8-methoxy-6-nitrospiro[2H-1-benzopyran-2,2'-benzothiazoline]; 6-bromo-3,3'-dimethyl-6'-methylthiospiro[2H-1-benzopyran-2,2'-benzothiazoline]; 6-bromo-3,3'-dimethyl-6'-nitrospiro[2H-1-benzopyran-2,2'-benzothiazoline]; 8-bromo-3,3'-dimethyl-6-nitrospiro[2H-1-benzopyran-2,2'-benzothiazoline]; 6-bromo-3'-methylspiro[2H-1-benzopyran-2,2'-benzothiazoline]; 3'-butyl-6-nitro-3-phenylspiro[2H-1-benzopyran-2,2'-benzothiazoline]; 8-carbethoxy-3,3'-dimethylspiro[2H-1-benzopyran-2,2'-benzothiazoline]; 8-carbethoxy-3,3'-dimethyl-6-nitrospiro[2H-1-benzopyran-2,2'-benzothiazoline]; 8-carboxy-3,3'-dimethylspiro[2H-1-benzopyran-2,2'-benzothiazoline]; 6'-carboxy-3,3'-dimethyl-8-methoxy-6-nitrospiro[2H-1-benzopyran-2,2'-benzothiazoline]; 8-carboxy-3,3'-dimethyl-6-nitrospiro[2H-1-benzopyran-2,2'-benzothiazoline]; 6'-chloro-3,3'-dimethyl-8-methoxy-6-nitrospiro[2H-1-benzopyran-2,2'-benzothiazoline]; 6-chloro-3,3'-dimethyl-8-nitrospiro[2H-1-benzopyran-2,2'-benzothiazoline]; 3-(p-chlorophenyl)-8-methoxy-3'-methyl-6-nitrospiro[2H-1-benzopyran-2,2'-benzothiazoline]; 6'-cyano-3,3'-dimethyl-8-methoxy-6-nitrospiro[2H-1-benzopyran-2,2'-benzothiazoline]; 6,6'-dibromo-3,3'-dimethylspiro[2H-1-benzopyran-2,2'-benzothiazoline]; 6',8-dimethoxy-3,3'-dimethylspiro[2H-1-benzopyran-2,2'-benzothiazoline]; 6',8-dimethoxy-3,3'-dimethyl-6,7'-dinitrospiro[2H-1-benzopyran-2,2'-benzothiazoline]; 6',8-dimethoxy-3,3'-dimethyl-6-nitrospiro[2H-1-benzopyran-2,2'-benzothiazoline]; 6',8-dimethoxy-3'-ethyl-3-methyl-6-nitrospiro[2H-1-benzopyran-2,2'-benzothiazoline]; 3,3'-dimethylspiro[2H-1-benzopyran-2,2'-benzothiazoline]; 3,3'-dimethyl-6,6'-dinitrospiro[2H-1-benzopyran-2,2'-benzothiazoline]; 3,3'-dimethyl-6,6'-dinitro-8-methoxyspiro[2H-1-benzopyran-2,2'-benzothiazoline]; 3,3'-dimethyl-6'- hydroxy-8-methoxy-6-nitrospiro[2H-1-benzopyran-2,2'-benzothiazoline]; 3,3'-dimethyl-5'-isobutyramido-6-nitrospiro[2H-1-benzopyran-2,2'-benzothiazoline]; 3,3'-dimethyl-5'-methacrylamido-6-nitrospiro[2H-1-benzopyran-2,2'-benzothiazoline]; 3,3'-dimethyl-8-methoxyspiro[2H-1-benzopyran-2,2'-benzothiazoline]; 3,3'-dimethyl-8-methoxy-6'-methylthio-6-nitrospiro[2H-1-benzopyran-2,2'-benzothiazoline]; 3,3'-dimethyl-6'-methoxy-6-nitrospiro[2H-1-benzopyran-2,2'-benzothiazoline]; 3,3'-dimethyl-8-methoxy-5-nitrospiro[2H-1-benzopyran-2,2'-benzothiazoline]; 3,3'-dimethyl-8-methoxy-6-nitrospiro[2H-1-benzopyran-2,2'-benzothiazoline]; 3,3'-dimethyl-6'-methylthio-6-nitrospiro[2H-1-benzopyran-2,2'-benzothiazoline]; 3,3'-dimethyl-6-nitrospiro[2H-1-benzopyran-2,2'-benzothiazoline]; 3,3'-dimethyl-8-nitrospiro[2H-1-benzopyran-2,2'-benzothiazoline]; 3'-ethyl-8-methoxy-3-methylspiro[2H-1-benzopyran-2,2'-benzothiazoline]; 3-ethyl-8-methoxy-3'-methyl-6-nitrospiro[2H-1-benzopyran-2,2'-benzothiazoline]; 3'-ethyl-6'-methoxy-3-methyl-6-nitrospiro[2H-1-benzopyran-2,2'-benzothiazoline]; 3'-ethyl-8-methoxy-3-methyl-6-nitrospiro[2H-1-benzopyran-2,2'-benzothiazoline]; 3-ethyl-3'-methyl-6-nitrospiro[2H-1-benzopyran-2,2'-benzothiazoline]; 3'-ethyl-3-methyl-6-nitrospiro[2H-1-benzopyran- 2,2'-benzothiazoline]; 3'-ethyl-8-methoxy-6-nitro-3-phenylspiro[2H-1-benzopyran-2,2'-benzothiazoline]; 3'-ethyl-6-nitrospiro[2H-1-benzopyran-2,2'-benzothiazoline]; 3'-ethyl-6-nitro-3-phenylspiro[2H-1-benzopyran-2,2'-benzothiazoline]; 3-isopropyl-8-methoxy-3'-methyl-6-nitrospiro[2H-1-benzopyran-2,2'-benzothiazoline]; 3'-isopropyl-8-methoxy-3methyl-6-nitrospiro[2H-1-benzopyran-2,2'-benzothiazoline]; 7-methoxy-3'-methylspiro[2H-1-benzopyran-2,2'-benzothiazoline]; 8-methoxy-3'-methyl-6-nitro-3-phenylspiro[2H-1-benzopyran-2,2'-benzothiazoline]; 8-methoxy-3'-methyl-6-nitro-3-propylspiro[2H-1-benzopyran-2,2'-benzothiazoline]; 3'-methylspiro[2H-1-benzopyran-2,2'-benzothiazoline]; 3'-methyl-6-nitrospiro[2H-1-benzopyran-2,2'-benzothiazoline]; 3'-methyl-6-nitro-3-phenylspiro[2H-1-benzopyran-2,2'-benzothiazoline]; 3'-methyl-6-nitro-3-propylspiro[2H-1-benzopyran-2,2'-benzothiazoline]; 6-nitro-3-phenyl-3'-propylspiro[2H-1-benzopyran-2,2'-benzothiazoline]; spiro[benzothiazoline-2,3,'-[3H]-naphtho[2,1-b]pyran]; 2',3-dimethylspiro[benzothiazoline-2,3,'-[3H]-naphtho[2,1-b]pyran]; 2',3-dimethyl-6-methoxyspiro[benzothiazoline-2,3,'-[3H]-naphtho[2,1-b]pyran]; 3-ethylspiro[benzothiazoline-2,3,'-[3H]-naphtho[2,1-b]pyran]; 3-ethyl-2'-methylspiro[benzothiazoline-2,3,'-[3H]-naphtho[2,1-b]pyran]; 3-methylspiro[benzothiazoline-2,3,'-[3H]-naphtho[2,1-b]pyran]; spiro[2H-1-benzopyran-2,2'-benzoxazoline]; 8-bromo-3'-methyl-6-nitrospiro[2H-1-benzopyran-2,2'-benzoxazoline]; 5'-chloro-3,3'-dimethyl-6-nitrospiro[2H-1-benzopyran-2,2'-benzoxazoline]; 6-chloro-3,3'-dimethyl-8-nitrospiro[2H-1-benzopyran-2,2'-benzoxazoline]; 3,3'-dimethyl-6-methoxy-8-nitrospiro[2H-1-benzopyran-2,2'-benzoxazoline]; 3,3'-dimethyl-8-methoxy-6-nitrospiro[2H-1-benzopyran-2,2'-benzoxazoline]; 3,3'-dimethyl-8-methoxy-6-nitro-5'-phenylspiro[2H-1-benzopyran-2,2'-benzoxazoline]; 3,3'-dimethyl-6-nitrospiro[2H-1-benzopyran-2,2'-benzoxazoline]; 3,3'-dimethyl-8-nitrospiro[2H-1-benzopyran-2,2'-benzoxazoline]; 3,3'-dimethyl-6-nitro-5'-phenylspiro[2H-1-benzopyran-2,2'-benzoxazoline]; 3-ethyl-3'-methyl-6-nitrospiro[2H-1-benzopyran-2,2'-benzoxazoline]; 8-methoxy-6-nitro-3,3',5',7'-tetramethylspiro[2H-1-benzopyran-2,2'-benzoxazoline]; 8-methoxy-6-nitro-3,3',5'-trimethylspiro[2H-1-benzopyran-2,2'-benzoxazoline]; 6-nitro- 3,3',5'-trimethylspiro[2H-1-benzopyran-2,2'-benzoxazoline]; 8-nitro-3,3',5'-trimethylspiro[2H-1-benzopyran-2,2'-benzoxazoline]; spiro[2H-1-benzopyran-2,2'-naphth[2,3-dioxazoline]; 3,3'-dimethyl-8-methoxy-6-nitrospiro[2H-1-benzopyran-2,2'-naphth[2,3-dioxazoline]; 3,3'-dimethyl-6-nitrospiro[2H-1-benzopyran-2,2'-naphth[2,3-d]oxazoline]; spiro[2H-1-benzopyran-2,2'-naphth[2,1-d]oxazoline]; 3,3'-dimethyl-8-methoxy-6-nitrospiro[2H-1-benzopyran-2,2'-naphth[2,1-dioxazoline]; 2,2'-spirobi[2H-1-benzopyran]; 3-amyl-2,2'-spirobi[2H-1-benzopyran]; 3-amyl-6'-bromo-2,2'-spirobi[2H-1-benzopyran]; 3-amyl-6-bromo-6'-methyl-2,2'-spirobi[2H-1-benzopyran]; 3-amyl-6'-bromo-6-methyl-2,2'-spirobi[2H-1-benzopyran]; 3-amyl-6,6'-dibromo-2,2'-spirobi[2H-1-benzopyran]; 3-amyl-6,6'-dimethyl-2,2'-spirobi[2H-1-benzopyran]; 3-amyl-6-methyl-2,2'-spirobi[2H-1-benzopyran]; 5-bromo-8,8'-dimethoxy-6-nitro-3'-phenyl-2,2'-spirobi[2H-1-benzopyran]; 6-bromo-6'-nitro-3-phenyl-2,2'-spirobi[2H-1-benzopyran]; 6-bromo-3'-phenyl-2,2'-spirobi[2H-1-benzopyran]; 3-benzyl-2,2'-spirobi[2H-1-benzopyran]; 3-butyl-2,2'-spirobi[2H-1-benzopyran]; 6-chloro-6'-nitro-3-phenyl-2,2'-spirobi[2H-1-benzopyran]; 8-chloro-6-nitro-3'-phenyl-2,2'-spirobi[2H-1-benzopyran]; 6,6'-dibromo-3,3'-dimethylene-2,2'-spirobi[2H-1-benzopyran]; 8,8'-dimethoxy-6'-nitro-3-phenyl-2,2'-spirobi[2H-1-benzopyran]; 3,3'-dimethyl-2,2'-spirobi[2H-1-benzopyran]; 6,6-dimethyl-3',3'-dimethylene-2,2'-spirobi[2H-1-benzopyran]; 3,3'-dimethylene-2,2'-spirobi[2H-1-benzopyran]; 6,6'-dinitro-3,3'-diphenyl-2,2'-spirobi[2H-1-benzopyran]; 3,3'-diphenyl-2,2'-spirobi[2H-1-benzopyran]; 3-ethyl-2,2'-spirobi[2H-1-benzopyran]; 8-fluoro-6-nitro-3'-phenyl-2,2'-spirobi[2H-1-benzopyran]; 8-iodo-6-nitro-3'-phenyl-2,2'-spirobi[2H-1-benzopyran]; 8'-methoxy-3-methyl-6-nitro-2,2'-spirobi[2H-1-benzopyran]; 8-methoxy-6-nitro-3'-phenyl-2,2'-spirobi[2H-1-benzopyran]; 8-methoxy-6'-nitro-3-phenyl-2,2'-spirobi[2H-1-benzopyran]; 8-methoxy-8'-nitro-3-phenyl-2,2'-spirobi[2H-1-benzopyran]; 8'-methoxy-6-nitro-3-phenyl-2,2'-spirobi[2H-1-benzopyran]; 3-methyl-2,2'-spirobi[2H-1-benzopyran]; 3-methyl-6-nitro-2,2'-spirobi[2H-1-benzopyran]; 6-nitro-3'-phenyl-2,2'-spirobi[2H-1-benzopyran]; 3-phenyl-2,2'-spirobi[2H-1-benzopyran]; 3,3'-tetramethylene-2,2'-spirobi[2H-1-benzopyran]; 3,3'-trimethylene-2,2'-spirobi[2H-1-benzopyran]; ; 3,3'-spirobi[3H-naphtho[2,1-b]pyran]; 2-amyl- 3,3'-spirobi[3H-naphtho[2,1-bipyran]; 2-benzyl-3,3'-spirobi[3H-naphtho[2,1-b]pyran]; 2-butyl-3,3'-spirobi[3H-naphtho[2,1-b]pyran]; 2-chloro-3,3'-spirobi[3H-naphtho[2,1-b]pyran]; 2-chloro-8,8'-dinitro-3,3'-spirobi[3H-naphtho[2,1-b]pyran]; 2-decyl-3,3'-spirobi[3H-naphtho[2,1-b]pyran]; 8,8'-dibromo-3,3'-spirobi[3H-naphtho[2,1-b]pyran]; 2,2'-dicarboethoxy-3,3'-spirobi[3H-naphtho[2,1-b]pyran]; 2,2'-dicarbomethoxy-3,3'-spirobi[3H-naphtho[2,1-b]pyran]; 2,2'-diethyl-3,3'-spirobi[3H-naphtho[2,1-b]pyran]; 5,5'-dimethoxy-3,3'-spirobi[3H-naphtho[2,1-b]pyran]; 5,5'-dimethoxy-8,8'-dinitro-3,3'-spirobi[3H-naphtho[2,1-b]pyran]; 5,5'-dimethoxy-10,10'-dinitro-3,3'-spirobi[3H-naphtho[2,1-b]pyran]; 9,9'-dimethoxy-8,8'-dinitro-3,3'-spirobi[3H-naphtho[2,1-b]pyran]; 2,2'-dimethyl-3,3'-spirobi[3H-naphtho[2,1-b]pyran]; 2,2'-dimethyl-8,8'-dinitro-3,3'-spirobi[3H-naphtho[2,1-b]pyran]; 5,5'-dimethyl-10,10'-dinitro-3,3'-spirobi[3H-naphtho[2,1-b]pyran]; 9,9'-dimethyl-8,8'-dinitro-3,3'-spirobi[3H-naphtho[2,1-b]pyran]; 9,9-dimethyl-7,7'-dinitro-3,3'-spirobi[3H-naphtho[2,1-b]pyran]; 2-(γ,γ-dimethylallyl)-3,3'-spirobi[3H-naphtho[2,1-b]pyran]; 2,2'-dimethylene-3,3'-spirobi[3H-naphtho[2,1-b]pyran]; 7,7'-dinitro-3,3'- spirobi[3H-naphtho[2,1-b]pyran]; 8,8'-dinitro-3,3'-spirobi [3H-naphtho[2,1-b]pyran]; 9,9'-dinitro-3,3'-spirobi[3H-naphtho[2,1-b]pyran]; 10,10'-dinitro-3,3'-spirobi[3H-naphtho[2,1-b]pyran]; 8,8'-dinitro-2-methyl-3,3'-spirobi [3H-naphtho[2,1-b]pyran]; 8,8'-dinitro-2,2'-(2"methyl) trimethylene-3,3'-spirobi[3H-naphtho[2,1-b]pyran]; 8,8'-dinitro-2-phenyl-3,3'-spirobi[3H-naphtho[2,1-b]pyran]; 8,8'-dinitro-2,2'-trimethylene-3,3'-spirobi[3H-naphtho[2,1-b]pyran]; 2,2'-diphenyl-3,3'-spirobi[3H-naphtho[2,1-b] pyran]; 2-ethyl-3,3'-spirobi[3H-naphtho[2,1-b]pyran]; 2-heptyl-3,3'-spirobi[3H-naphtho[2,1-b]pyran]; 2-hexyl-3,3'-spirobi[3H-naphtho[2,1-b]pyran]; 2-isobutyl-3,3'-spirobi [3H-naphtho[2,1-b]pyran]; 2-isopropyl-3,3'-spirobi[3H-naphtho[2,1-b]pyran]; 2-methyl-3,3'-spirobi[3H-naphtho[2,1-b]pyran]; 2,2'-(2"-methyl)trimethylene-3,3'-spirobi[3H-naphtho[2,1-b]pyran]; 8'-nitro-2-phenyl-3,3'-spirobi[3H-naphtho[2,1-b]pyran]; 2-octyl-3,3'-spirobi[3H-naphtho[2,1-b]pyran]; 2-phenyl-3,3'-spirobi[3H-naphtho[2,1-b]pyran]; 2-(β-phenylethyl)-3,3'-spirobi[3H-naphtho[2,1-b]pyran]; 2-propyl-3,3'-spirobi[3H-naphtho[2,1-b]pyran]; 2,2'-tetramethylene-3,3'-spirobi[3H-naphtho[2,1-b]pyran]; 2,2'-trimethylene- 3,3'-spirobi[3H-naphtho[2,1-b]pyran]; 2,2'-spirobi[2H-naphtho[1,2-b]pyran]; 3-amyl-2,2'-spirobi[2H-naphtho[1,2-b]pyran]; 6,6'-dichloro-2,2'-spirobi[2H-naphtho[1,2-b]pyran]; 7,7'-dinitro-2,2'-spirobi[2H-naphtho [1,2-b]pyran]; 8,8'-dinitro-2,2'-spirobi[2H-naphtho[1,2-b] pyran]; 9,9'-dinitro-2,2'-spirobi[2H-naphtho[1,2-b]pyran]; 10,10'-dinitro-2,2'-spirobi[2H-naphtho[1,2-b]pyran]; 3-phenyl-2,2'-spirobi[2H-naphtho[1,2-b]pyran]; 2,2'-spirobi [2H-naphtho[2,3-b]pyran]; spiro[2H-1-benzopyran-2,3'-[3H]-naphtho[2,1-b]pyran]; 2'-amylspiro[2H-1-benzopyran-2,3'-[3H]-naphtho[2,1-b]pyran]; 3-amylspiro [2H-1-benzopyran-2,3'-[3H]-naphtho[2,1-b]pyran]; 3-amyl-6-bromospiro[2H-1-benzopyran-2,3'-[3H]-naphtho[2,1-b] pyran]; 3-amyl-7-chlorospiro[2H-1-benzopyran-2,3'-[3H]-naphtho[2,1-b]pyran]; 3-amyl-6-hydroxyspiro[2H-1-benzopyran-2,3'-[3H]-naphtho[2,1-b]pyran]; 3-amyl-6-methoxyspiro[2H-1-benzopyran-2,3'-[3H]-naphtho[2,1-b] pyran]; 3-amyl-7-methoxyspiro[2H-1-benzopyran-2,3'-[3H] -naphtho[2,1-b]pyran]; 3-amyl-6-methylspiro[2H-1-benzopyran-2,3'-[3H]-naphtho[2,1-b]pyran]; 3-amyl-7-methylspiro[2H-1-benzopyran-2,3'-[3H]-naphtho[2,1-b] pyran]; 3-amyl-6-nitrospiro[2H-1-benzopyran-2,3'-[3H]-naphtho[2,1-b]pyran]; 2'-benzylspiro[2H-1-benzopyran-2,3'-[3H]-naphtho[2,1-b]pyran]; 3-benzylspiro[2H-1-benzopyran-2,3'-[3H]-naphtho[2,1-b]pyran]; 6-bromospiro [2H-1-benzopyran-2,3'-[3H]-naphtho[2,1-b]pyran]; 6-bromo-8-methoxy-3-methyl-8'-nitrospiro[2H-1-benzopyran-2,3'-[3H]-naphtho[2,1-b]pyran]; 8'-bromo-8-methoxy-3-phenylspiro[2H-1-benzopyran-2,3'-[3H]-naphtho[2,1-b]pyran]; 6-bromo-3-methyl-8'-nitrospiro[2H-1-benzopyran-2,3'-[3H]-naphtho[2,1-b]pyran]; 6-bromo-8'-nitro-3-phenylspiro[2H-1-benzopyran-2,3'-[3H]-naphtho[2,1-b]pyran]; 8'-bromo-3-phenylspiro[2H-1-benzopyran-2,3'-[3H]-naphtho[2,1-b]pyran]; 6-chloro-8-methoxy-3-methyl-8'-nitrospiro[2H-1-benzopyran-2,3'-[3H]-naphtho[2,1-b] pyran]; 6-chloro-3-methylspiro[2H-1-benzopyran-2,3'-[3H] -naphtho[2,1-b]pyran]; 6-chloro-3-methyl-8'-nitrospiro[2H-1-benzopyran-2,3'-[3H]-naphtho[2,1-b]pyran]; 8-chloro-3-methyl-8'-nitrospiro[2H-1-benzopyran-2,3'-[3H]-naphtho [2,1-b]pyran]; 6-chloro-8'-nitro-3-phenylspiro[2H-1-benzopyran-2,3'-[3H]-naphtho[2,1-b]pyran]; 7-diethylamino-3-methyl-8'nitrospiro[2H-1-benzopyran-2,3'-[3H]-naphtho[2,1-b]pyran]; 5,7-dimethoxy-8'-nitro-3-phenylspiro[2H-1-benzopyran- 2,3'-[3H]-naphtho[2,1-b] pyran]; 2',3-dimethylspiro[2H-1-benzopyran-2,3'-[3H]-naphtho[2,1-b]pyran]; 2',3'-dimethylenespiro[2H-1-benzopyran-2,3'-[3H]-naphtho[2,1-b]pyran]; 6-fluoro-3-methyl-8'-nitrospiro[2H-1-benzopyran-2,3'-[3H]-naphtho [2,1-b]pyran]; 2-isopropylspiro[2H-1-benzopyran-2,3'-[3H] -naphtho[2,1-b]pyran]; 3-isopropylspiro[2H-1-benzopyran-2,3'-[3H]-naphtho[2,1-b]pyran]; 8-methoxy-2'-methylspiro [2H-1-benzopyran-2,3'-[3H]-naphtho[2,1-b]pyran]; 8-methoxy-2'-methyl-8'-nitrospiro[2H-1-benzopyran-2,3'-[3H]-naphtho[2,1-b]pyran]; 8-methoxy-3-methyl-6-nitrospiro[2H-1-benzopyran-2,3'-[3H]-naphtho[2,1-b] pyran]; 8-methoxy-3-methyl-8'-nitrospiro[2H-1-benzopyran-2,3'-[3H]-naphtho[2,1-b]pyran]; 7-methoxy-2'-methyl-4-phenylspiro[2H-1-benzopyran-2,3'-[3H]-naphtho [2,1-b]pyran]; 7-methoxy-3-methyl-4-phenylspiro[2H-1-benzopyran-2,3'-[3H]-naphtho[2,1-b]pyran]; 8-methoxy-8'-nitro-3-phenylspiro[2H-1-benzopyran-2,3'-[3H]-naphtho[2,1-b]pyran]; 2'-methylspiro[2H-1-benzopyran-2,3'-[3H]-naphtho[2,1-b]pyran]; 3-methylspiro[2H-1-benzopyran-2,3'-[3H]-naphtho[2,1-b]pyran]; 6-methylspiro[2H-1-benzopyran-2,3'-[3H]-naphtho[2,1-b]pyran]; 3-methyl-6-nitrospiro[2H-1-benzopyran-2,3'-[3H]-naphtho[2,1-b] pyran]; 2'-methyl-4-phenylspiro[2H-1-benzopyran-2,3'-[3H]-naphtho[2,1-b]pyran]; 8'-nitro-3-(o-nitrophenyl)spiro [2H-1-benzopyran-2,3'-[3H]-naphtho[2,1-b]pyran]; 8'-nitro-3-phenylspiro[2H-1-benzopyran-2,3'-[3H]-naphtho[2,1-b] pyran]; 2'-octylspiro[2H-1-benzopyran-2,3'-[3H]-naphtho [2,1-b]pyran]; 2'-phenylspiro[2H-1-benzopyran-2,3'-[3H]-naphtho[2,1-b]pyran]; 3-phenylspiro[2H-1-benzopyran-2,3'-[3H]-naphtho[2,1-b]pyran]; 2'-(β-phenylethyl)spiro[2H-1-benzopyran-2,3'-[3H]-naphtho[2,1-b]pyran]; 3-(β-phenylethyl)spiro[2H-1-benzopyran-2,3'-[3H]-naphtho[2,1-b]pyran]; 2',3-trimethylenespiro[2H-1-benzopyran-2,3'-[3H]-naphtho[2,1-b]pyran]; spiro[2H-1-benzopyran-2,2'-[2H]-naphtho[1,2-b]pyran]; 3-amylspiro[2H-1-benzopyran-2,2'-[2H]-naphtho[1,2-b]pyran]; 3'-amylspiro[2H-1-benzopyran-2,2'-[2H]-naphtho[1,2-b]pyran]; 3-amyl-6-bromospiro[2H-1-benzopyran-2,2'-[2H]-naphtho[1,2-b] pyran]; 3-amyl-6-methoxyspiro[2H-1-benzopyran-2,2'-[2H] -naphtho[1,2-b]pyran]; 3-amyl-6-methylspiro[2H-1-benzopyran-2,2'-[2H]-naphtho[1,2-b]pyran]; 3-amyl-6-nitrospiro[2H-1-benzopyran-2,2'-[2H]-naphtho[1,2-b] pyran]; 6'-chloro-8-methoxy-3-phenylspiro[2H-1-benzopyran-2,2'-[2H]-naphtho[1,2-b]pyran]; 3'-methyl-4'-phenylspiro[2H-1-benzopyran-2,2'-[2H]-naphtho[1,2-b] pyran]; 3-phenylspiro[2H-1-benzopyran-2,2'-[2H]-naphtho [1,2-bipyran]; 3'-phenylspiro[2H-1-benzopyran-2,2'-[2H]-naphtho[1,2-b]pyran]; spiro[3H-anthraceno[2,1-b]pyran-3,2'-[2H]-1-benzopyran]; spiro[2H-1-benzopyran-2,2'-[2'H] phenanthreno[2,1-b]pyran]; spiro[3H-anthraceno[2,1-b] pyran-3,3'-[3H]naphtho[2,1-b]pyran]; spiro[3H-naphtho[2,1-b]pyran-3,2'-[2'H]phenanthreno[2,1-b]pyran]; 2,2'-spirobi [2H-phenanthreno[2,1-b]pyran]; spiro[4H-1-benzopyran-4,3'-[3H]naphtho[2,1-b]pyran]; 2,3-diphenyl-7-methoxyspiro [4H-1-benzopyran-4,3'-[3H]naphtho[2,1-b]pyran]; 2,3-diphenyl-7-methoxy-8'-nitrospiro[4H-1-benzopyran-4,3'-[3H]naphtho[2,1-b]pyran]; 2,3-diphenyl-8'-nitrospiro[4H-1-benzopyran-4,3'-[3H]naphtho[2,1-b]pyran]; 7-methoxy-3-methyl-8'-nitro-2-phenylspiro[4H-1-benzopyran-4,3'-[3H] naphtho[2,1-b]pyran]; 6-methoxy-3-methyl-2-phenylspiro [4H-1-benzopyran-4,3'-[3H]naphtho[2,1-b]pyran]; 7-methoxy-3-methyl-2-phenylspiro[4H-1-benzopyran-4,3'-[3H]naphtho[2,1-b]pyran]; 3-(p-methoxyphenyl)-8'-nitro-2-phenylspiro[4H-1-benzopyran-4,3'-[3H]naphtho[2,1-b] pyran]; 3-methyl-2-phenylspiro[4H-1-benzopyran-4,3'-[3H] naphtho[2,1-b]pyran]; spiro[2H-naphtho[1,2-b]pyran-2,3'-[3H]-naphtho[2,1-b]pyran]; 2'-amylspiro[2H-naphtho[1,2-b]pyran-2,3'-[3H]-naphtho[2,1-b]pyran]; 3-amylspiro[2H-naphtho[1,2-b]pyran-2,3'-[3H]-naphtho[2,1-b]pyran]; 2',3-dimethyl-4-phenylspiro[2H-naphtho[1,2-b]pyran-2,3'-[3H]-naphtho[2,1-b]pyran]; 2'-3-dimethylenespiro[2H-naphtho[1,2-b]pyran-2,3'-[3H]-naphtho[2,1-b]pyran]; 2'-methyl-4-phenylspiro[2H-naphtho[1,2-b]pyran-2,3'-[3H]-naphtho[2,1-b]pyran]; 3-methyl-4-phenylspiro[2H-naphtho[1,2-b]pyran-2,3'-[3H]-naphtho[2,1-b]pyran]; 2'-phenylspiro[2H-naphtho[1,2-b]pyran-2,3'-[3H]-naphtho[2,1-b]pyran]; 3-phenylspiro[2H-naphtho[1,2-b]pyran-2,3'-[3H]-naphtho[2,1-b]pyran]; 4-phenylspiro[2H-naphtho[1,2-b]pyran-2,3'-[3H]-naphtho[2,1-b]pyran]; 2',3-trimethylenespiro[2H-naphtho[1,2-b]pyran-2,3'-[3H]-naphtho[2,1-bipyran]; spiro[4H-napththo[1,2-b]pyran-4,3'-[3H]naphtho[2,1-b]pyran]; 3-methyl-8'-nitro-2-phenylspiro[4H-napththo[1,2-b]pyran-4,3'-[3H]naphtho[2,1-b]pyran]; spiro[2H-1-benzopyran-2,9'-xanthene]; 6,8-dinitrospiro[2H-1-benzopyran-2,9'-xanthene]; 3'-hydroxy-6-nitrospiro[2H-1-benzopyran-2,9'-xanthene]; 6-nitrospiro[2H-1-benzopyran-2,9'-xanthene]; 8-nitrospiro[2H-1-benzopyran-2,9'-xanthene]; spiro[3H-naphtho[2,1-b]pyran-3,9'-xanthene]; 2-methylspiro[3H-naphtho[2,1-b]pyran-3,9'-xanthene]; 8-nitrospiro[3H-naphtho[2,1-b]pyran-3,9'-xanthene]; spiro[3H-naphtho[2,1-b]pyran-3,2'-[2H]pyran; 4',6'-diphenylspiro[3H-naphtho[2,1-b]pyran-3,2'-[2H]pyran; spiro[indoline-2,2'-pyrano[3,2-H]quinoline]; 6'-bromo-1,3,3-trimethylspiro[indoline-2,2'-pyrano[3,2-H]quinoline]; 5-chloro-1,3,3,6'-tetramethylspiro[indoline-2,2'-pyrano[3,2-H]quinoline]; 5-chloro-1,3,3,9'-tetramethylspiro[indoline-2,2'-pyrano[3,2-H]quinoline]; 5-chloro-1,3,3-trimethylspiro[indoline-2,2'-pyrano[3,2-H]quinoline]; 3,3-dimethyl-1-ethylspiro[indoline-2,2'-pyrano[3,2-H]quinoline]; 3,3-dimethyl-1-propylspiro[indoline-2,2'-pyrano[3,2-H]quinoline]; 1-ethyl-3,3,6'-trimethylspiro[indoline-2,2'-pyrano[3,2-H]quinoline]; 5-fluoro-1,3,3,6'-tetramethylspiro[indoline-2,2'-pyrano[3,2-H]quinoline]; 5-fluoro-1,3,3-trimethylspiro[indoline-2,2'-pyrano[3,2-H]quinoline]; 1,3,3,6',7-pentamethylspiro[indoline-2,2'-pyrano[3,2-H]quinoline]; 1,3,3,7,9'-pentamethylspiro[indoline-2,2'-pyrano[3,2-H]quinoline]; 1-propyl-3,3,6'-trimethylspiro[indoline-2,2'-pyrano[3,2-H]quinoline]; 1,3,3,7-tetramethylspiro[indoline-2,2'-pyrano[3,2-H]quinoline]; 1,3,3,9'-tetramethylspiro[indoline-2,2'-pyrano[3,2-H]quinoline]; spiro(indoline-2,3'-[3H]-naphtho[2,1-b]-1,4-oxazine]; 5-chloro-1,3,3-trimethylspiro[indoline-2,3'-[3H]-naphtho[2,1-b]-1,4-oxazine]; 1,3,3-trimethylspiro[indoline-2,3'-[3H]-naphtho[2,1-b]-1,4-oxazine]; spiro[indoline-2,2'-[2H]-pyrano[3,4-b]pyridine]; 5'-hydroxymethyl-1,3,3,8'-tetramethylspiro[indoline-2,2'-[2H]-pyrano[3,4-b]pyridine]; spiro[indoline-2,2'-[2H]-pyrano[3,2-b]pyridine]; 5-chloro-1,3,3-trimethylspiro[indoline-2,2'-[2H]-pyrano[3,2-b]pyridine]; spiro[indoline-2,2'-[2H]-pyrano[3,2-c]quinoline]; 1,3,3,5'-tetramethylspiro[indoline-2,2'-[2H]-pyrano[3,2-c]quinoline]; spiro[2H-1,4-benzoxazine-2,2'-indoline]; 1',3',3'-trimethylspiro[2H-1,4-benzoxazine-2,2'-indoline]; spiro[2H-1-benzopyran-2,2'-[2H]quinoline]; 6-bromo-3-isopropyl-1'-methylspiro[2H-1-benzopyran-2,2'-[2H]quinoline]; 6-bromo-1'-methylspiro[2H-1-benzopyran-2,2'-[2H]quinoline]; 3,3'-dimethylene-1'-methylspiro[2H-1-benzopyran-2,2'-[2H]quinoline]; 1'-ethylspiro[2H-1-benzopyran- 2,2'-[2H]quinoline]; 1'-ethyl-6-nitrospiro[2H-1-benzopyran-2,2'-[2H]quinoline]; 1'-ethyl-8-nitrospiro[2H-1-benzopyran-2,2'-[2H]quinoline]; 6-methoxy-1'-methylspiro[2H-1-benzopyran-2,2'-[2H]quinoline]; 7-methoxy-1'-methylspiro[2H-1-benzopyran-2,2'-[2H]quinoline]; 1'-methylspiro[2H-1-benzopyran-2,2'-[2H]quinoline]; 1'-methyl-6-nitrospiro[2H-1-benzopyran-2,2'-[2H-1-quinoline]; 1'-methyl-3,3'-trimethylenespiro[2H-1-benzopyran-2,2'-[2H]quinoline]; 6-nitro-1',3,3'-trimethylspiro[2H-1-benzopyran-2,2'-[2H]quinoline]; spiro[3H-naphtho[2,1-b]pyran-3,2'-[2H]quinoline]; 2-isopropyl-1'-methylspiro[3H-naphtho[2,1-b]pyran-3,2'-[2H]quinoline]; 1'-methylspiro[3H-naphtho[2,1-b]pyran-3,2'-[2H]quinoline]; spiro[2H-1-benzopyran-2,2'-[2H]pyridine]; 6-bromo-1'-methylspiro[2H-1-benzopyran-2,2'-[2H]pyridine]; 1',3-dimethyl-6-nitrospiro[2H-1-benzopyran-2,2'-[2H]pyridine]; 6,8-dinitro-1'-methyl-3-phenylspiro[2H-1-benzopyran-2,2'-[2H]pyridine]; 1'-ethylspiro[2H-1-benzopyran-2,2'-[2H]pyridine]; 3-ethyl-1'-methyl-6-nitrospiro[2H-1-benzopyran-2,2'-[2H]pyridine]; 1'-ethyl-6-nitrospiro[2H-1-benzopyran-2,2'-[2H]pyridine]; 1'-ethyl-8-nitrospiro[2H-1-benzopyran-2,2'-[2H]pyridine]; 7-methoxy-1'-methylspiro[2H-1-benzopyran-2,2'-[2H]pyridine]; 1'-methylspiro[2H-1-benzopyran-2,2'-[2H]pyridine]; 1'-methyl-6-nitrospiro[2H-1-benzopyran-2,2'-[2H]pyridine]; spiro[3H-naphtho[2,1-b]pyran-3,2'-[2H]pyridine]; 1'-methylspiro[3H-naphtho[2,1-b]pyran-3,2'-[2H]pyridine]; 1',4',6'-triphenylspiro[3H-naphtho[2,1-b]pyran-3,2'-[2H]pyridine]; spiro[9H-acridine-9,2'-[2H]benzopyran]; 8'-methoxy-10-methylspiro[9H-acridine-9,2'-[2H]benzopyran]; 10-methylspiro[9H-acridine-9,2'-[2H]benzopyran]; spiro[9H-acridine-9,3'-[3H]naphtho[2,1-b]pyran]; 10-methylspiro[9H-acridine-9,3'-[3H]naphtho[2,1-bipyran]; spiro[indoline-2,2'-[2H]pyrano[2,3-b]indole]; 5-chloro-1,3,3,9'-tetramethylspiro[indoline-2,2'-[2H]pyrano[2,3-b]indole]; spiro[indoline-2,2'-[2H]pyrano[3,2-b]indole]; 5-chloro-1,3,3-trimethylspiro[indoline-2,2'-[2H]pyrano[3,2-b]indole]; spiro[indoline-2,2'-[2H]pyrano[2,3-b]benzofuran]; 1,3,3-trimethylspiro[indoline-2,2'-[2H]pyrano[2,3-b]benzofuran]; spiro[indoline-2,2'-[2H]pyrano[3,2-b]benzofuran]; 5-chloro-1,3,3-trimethylspiro[indoline-2,2'-[2H]pyrano[3,2-b]benzofuran]; spiro[2H-1-benzothieno[2,3-b]pyran-2,2'-indoline]; 5'-chloro-1',3',3'-trimethylspiro[2H-1-benzothieno[2,3-b]pyran-2,2'-indoline]; spiro[2H]-1-benzothieno[3,2-b]pyran-2,2'-indoline]; 5'-chloro-1',3',3'-trimethylspiro[2H]-1-benzothieno[3,2-b]pyran-2,2'-indoline]; spiro[3H-naphtho[2,1-b]pyran-3,9'-thioxanthene]; 4'-chloro-8-nitrospiro[3H-naphtho[2,1-b]pyran-3,9'-thioxanthene]; spiro[2H,8H-benzo[1,2-b: -3,4-b']dipyran-8-2'-indoline]-2-one; 1',3',3',4-tetramethylspiro[2H,8H-benzo[1,2-b:-3,4-b']dipyran-8-2'-indoline]-2-one; spiro[2H-1-benzopyran-2,2'-oxazoline]; 3'-methyl-6-nitro-5'-phenylspiro[2H-1-benzopyran-2,2'-oxazoline]; spiro[2H-1-benzothiopyran-2,2'-indoline]; 1,3',3'-trimethylspiro[2H-1-benzothiopyran-2,2'-indoline]; spiro[3H-naphtho[2,1-b]pyran-3,2'-thiazoline]; 4',5'-dihydro-2,3'-dimethylspiro[3H-naphtho[2,1-b]pyran-3,2'-thiazoline]; m-dithiino[5,4b:5,6-b']bis[1]benzopyranspiro[3H-naphtho[2,1-b]pyran-3,2'-thiazoline]; 6H,8H-thiopyrano[4,3-b:4,5-b']bis[1]benzopyranspiro[3H-naphtho[2,1-b]pyran-3,2'-thiazoline]; 6H,8H-bisnaphtho[1',2':5,6]pyrano[3,2-c:2',3'-d]thiopyranspiro[3H-naphtho[2,1-b]pyran-3,2'-thiazoline]; spiro[2H-1-benzopyran-2,1'-isoindoline]; 6-nitro-2',3',3'-trimethylspiro[2H-1-benzopyran-2,1'-isoindoline]; spiro[indoline-2,3'-[3H]pyrano-[3,2-a]xanthene]-12'-one; 5-chloro-3',12'-dihydro-1,3,3-trimethylspiro[indoline-2,3'-[3H]pyrano-[3,2-a]xanthene]-12'-one; spiro[benzoselenazole-2,3'-[3H]naphtho[2,1-b]pyran]; 3-ethylspiro[benzoselenazole-2,3'-[3H]naphtho[2,1-b]pyran]; and the like. Mixtures of two or more spiro compounds can also be used.

One spiro compound preferred for lightfastness and reversibility of the photochromic shift over a number of times is of the formula

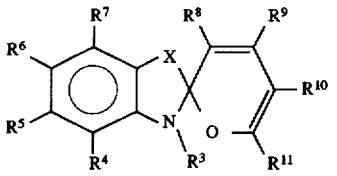

or

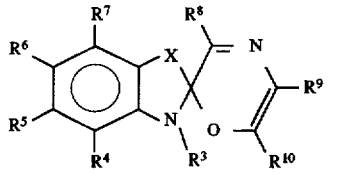

wherein X is a sulfur atom, a selenium atom, an oxygen atom, a —$CH_2$— group, a —$CHR^1$— group, or a —$CR^1R^2$— group, and wherein $R^1$, $R^2$, $R^3$, $R^4$, $R^5$, $R^6$, $R^7$, $R^8$, $R^9$, $R^{10}$, and $R^{11}$ each, independently of the others, can be (but are not limited to) hydrogen, alkyl, including cyclic alkyl groups, such as cyclopropyl, cyclohexyl, and the like, and including unsaturated alkyl groups, such as vinyl ($H_2C$=CH—), allyl ($H_2C$=CH—$CH_2$—), propynyl (HC≡C—$CH_2$—), and the like, preferably with from 1 to about 50 carbon atoms and more preferably with from 1 to about 30 carbon atoms, aryl, preferably with from about 5 to about 30 carbon atoms and more preferably with from about 5 to about 20 carbon atoms, arylalkyl, preferably with from about 6 to about 50 carbon atoms and more preferably with from about 6 to about 30 carbon atoms, silyl groups, nitro groups, cyano groups, halide atoms, such as fluoride, chloride, bromide, iodide, and astatide, amine groups, including primary, secondary, and tertiary amines, hydroxy groups, alkoxy groups, preferably with from 1 to about 50 carbon atoms and more preferably with from 1 to about 30 carbon atoms, aryloxy groups, preferably with from about 5 to about 30 carbon atoms and more preferably with from about 5 to about 20 carbon atoms, alkylthio groups, preferably with from 1 to about 50 carbon atoms and more preferably with from 1 to about 30 carbon atoms, arylthio groups, preferably with from about 5 to about 30 carbon atoms and more preferably with from about 5 to about 20 carbon atoms, aldehyde groups, ketone groups, ester groups, amide groups, carboxylic acid groups, sulfonic acid groups, and the like. The alkyl, aryl, and arylalkyl groups can also be substituted with groups such as, for example, silyl groups, nitro groups, cyano groups, halide atoms, such as fluoride, chloride, bromide, iodide, and astatide, amine groups, including primary, secondary, and tertiary amines, hydroxy groups, alkoxy groups, preferably with from 1 to about 20 carbon atoms and more preferably with from 1 to about 10 carbon atoms, aryloxy groups, preferably with from about 5 to about 20 carbon atoms and more preferably with from about 5 to about 10 carbon atoms, alkylthio groups, preferably with from 1 to about 20 carbon atoms and more preferably with from 1 to about 10 carbon atoms, arylthio groups, preferably with from about 5 to about 20 carbon atoms and more preferably with from about 5 to about 10 carbon atoms, aldehyde groups, ketone groups, ester groups, amide groups, carboxylic acid groups, sulfonic acid groups, and the like. Further, two or more R groups can be joined together to form a ring.

Spiropyrans, spirooxazines, and spirothiopyrans are known compounds and can be prepared as described in, for example, U.S. Pat. Nos. 3,293,055; 3,451,338; 3,100,778; 3,290,331; 3,231,584; 3,299,079; 3,291,604; 3,149,120; 3,022,318; 2,978,462; 3,413,234; 3,407,145; French Patent 1,450,583; French Patent 1,451,332; Zelichenok et al., *Macromolecules*, vol. 25, p.3179 et seq. (1992); A. I. Kiprianov et al., *Zh. Obshch. Khim.*, vol.17, p. 1468 (1947); E. B. Knott, *J. Chem. Soc.*, vol. 1951, p. 3038 (1951); Y. Hirshberg et al., *J. Chem. Soc.*, vol. 1955, p. 3313 (1955); C. Schiele et al., *Tetrahedron*, vol. 23, p. 3733 (1967); T. A. Shakhverdov et al., *Opt. Spektrosk.*, vol. 24, p. 619 (1968); R. Guglielmetti et al., *J. Chim. Phys.*, vol. 65, p. 454 (1968); A. Hinnen et al., *Bull. Soc. Chim. Fr.*, p. 2066 (1968); E. Berman et al., *J. Amer. Chem. Soc.*, vol. 81, p. 5605 (1959); D. P. Maisuradze et al., *Soobshch. Akad. Nauk Gruz. SSR*, vol. 50, p. 77 (1968); D. P. Maisuradze et al., *Soobshch. Akad. Nauk Gruz. SSR*, vol. 49, p. 75 (1968); T. Bercovici et al., *Mol. Photochem.*, vol.1, p. 23 (1969); O. F. Koelsch et al., *J. Amer. Chem. Soc.*, vol.74, p.6288 (1952); O. Chaude, *Cahiers Phys. (France)*, vol. 52, p.39 (1954); I. Shimidzu et al., *Kogyo Kagaku Zasshi*, vol. 72, p.171 (1969); I. Shimidzu et al., *Bull. Chem. Soc. Jap.*, vol. 42, p. 1730 (1969); I. Shimidzu et al., *Nippon Kagaku Zasshi*, vol. 88, p. 1127 (1967); I. Shimidzu, et al., *Nippon Kagaku Zasshi*, vol. 89, p. 755 (1968); C. Balny et al., *Tetrahedron Lett.*, vol. 1968, p. 5097 (1968); J. Arnaud et al., *J. Chim. Phys.*, vol. 64, p. 1165 (1967); R. Wizinger et al., *Helv. Chim. Acta*, vol. 23, p. 247 (1940); L. D. Taylor et al., *Tetrahedron Lett.*, vol. 1967, p. 1585 (1967); A. I. Nogaideli et al., *Soobshch. Akad. Nauk Gruz. SSR*, vol. 40, p. 607 (1965); E. D. Bergmann et al., *J. Amer. Chem. Soc.*, vol. 7, p. 5009 (1950); C. Schiele et al., *Angew. Chem.*, vol. 78, p. 389 (1966); C. Schiele et al., *Ann. Chem.*, vol. 696, p. 81(1966); C. Schiele et al., *Tetrahedron Lett.*, vol. 1966, p. 4409 (1966); R. Guglielmetti et al., *Bull. Soc. Chim. Fr.*, vol.1967, p.2824 (1967); Z. M. Elashvili et al., *Soobshch. Aka Nauk Gruz, SSR*, vol. 52, p. 351(1968); O. Dumenil et al., *Bull. Soc. Chim. Fr.*, vol.1969, p.817 (1969); P. H. Vandewijer et al., *J. Polym. Sci. Part C*, vol. 22, p. 231 (1968); A. V. Shablya et al., *Opt. Spektrosk.*, vol. 20, p. 738 (1966); H. Decker et al., *Chem. Ber.*, vol. 41, p. 2997 (1908); O. Arnold, *Z. Naturforsch.*, vol. 21b, p. 291(1966); C. Schiele et al., *Ann. Chem.*, vol. 722, p. 162 (1969); I. M. Heilbron et al., *J. Chem. Soc.*, vol. 1931, p. 1336 (1931); A. Lowenbein et al., *Chem. Ber.*, vol. 59, p. 1377 (1926); W. Borsche et al., *Ann. Chem.*, vol.393, p. 29 (1912); R. Dickinson et al., *J. Chem. Soc.*, vol.1928, p.2077 (1928); W. Dilthey et al., *J. Prakt. Chem.*, vol.1, p.179 (1926); R. Dickinson et al., *J. Chem. Soc.*, vol.1927, p.14 (1927); R. Dickinson et al., *J. Chem. Soc.*, vol.1927, p.1699 (1927); W. Dilthey et al., *Chem. Ber.*, vol. 61, p. 963 (1928); I. M. Heilbron et al., *J. Chem. Soc., vol.* 1933, p. 430 (1933); I. M. Heilbron et al., *J. Chem. Soc.*, vol. 1929, p. 936 (1929); I. M. Heilbron et al., *J. Chem. Soc.*, vol. 1936, p. 1380 (1936); C. Schiele et al., *Tetrahedron Lett.*, vol. 1966, p. 4413 (1966); I. M. Heilbron et al., *J. Chem. Soc.*, vol. 1934, p. 1571(1934); I. M. Heilbron et al., *J. Chem. Soc.*, vol. 1933, p. 1263 (1933); F. Irving, *J. Chem. Soc.*, vol. 1929, p. 1093 (1929); F. Przystal et al., Anal. Chim. *Acta*, vol. 41, p. 391 (1968); C. F. Koelsch, *J. Org. Chem.*, vol. 16, p. 1362 (1951); R. S. Becker et al., *J. Phys. Chem.*, vol. 72, p. 997 (1968); E. O. Howard et al., *J. Amer. Chem. Soc.*, vol. 82, p.158 (1960); A. I. Nogaideli et al., *Soobshch. Akad. Nauk Gruz. SSR*, vol. 49, p. 573 (1968); A. Samat et al., *Bull. Soc., Chim. Belg.*, vol. 100, no. 9, p. 679 (1991); G. Petillon, Ph.D. Thesis, University of Brest (1979); M. Maguet, Ph.D. Thesis, University of Brest (1980); and R. Guglielmetti et al., *Bull. Soc. Chim. France*, vol 1971, p. 2039 (1971); the disclosures of each of which are totally incorporated herein by reference. Spiro compounds are also available commercially from, for example, Aldrich Chemical Company, Milwaukee, Wis., Nippon Kankoh—Shikiso Kenkyusho Co. Ltd., Okayama, Japan, Chroma Chemicals Inc., Dayton, Ohio, and the like. Specific examples of suitable commercially available spiropyrans and spirooxazines include 27,361-9; 32,254-7; 32,255-5; 32,256-3; and 32,257-1, available from Aldrich; SP-1822; SP-98; SP-48; SP-12;, and SP-99, available from Nippon Kankoh-Shikiso Kenkyusho; and the like.

Stilbene compounds are of the general formula

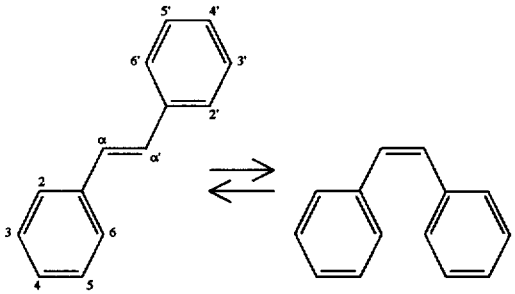

wherein substituents may be present at the 2, 3, 4, 5, 6, 2', 3', 4', 5', and 6' positions. Examples of suitable substituents include (but are not limited to) alkyl, including cyclic alkyl groups, such as cyclopropyl, cyclohexyl, and the like, and including unsaturated alkyl groups, such as vinyl ($H_2C{=}CH{-}$), allyl ($H_2C{=}CH{-}CH_2{-}$), propynyl ($HC{\equiv}C{-}CH_2{-}$), and the like, preferably with from 1 to about 50 carbon atoms and more preferably with from 1 to about 30 carbon atoms, aryl, preferably with from about 5 to about 30 carbon atoms and more preferably with from about 5 to about 20 carbon atoms, arylalkyl, preferably with from about 6 to about 50 carbon atoms and more preferably with from about 6 to about 30 carbon atoms, silyl groups, nitro groups, cyano groups, halide atoms, such as fluoride, chloride, bromide, iodide, and astatide, amine groups, including primary, secondary, and tertiary amines, hydroxy groups, alkoxy groups, preferably with from 1 to about 50 carbon atoms and more preferably with from 1 to about 30 carbon atoms, aryloxy groups, preferably with from about 5 to about 30 carbon atoms and more preferably with from about 5 to about 20 carbon atoms, alkylthio groups, preferably with from 1 to about 50 carbon atoms and more preferably with from 1 to about 30 carbon atoms, arylthio groups, preferably with from about 5 to about 30 carbon atoms and more preferably with from about 5 to about 20 carbon atoms, aldehyde groups, ketone groups, ester groups, amide groups, carboxylic acid groups, sulfonic acid groups, and the like. The alkyl, aryl, and arylalkyl groups can also be substituted with groups such as, for example, silyl groups, nitro groups, cyano groups, halide atoms, such as fluoride, chloride, bromide, iodide, and astatide, amine groups, including primary, secondary, and tertiary amines, hydroxy groups, alkoxy groups, preferably with from 1 to about 30 carbon atoms and more preferably with from 1 to about 20 carbon atoms, aryloxy groups, preferably with from about 5 to about 30 carbon atoms and more preferably with from about 5 to about 20 carbon atoms, alkylthio groups, preferably with from 1 to about 30 carbon atoms and more preferably with from 1 to about 20 carbon atoms, arylthio groups, preferably with from about 5 to about 30 carbon atoms and more preferably with from about 5 to about 20 carbon atoms, aldehyde groups, ketone groups, ester groups, amide groups, carboxylic acid groups, sulfonic acid groups, and the like. Further, two or more substituents can be joined together to form a ring.

Specific examples of stilbenes include stilbene (no substituents), 3-methylstilbene, 4-methoxystilbene, 3-methoxystilbene, 4-aminostilbene, 4-fluorostilbene, 3-fluorostilbene, 4-chlorostilbene, 3-chlorostilbene, 4-bromostilbene, 3-bromostilbene, 3-iodostilbene, 4-cyanostilbene, 3-cyanostilbene, 4-acetylstilbene, 4-benzoylstilbene, 4-phenacylstilbene, 4-nitrostilbene, 3-nitrostilbene, 3-nitro-3'-methoxystilbene, 3-nitro-4-dimethylaminostilbene, 4,4'-dinitrostilbene, 4-nitro-4'-methoxystilbene, 4-nitro-3'-methoxystilbene, 4-nitro-4'-aminostilbene, 4-nitro-4'-dimethylaminostilbene, α-methylstilbene, α,α'-dimethylstilbene, α,α'-difluorostilbene, α,α'-dichlorostilbene, 2,4,6-trimethylstilbene, 2,2',4,4',6,6'-hexamethylstilbene, and the like. Stilbene compounds are well known and can be prepared as described in, for example, G. S. Hammond et al., *J. Amer. Chem. Soc.*, vol. 86, p. 3197 (1964), W. G. Herkstroeter et al., *J. Amer. Chem. Soc.*, vol. 88, p. 4769 (1966), D. L. Beveridge et al., *J. Amer. Chem. Soc.*, vol. 87, p. 5340 (1965), D. Gegiou et al., *J. Amer. Chem. Soc.*, vol. 90, p. 3907 (1968), D. Schulte-Frohlinde et al., *J. Phys. Chem.*, vol. 66, p. 2486 (1962), S. Malkin et al., *J. Phys. Chem.*, vol. 68, p. 1153 (1964), S. Malkin et al., *J. Phys. Chem.*, vol. 66, p. 2482 (1964), H. Stegemeyer, *J. Phys. Chem.*, vol. 66, p. 2555 (1962), H. Gusten et al., *Tetrahedron Lett.*, vol.1968, p.3097 (1968), D. Gegiou et al., *J. Amer. Chem. Soc.*, vol. 90, p. 12 (1968), K. Kruger et al., *J. Phys. Chem.*, vol. 66, p. 293 (1969), and D. Schulte-Frohlinde, *Ann.*, vol. 612, p. 138 (1958), the disclosures of each of which are totally incorporated herein by reference.

Aromatic azo compounds which exhibit photochromism are of the general formula

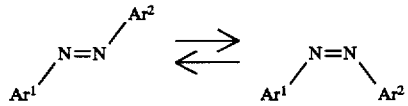

wherein $Ar^1$ and $Ar^2$ are each, independently of the other, selected from the group consisting of aromatic groups. The aromatic groups can be substituted, with examples of substituents including (but not limited to) alkyl, including cyclic alkyl groups, such as cyclopropyl, cyclohexyl, and the like, and including unsaturated alkyl groups, such as vinyl ($H_2C{=}CH{-}$), allyl ($H_2C{=}CH{-}CH_2{-}$), propynyl ($HC{\equiv}C{-}CH_2{-}$), and the like, preferably with from 1 to about 50 carbon atoms and more preferably with from 1 to about 30 carbon atoms, aryl, preferably with from about 5 to about 30 carbon atoms and more preferably with from about 5 to about 20 carbon atoms, arylalkyl, preferably with from about 6 to about 50 carbon atoms and more preferably with from about 6 to about 30 carbon atoms, silyl groups, nitro groups, cyano groups, halide atoms, such as fluoride, chloride, bromide, iodide, and astatide, amine groups, including primary, secondary, and tertiary amines, hydroxy groups, alkoxy groups, preferably with from 1 to about 50 carbon atoms and more preferably with from 1 to about 30 carbon atoms, aryloxy groups, preferably with from about 5 to about 30 carbon atoms and more preferably with from about 5 to about 20 carbon atoms, alkylthio groups, preferably with from 1 to about 50 carbon atoms and more preferably with from 1 to about 30 carbon atoms, arylthio groups, preferably with from about 5 to about 30 carbon atoms and more preferably with from about 5 to about 20 carbon atoms, aldehyde groups, ketone groups, ester groups, amide groups, carboxylic acid groups, sulfonic acid groups, and the like. Alkyl, aryl, and arylalkyl substituents can also be further substituted with groups such as, for example, silyl groups, nitro groups, cyano groups, halide atoms, such as fluoride, chloride, bromide, iodide, and astatide, amine groups, including primary, secondary, and tertiary amines, hydroxy groups, alkoxy groups, preferably with from 1 to about 30 carbon atoms and more preferably with from 1 to about 20 carbon atoms, aryloxy groups, preferably with from about 5 to about 30 carbon atoms and more preferably with from about 5 to about 20 carbon atoms, alkylthio groups, preferably with from 1 to about 30 carbon atoms and more preferably with from 1 to about 20 carbon atoms, arylthio groups, preferably with from about 5 to about 30 carbon atoms and more preferably with from about 5 to about 20 carbon atoms, aldehyde groups, ketone groups, ester groups, amide groups, carboxylic acid groups, sulfonic acid groups, and the like. Further, two or more substituents can be joined together to form a ring.

Examples of photochromic azo compounds include azobenzene, 2-methoxyazobenzene, 2-hydroxyazobenzene, 3-methylazobenzene, 3-nitroazobenzene, 3-methoxyazobenzene, 3-hydroxyazobenzene, 4-iodoazobenzene, 4-bromoazobenzene, 4-chloroazobenzene, 4-fluoroazobenzene, 4-methylazobenzene, 4-carbomethoxyazobenzene, 4-acetylazobenzene, 4-carboxyazobenzene, 4-cyanoazobenzene, 4-ethoxyazobenzene, 4-methoxyazobenzene, 4-nitroazobenzene, 4-acetamidoazobenzene, 4-dimethylaminoazobenzene, 4-aminoazobenzene, 4-trimethylammonium azobenzene (with any suitable anion accompanying the ammonium cation, including but not limited to $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof), 4-dimethylamino-4'-phenylazobenzene, 4-dimethylamino-4'-hydroxyazobenzene, 4,4'-bis-(dimethylamino)azobenzene, 4-dimethylamino-4'-p-aminophenylazobenzene, 4-dimethylamino-4'-p-acetamidophenylazobenzene, 4-dimethylamino-4'-p-aminobenzylazobenzene, 4-dimethylamino-4'-[β-(p-aminophenyl)ethyl]azobenzene, 4-dimethylamino-4'-mercuric acetate azobenzene, 4-hydroxyazobenzene, 2-methyl-4-hydroxyazobenzene, 4-hydroxy-4'-methylazobenzene, 2,6-dimethyl-4-hydroxyazobenzene, 2,2'- 4',6,6'-pentamethyl-4-hydroxyazobenzene, 2,6-dimethyl-2',4',6'-trichloro-4-hydroxyazobenzene, 4-hydroxy-4'-chloroazobenzene, 2,2',4',6'-tetrachloro-4-hydroxyazobenzene, 3-sulfonate-4-hydroxyazobenzene, 2,2'-dimethoxyazobenzene, 3,3'-dinitroazobenzene, 3,3'-dimethylazobenzene, 4,4'-dimethylazobenzene, 4,4'-dimethoxyazobenzene, 4,4'-dinitroazobenzene, 4,4'-dichloroazobenzene, 2,4-dimethoxyazobenzene, 2,6-dimethoxyazobenzene, 4-nitro-4'-methoxyazobenzene, 2,4,6-trimethylazobenzene, 2,3'-dimethoxy-4'-isobutyramidoazobenzene, 2,2',4,4',6,6'-hexamethylazobenzene, 2-hydroxy-5-methylazobenzene, 3,3'-disulfonateazobenzene, 4-methoxy-3'-sulfonateazobenzene, 4-methoxy-4'-sulfonateazobenzene, 2,4-dimethoxy-4'-sulfonateazobenzene, 2,2',4-trimethoxy-5'-sulfonateazobenzene, 4,4'-dimethoxy-3,3'-dicarboxylateazobenzene, 2,2'-azopyridine, 3,3'-azopyridine, 4,4'-azopyridine, 2-phenylazopyridine, 3-phenylazopyridine, 4-phenylazopyridine, 6,6'-azoquinoline, 1-phenylazonaphthalene, 1,1-azonaphthalene, a,2'-azonaphthalene, 2,2'-azonaphthalene, 1-phenylazo-4-naphthol, 1-phenylazo-4-methoxynaphthalene, 3-phenylazo-2-naphthol, 3-phenylazo-2-methoxynaphthalene, 1-(o-hydroxyphenylazo)-2-naphthol, 4-phenylazo-1-naphthylamine, 1-phenylazo-2-naphthylamine, and the like. Polymeric azo materials are also suitable. Aromatic azo compounds are well known and can be prepared as described in, for example, A. Natansohn et al., *Macromolecules*, vol.25, p.2268 (1992); G. Zimmerman et al., *J. Amer. Chem. Soc.*, vol. 80, p. 3528 (1958); W. R. Brode, in *The Roger Adams Symposium*, p. 8, Wiley (New York 1955); D. Gegiou et al., *J. Amer. Chem. Soc.*, vol.90, p.3907 (1968); S. Malkin et al., *J. Phys. Chem.*, vol.66, p. 2482 (1962); D. Schulte-Frohlinde, *Ann.*, vol.612, p.138 (1958); E. I. Stearns, *J. Opt. Soc. Amer.*, vol. 32, p. 382 (1942); W. R. Brode et al., *J. Amer. Chem. Soc.*, vol 74, p.4641 (1952); W. R. Brode et al., *J. Amer. Chem. Soc.*, vol 75, p. 1856 (1953); E. Fischer et al., *J. Chem. Phys.*, vol. 27, p. 328 (1957); G. Wettermark et al., *J. Amer. Chem. Soc.*, vol. 87, p. 476 (1965); G. Gabor et al., *J. Phys. Chem.*, vol.72, p.3266 (1968); M. N. Inscoe et al., *J. Amer. Chem. Soc.*, vol 81, p. 5634 (1959); E. Fischer et al., *J. Chem. Soc.*, vol.1959, p.3159 (1959); G. Gabor et al., *J. Phys. Chem.*, vol. 66, p. 2478 (1962); G. Gabor et al., *Israel J. Chem.*, vol. 5, p. 193 (1967); D. Bullock et al., *J. Chem. Soc.*, vol. 1965, p. 5316 (1965); R. Lovrien et al., *J. Amer. Chem. Soc.*, vol 86, p. 2315 (1964); J. H. Collins et al., *J. Amer. Chem. Soc.*, vol. 84, p. 4708 (1962); P. P. Birnbaum et al., *Trans. Faraday Soc.*, vol. 50, p. 1192 (1954); M. Frankel et al., *J. Chem. Soc.*, vol. 1955, p. 3441 (1955); E. Fischer et al., *J. Chem. Phys.*, vol. 23, p. 1367 (1955); E. Fischer, *J. Amer. Chem. Soc.*, vol. 82, p. 3249 (1960); H. Sterk et al., *Monatsch. Chem.*, vol.99, p.297 (1968); A. H. Cook et al., *J. Chem. Soc.*, vol. 1939, p. 1315 (1939); A. H. Cook et al., *J. Chem. Soc.*, vol.1939, p.1309 (1939); N. Campbell et al., *J. Chem. Soc.*, vol.1953, p.1281 (1953); P. P. Birnbaum et al., *Trans. Faraday Soc.*, vol. 49, p. 735 (1953); R. Lefevre et al., *J. Chem. Soc.*, vol.1953, p. 867 (1953); G. S. Hartley, *J. Chem. Soc.*, vol.1938, p. 633 (1938); J. H. Gould et al., *J. Opt. Soc. Amer.*, vol. 42, p. 380 (1952); G. Gabor et al., *J. Phys. Chem.*, vol. 72, p.153 (1968); R. Lefevre et al., *J. Chem. Soc.*, vol.1951, p.1814 (1951); M. A. Horowitz et al., *J. Amer. Chem. Soc.*, vol.77, p.5011 (1955); and A. Winkel et al., *Ber.*, vol. 74B, p.670 (1940), the disclosures of each of which are totally incorporated herein by reference.

Bisimidazoles are of the general formula

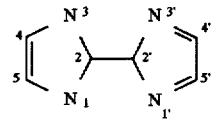

wherein substituents can be present on the 2, 4, 5, 2', 4', and 5' positions. examples of substituents include (but are not limited to) alkyl, including cyclic alkyl groups, such as cyclopropyl, cyclohexyl, and the like, and including unsaturated alkyl groups, such as vinyl ($H_2C{=}CH{-}$), allyl ($H_2C{=}CH{-}CH_2{-}$), propynyl ($HC{\equiv}C{-}CH_2{-}$), and the like, preferably with from 1 to about 50 carbon atoms and more preferably with from 1 to about 30 carbon atoms, aryl, preferably with from about 5 to about 30 carbon atoms and more preferably with from about 5 to about 20 carbon atoms, arylalkyl, preferably with from about 6 to about 50 carbon atoms and more preferably with from about 6 to about 30 carbon atoms, silyl groups, nitro groups, cyano groups, halide atoms, such as fluoride, chloride, bromide, iodide, and astatide, amine groups, including primary, secondary, and tertiary amines, hydroxy groups, alkoxy groups, preferably with from 1 to about 50 carbon atoms and more preferably with from 1 to about 30 carbon atoms, aryloxy groups, preferably with from about 5 to about 30 carbon atoms and more preferably with from about 5 to about 20 carbon atoms, alkylthio groups, preferably with from 1 to about 50 carbon atoms and more preferably with from 1 to about 30 carbon atoms, arylthio groups, preferably with from about 5 to about 30 carbon atoms and more preferably with from about 5 to about 20 carbon atoms, aldehyde groups, ketone groups, ester groups, amide groups, carboxylic acid groups, sulfonic acid groups, and the like. The alkyl, aryl, and arylalkyl groups can also be substituted with groups such as, for example, silyl groups, nitro groups, cyano groups, halide atoms, such as fluoride, chloride, bromide, iodide, and astatide, amine groups, including primary, secondary, and tertiary amines, hydroxy groups, alkoxy groups, preferably with from 1 to about 30 carbon atoms and more preferably with from 1 to about 20 carbon atoms, aryloxy groups, preferably with from about 5 to about 30 carbon atoms and more preferably with from about 5 to about 20 carbon atoms, alkylthio groups, preferably with from 1 to about 30 carbon atoms and more preferably with from 1 to about 20 carbon atoms, arylthio groups, preferably with from about 5 to about 30 carbon atoms and more preferably with from about 5 to about 20 carbon atoms, aldehyde groups, ketone groups, ester groups, amide groups, carboxylic acid groups, sulfonic acid groups, and the like. Further, two or more substituents can be joined together to form a ring.

Specific examples of photochromic bisimidazoles include 2,2',4,4',5,5'-hexaphenyl bisimidazole, 2,2',4,4',5,5'-hexa-p-tolyl bisimidazole, 2,2',4,4',5,5'-hexa-p-chlorophenyl bisimidazole, 2,2'-di-p-chlorophenyl-4,4',5,5'-tetraphenyl bisimidazole, 2,2'-di-p-anisyl-4,4',5,5'-tetraphenyl bisimidazole, and the like. Bisimidazole compounds are known, and can be prepared as described in, for example, T. Hayashi et al., *Bull. Chem. Soc. Jap.*, vol. 33, p. 565 (1960), T. Hayashi et al., *J. Chem. Phys.*, vol.32, p.1568 (1960), T. Hayashi et al., *Bull. Chem. Soc. Jap.*, vol.38, p. 2202 (1965), and D. M. White et al., *J. Org. Chem.*, vol. 29, p. 1926 (1964), the disclosures of each of which are totally incorporated herein by reference.

Bis-tetraphenylpyrrole is of the formula

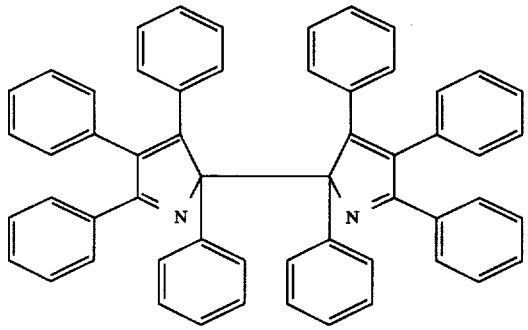

and can be prepared as disclosed in, for example, S. M. Blinder et al., *J. Chem. Phys.*, vol.36, p. 540 (1962) and in G. Rio et al., *Acad. Sci., Paris, Ser. C*, vol. 263, p. 634 (1967), the disclosures of each of which are totally incorporated herein by reference.

Hydrazines are of the general formula

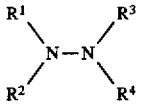

wherein $R^1$, $R^2$, $R^3$, and $R^4$ each, independently of the others, can be hydrogen, alkyl, preferably with from 1 to about 50 carbon atoms and more preferably with from 1 to about 30 carbon atoms, aryl, preferably with from about 5 to about 30 carbon atoms and more preferably with from about 5 to about 20 carbon atoms, and arylalkyl, preferably with from about 6 to about 50 carbon atoms and more preferably with from about 6 to about 30 carbon atoms. The alkyl, aryl, and arylalkyl groups can also be substituted with groups such as, for example, silyl groups, nitro groups, cyano groups, halide atoms, such as fluoride, chloride, bromide, iodide, and astatide, amine groups, including primary, secondary, and tertiary amines, hydroxy groups, alkoxy groups, preferably with from 1 to about 30 carbon atoms and more preferably with from 1 to about 20 carbon atoms, aryloxy groups, preferably with from about 5 to about 30 carbon atoms and more preferably with from about 5 to about 20 carbon atoms, alkylthio groups, preferably with from 1 to about 30 carbon atoms and more preferably with from 1 to about 20 carbon atoms, arylthio groups, preferably with from about 5 to about 30 carbon atoms and more preferably with from about 5 to about 20 carbon atoms, aldehyde groups, ketone groups, ester groups, amide groups, carboxylic acid groups, sulfonic acid groups, and the like. Further, two or more R groups can be joined together to form a ring.

Specific examples of hydrazines include hydrazine (wherein $R^1$, $R^2$, $R^3$, and $R^4$ are each hydrogen), 1,2-diphenylhydrazine, tetraphenylhydrazine, and the like. Hydrazines are well known and can be prepared as described in, for example, G. N. Lewis et al., *J. Amer. Chem. Soc.*, vol 64, p. 2801 (1942), D. A. Ramsay, *J. Phys. Chem.*, vol. 57, p. 415 (1953), P. F. Holt et al., *J. Chem. Soc.*, v. 1955, p. 98 (1955), and J. Weiss, *Trans. Faraday Soc.*, vol. 36, p. 856 (1940), disclosures of each of which are totally incorporated herein by reference.

Aryl disulfides are of the general formula

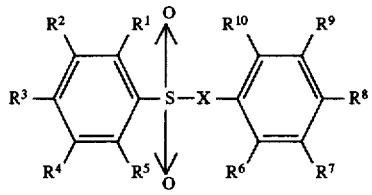

wherein X is a sulfur atom, an oxygen atom, or an $SO_2$ group and $R^1$, $R^2$, $R^3$, $R^4$, $R^5$, $R^6$, $R^7$, $R^8$, $R^9$, and $R^{10}$ each, independently of the others, can be hydrogen, alkyl, preferably with from 1 to about 50 carbon atoms and more preferably with from 1 to about 30 carbon atoms, aryl, preferably with from 5 to about 30 carbon atoms and more preferably with from about 5 to about 20 carbon atoms, arylalkyl, preferably with from about 6 to about 50 carbon atoms and more preferably with from about 6 to about 30 carbon atoms, silyl groups, nitro groups, cyano groups, halide atoms, such as fluoride, chloride, bromide, iodide, and astatide, amine groups, including primary, secondary, and tertiary amines, hydroxy groups, alkoxy groups, preferably with from 1 to about 50 carbon atoms and more preferably with from 1 to about 30 carbon atoms, aryloxy groups, preferably with from about 5 to about 30 carbon atoms and more preferably with from about 5 to about 20 carbon atoms, alkylthio groups, preferably with from 1 to about 50 carbon atoms and more preferably with from 1 to about 30 carbon atoms, arylthio groups, preferably with from about 5 to about 30 carbon atoms and more preferably with from about 5 to about 20 carbon atoms, aldehyde groups, ketone groups, ester groups, amide groups, carboxylic acid groups, sulfonic acid groups, and the like. The alkyl, aryl, and arylalkyl groups can also be substituted with groups such as, for example, silyl groups, nitro groups, cyano groups, halide atoms, such as fluoride, chloride, bromide, iodide, and astatide, amine groups, including primary, secondary, and tertiary amines, hydroxy groups, alkoxy groups, preferably with from 1 to about 30 carbon atoms and more preferably with from 1 to about 20 carbon atoms, aryloxy groups, preferably with from about 5 to about 30 carbon atoms and more preferably with from about 5 to about 20 carbon atoms, alkylthio groups, preferably with from 1 to about 30 carbon atoms and more preferably with from 1 to about 20 carbon atoms, arylthio groups, preferably with from about 5 to about 30 carbon atoms and more preferably with from about 5 to about 20 carbon atoms, aldehyde groups, ketone groups, ester groups, amide groups, carboxylic acid groups, sulfonic acid groups, and the like. Further, two or more R groups can be joined together to form a ring.

Specific examples of aryl disulfide compounds include

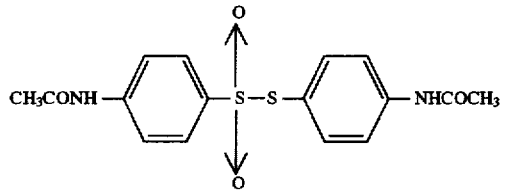

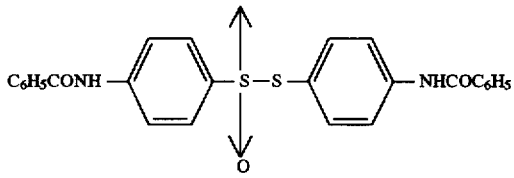

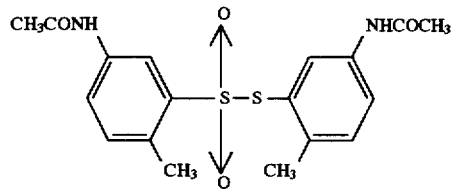

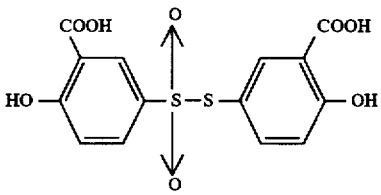

-continued

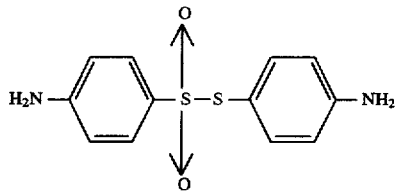

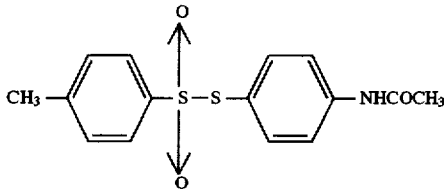

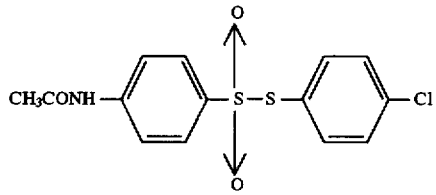

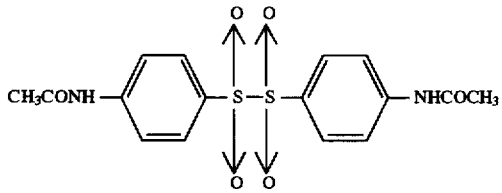

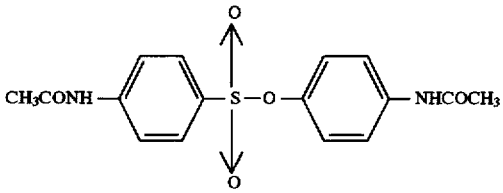

and the like. Aryl disulfide compounds are known, and can be prepared as described in, for example, C. M. Bere et al., *J. Chem. Soc.*, vol.1924, p. 2359 (1924) and in R. Child et al., *J. Chem. Soc.*, vol. 1926, p. 2697 (1926), the disclosures of each of which are totally incorporated herein by reference.

Also suitable are compounds that exhibit tautomeric photochromic phenomena. Examples of these materials include those that undergo photochromic valence tautomerism, those that undergo hydrogen transfer, including keto-enol phototautomerism, aci-nitro phototautomerism, and those that undergo other forms of phototautomerism, such as the naphthacenequinones and their substituted derivatives, as well as polymers containing these moieties, which undergo photochromic transformation between the trans and ana forms as follows:

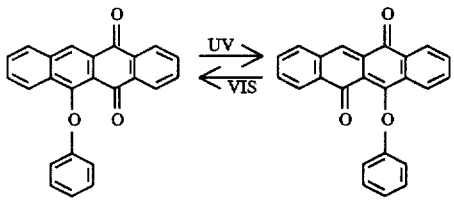

as disclosed in, for example, F. Buchholtz et al., *Macromolecules*, vol. 26, p. 906 (1993), the disclosure of which is totally incorporated herein by reference. Examples of suitable substituents include alkyl, preferably with from 1 to about 50 carbon atoms and more preferably with from 1 to about 30 carbon atoms, aryl, preferably with from 5 to about 30 carbon atoms and more preferably with from about 5 to about 20 carbon atoms, arylalkyl, preferably with from about 6 to about 50 carbon atoms and more preferably with from about 6 to about 30 carbon atoms, silyl groups, nitro groups, cyano groups, halide atoms, such as fluoride, chloride, bromide, iodide, and astatide, amine groups, including primary, secondary, and tertiary amines, hydroxy groups, alkoxy groups, preferably with from 1 to about 50 carbon atoms and more preferably with from 1 to about 30 carbon atoms, aryloxy groups, preferably with from about 5 to about 30 carbon atoms and more preferably with from about 5 to about 20 carbon atoms, alkylthio groups, preferably with from 1 to about 50 carbon atoms and more preferably with from 1 to about 30 carbon atoms, arylthio groups, preferably with from about 5 to about 30 carbon atoms and more preferably with from about 5 to about 20 carbon atoms, aldehyde groups, ketone groups, ester groups, amide groups, carboxylic acid groups, sulfonic acid groups, and the like. Alkyl, aryl, and arylalkyl substituents can also be further substituted with groups such as, for example, silyl groups, nitro groups, cyano groups, halide atoms, such as fluoride, chloride, bromide, iodide, and astatide, amine groups, including primary, secondary, and tertiary amines, hydroxy groups, alkoxy groups, preferably with from 1 to about 30 carbon atoms and more preferably with from 1 to about 20 carbon atoms, aryloxy groups, preferably with from about 5 to about 30 carbon atoms and more preferably with from about 5 to about 20 carbon atoms, alkylthio groups, preferably with from 1 to about 50 carbon atoms and more preferably with from 1 to about 30 carbon atoms, arylthio groups, preferably with from about 5 to about 30 carbon atoms and more preferably with from about 5 to about 20 carbon atoms, aldehyde groups, ketone groups, ester groups, amide groups, carboxylic acid groups, sulfonic acid groups, and the like. Further, two or more substituents can be joined together to form a ring.

Mixtures of two or more photochromic materials can also be employed.

Additional information regarding photochromic materials and the preparation and characterization thereof is disclosed in, for example, *Techniques of Chemistry, Vol. 3: Photochromism*, A. Weissberger and G. Brown, ed., John Wiley & Sons (New York 1971), and in Photochromism: Molecules and Systems, H. Durr and H. Bouas-Laurent, ed., Elsevier (New York 1990), the disclosures of each of which are totally incorporated herein by reference. Photochromic materials are also available from, for example, Aldrich Chemical Company, Milwaukee, Wis. (including 5480-8; 13,993-9; 26,813-5; 10,655-0; 30,832-3; 5492-1; 15,073-8; 21,515-5; 12,672-1; 39,026-7; and the like), Eastman Kodak Company, Rochester, NY (including 1817; 13080; 704; 9439; 11012; 902; and the like), Lancaster Synthesis Inc., Windham, N.H. (including 2002; 4555; 4956; 4364; and the like), Fluka Chemika-BioChemika, Buchs, Switzerland (including 85868; 85870; 85875; 12801; and the like) and the like.

The photochromic material is present in the dry toner composition in any effective amount. Typically, the photochromic material is present in amounts of from about 1 to about 20 percent by weight, and preferably from about 5 to about 10 percent by weight, although the amount can be outside these ranges.

If desired or necessary, the toner compositions of the present invention can also contain a charge control agent. Any charge control agent suitable for charging dry toners can be employed, such as alkyl pyridinium halides, including cetyl pyridinium chloride and others as disclosed in U.S. Pat. No. 4,298,672, the disclosure of which is totally incorporated herein by reference, distearyl dimethyl ammonium methyl sulfate as disclosed in U.S. Pat. No. 4,560,635, the disclosure of which is totally incorporated herein by reference, charge control agents as disclosed in U.S. Pat. Nos. 4,464,452 and 4,480,021, the disclosures of each of which are totally incorporated herein by reference, distearyl dimethyl ammonium bisulfate as disclosed in U.S. Pat. No. 4,937,157, U.S. Pat. No. 4,560,635, and copending application Ser. No. 07/396,497, the disclosures of each of which are totally incorporated herein by reference, zinc 3,5-di-tert-butyl salicylate compounds, such as Bontron E-84, available from Orient Chemical Company of Japan, or zinc compounds as disclosed in U.S. Pat. No. 4,656,112, the disclosure of which is totally incorporated herein by reference, aluminum 3,5-di-tert-butyl salicylate compounds, such as Bontron E-88, available from Orient Chemical Company of Japan, or aluminum compounds as disclosed in U.S. Pat. No. 4,845,003, the disclosure of which is totally incorporated herein by reference, and the like, as well as mixtures thereof and/or any other charge control agent suitable for dry electrophotographic toners. The charge control agent, if present, is present in the toner in any amount effective to obtain the desired charging characteristics. Typically, the charge control agent is present in an amount of from about 0.5 to about 3 percent by weight, preferably from about 1 to about 2 percent by weight, and more preferably from about 1 to about 1.5 percent by weight, although the amount can be outside these ranges.

Optionally, the toner compositions of the present invention can also contain a colorant in addition to the photochromic material. Typically, the colorant material is a pigment, although dyes can also be employed. Examples of suitable pigments and dyes are disclosed in, for example, U.S. Pat. No. 4,788,123, U.S. Pat. No. 4,828,956, U.S. Pat. No. 4,894,308, U.S. Pat. No. 4,948,686, U.S. Pat. No. 4,963,455, and U.S. Pat. No. 4,965,158, the disclosures of each of which are totally incorporated herein by reference. Specific examples of suitable dyes and pigments include carbon black, nigrosine dye, aniline blue, magnetites, and the like, as well as mixtures thereof. Colored toner pigments are also suitable for use with the present invention, including red, green, blue, brown, magenta, cyan, and yellow particles, as well as mixtures thereof, wherein the colored pigments are present in amounts that enable the desired color. Illustrative examples of suitable magenta pigments include 2,9-dimethyl-substituted quinacridone and anthraquinone dye, identified in the color index as Cl 60710, Cl Dispersed Red 15, a diazo dye identified in the color index as Cl 26050, Cl Solvent Red 19, and the like. Illustrative examples of suitable cyan pigments include copper tetra-4-(octadecyl sulfonamido) phthalocyanine, copper phthalocyanine pigment, listed in the color index as Cl 74160, Pigment Blue, and Anthradanthrene Blue, identified in the color index as Cl 69810, Special Blue X-2137, and the like. Illustrative examples of yellow pigments that may be selected include diarylide yellow 3,3-dichlorobenzidene acetoacetanilides, a monoazo pigment identified in the color index as Cl 12700, Cl Solvent Yellow 16, a nitrophenyl amine sulfonamide identified in the color index as Foron Yellow SE/GLN, Cl Dispersed Yellow 33, 2,5-dimethoxy-4-sulfonanilide phenylazo-4'-chloro-2,5-dimethoxy acetoacetanilide, Permanent Yellow FGL, and the like. Other suitable toner colorants include Normandy Magenta RD-2400 (Paul Uhlich), Paliogen Violet 5100 (BASF), Paliogen Violet 5890 (BASF), Permanent Violet VT2645 (Paul Uhlich), Heliogen Green L8730 (BASF), Argyle Green XP-111-S (Paul Uhlich), Brilliant Green Toner GR 0991 (Paul Uhlich), Heliogen Blue L6900, L7020 (BASF), Heliogen Blue D6840, D7080 (BASF), Sudan Blue OS (BASF), PV Fast Blue B2G01 (American Hoechst), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Novoperm Yellow FG1 (Hoechst), Permanent Yellow YE 0305 (Paul Uhlich), Lumogen Yellow D0790 (BASF), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Tolidine Red (Aldrich), Scarlet for Thermoplast NSD PS PA (Ugine Kuhlmann of Canada), E. D. Toluidine Red (Aldrich), Lithol Rubine Toner (Paul Uhlich), Lithol Scarlet 4440 (BASF), Bon Red C (Dominion Color Co.), Royal Brilliant Red RD-8192 (Paul Uhlich), Oracet Pink RF (Ciba-Geigy), Paliogen Red 3871 K (BASF), Paliogen Red 3340 (BASF), and Lithol Fast Scarlet L4300 (BASF). Colorants are typically present in the toner an amount of from about 2 to about 20 percent by weight, although the amount can be outside this range.

The dry toner compositions can be prepared by any suitable method. For example, the components of the dry toner particles can be mixed in a ball mill, to which steel beads for agitation are added in an amount of approximately five times the weight of the toner. The ball mill can be operated at about 120 feet per minute for about 30 minutes, after which time the steel beads are removed. Dry toner particles for two-component developers generally have an average particle size of from about 6 to about 20 microns.

Another method, known as spray drying, entails dissolving the appropriate polymer or resin in an organic solvent such as toluene or chloroform, or a suitable solvent mixture. The photochromic material (as well as the colorant, if one used) is also added to the solvent. Vigorous agitation, such as that obtained by ball milling processes, assists in assuring good dispersion of the components. The solution is then pumped through an atomizing nozzle while using an inert gas, such as nitrogen, as the atomizing agent. The solvent evaporates during atomization, resulting in toner particles which are then attrited and classified by particle size. Particle diameter of the resulting toner varies, depending on the size of the nozzle, and generally varies between about 0.1 and about 100 microns.

Another suitable process is known as the Banbury method, a batch process wherein the dry toner ingredients are pre-blended and added to a Banbury mixer and mixed, at which point melting of the materials occurs from the heat energy generated by the mixing process. The mixture is then dropped into heated rollers and forced through a nip, which results in further shear mixing to form a large thin sheet of the toner material. This material is then reduced to pellet form and further reduced in size by grinding or jetting, after which the particles are classified by size.

Another suitable toner preparation process, extrusion, is a continuous process that entails dry blending the toner ingredients, placing them into an extruder, melting and mixing the mixture, extruding the material, and reducing the extruded material to pellet form. The pellets are further reduced in size by grinding or jetting, and are then classified by particle size.

Other similar blending methods may also be used. Subsequent to size classification of the toner particles, any external additives are blended with the toner particles. If desired, the resulting toner composition is then mixed with carrier particles.

Any suitable external additives can also be utilized with the dry toner particles. The amounts of external additives are measured in terms of percentage by weight of the toner composition, but are not themselves included when calculating the percentage composition of the toner. For example, a toner composition containing a resin, a colorant, and an external additive can comprise 80 percent by weight resin and 20 percent by weight colorant; the amount of external additive present is reported in terms of its percent by weight of the combined resin and colorant. External additives can include any additives suitable for use in electrostatographic toners, including straight silica, colloidal silica (e.g. Aerosil R972®, available from Degussa, Inc.), ferric oxide, Unilin®, polypropylene waxes, polymethylmethacrylate, zinc stearate, chromium oxide, aluminum oxide, stearic acid, polyvinylidene fluoride (e.g. Kynar®, available from Pennwalt Chemicals Corporation), and the like. External additives can be present in any desired or effective amount.

Dry toners of the present invention can be employed alone in single component development processes, or they can be employed in combination with carrier particles in two component development processes. Any suitable carrier particles can be employed with the toner particles. Typical carrier particles include granular zircon, steel, nickel, iron ferrites, and the like. Other typical carrier particles include nickel berry carriers as disclosed in U.S. Pat. No. 3,847,604, the entire disclosure of which is incorporated herein by reference. These carriers comprise nodular carrier beads of nickel characterized by surfaces of reoccurring recesses and protrusions that provide the particles with a relatively large external area. The diameters of the carrier particles can vary, but are generally from about 50 microns to about 1,000 microns, thus allowing the particles to possess sufficient density and inertia to avoid adherence to the electrostatic images during the development process.

Carrier particles can possess coated surfaces. Typical coating materials include polymers and terpolymers, including, for example, fluoropolymers such as polyvinylidene fluorides as disclosed in U.S. Pat. No. 3,526,533, U.S. Pat. No. 3,849,186, and U.S. Pat. No. 3,942,979, the disclosures of each of which are totally incorporated herein by reference. Coating of the carrier particles may be by any suitable process, such as powder coating, wherein a dry powder of the coating material is applied to the surface of the carrier particle and fused to the core by means of heat, solution coating, wherein the coating material is dissolved in a solvent and the resulting solution is applied to the carrier surface by tumbling, or fluid bed coating, in which the carrier particles are blown into the air by means of an air stream, and an atomized solution comprising the coating material and a solvent is sprayed onto the airborne carrier particles repeatedly until the desired coating weight is achieved. Carrier coatings may be of any desired thickness or coating weight. Typically, the carrier coating is present in an amount of from about 0.1 to about 1 percent by weight of the uncoated carrier particle, although the coating weight may be outside this range.

The toner is present in the two-component developer in any effective amount, typically from about 1 to about 5 percent by weight of the carrier, and preferably about 3 percent by weight of the carrier, although the amount can be outside these ranges.

Any suitable conventional electrophotographic development technique can be utilized to deposit toner particles of the present invention on an electrostatic latent image on an imaging member. Well known electrophotographic development techniques include magnetic brush development, cascade development, powder cloud development, electrophoretic development, and the like. Magnetic brush development is more fully described, for example, in U.S. Pat. No. 2,791,949, the disclosure of which is totally incorporated herein by reference; cascade development is more fully described, for example, in U.S. Pat. No. 2,618,551 and U.S. Pat. No. 2,618,552, the disclosures of each of which are totally incorporated herein by reference; powder cloud development is more fully described, for example, in U.S. Pat. Nos. 2,725,305, 2,918,910, and 3,015,305, the disclosures of each of which are totally incorporated herein by reference; and liquid development is more fully described, for example, in U.S. Pat. No. 3,084,043, the disclosure of which is totally incorporated herein by reference.

The deposited toner image can be transferred to a receiving member such as paper or transparency material by any suitable technique conventionally used in electrophotography, such as corona transfer, pressure transfer, adhesive transfer, bias roll transfer, and the like. Typical corona transfer entails contacting the deposited toner particles with a sheet of paper and applying an electrostatic charge on the side of the sheet opposite to the toner particles. A single wire corotron having applied thereto a potential of between about 5000 and about 8000 volts provides satisfactory transfer.

After transfer, the transferred toner image can be fixed to the receiving sheet. The fixing step can be also identical to that conventionally used in electrophotographic imaging. Typical, well known electrophotographic fusing techniques include heated roll fusing, flash fusing, oven fusing, laminating, adhesive spray fixing, and the like.

Liquid developers of the present invention suitable for polarizable liquid development processes can comprise a nonaqueous liquid vehicle and a photochromic material. When the liquid developer is intended for use in a polarizable liquid development system, the liquid developer is applied to an applicator such as a gravure roll and brought near an electrostatic latent image. The charged image polarizes the liquid developer in the depressions in the applicator, thereby drawing the developer from the depressions and causing it to flow to the image bearing member to develop the image. For this application, the liquid developer is somewhat more viscous than is the situation with electrophoretic development, since particle migration within the developer is generally not necessary and since the liquid developer must be sufficiently viscous to remain in the depressions in the applicator prior to development. The viscosity, however, remains significantly lower than that typically observed for many printing inks, since the liquid developer must be capable of being pulled from the depressions in the applicator roll by the force exerted by the electrostatic latent image. Thus, liquid developers for use in polar development systems typically have a viscosity of from about 25 to about 500 centipoise at the operating temperature of the copier or printer, and preferably from about 30 to about 300 centipoise at the machine operating temperature, although the viscosity can be outside these ranges. In addition, liquid developers intended for use in polarizable liquid development systems typically have a resistivity lower than liquid developers employed in electrophoretic development systems to enable the developer to become polarized upon entering proximity with the electrostatic latent image. The liquid developers of the present invention, however, generally have resistivities that are significantly higher than the resistivities of typical printing inks, for which resistivities generally are substantially less than about $10^9$ ohm-cm. Typically, liquid developers for polarizable liquid development systems have a resistivity of from about $10^8$ to about $10^{11}$ ohm-cm, and preferably from about $2\times10^9$ to about $10^{10}$ ohm-cm, although the resistivity can be outside these ranges.

In polarizable liquid developers of the present invention wherein the photochromic material is present directly dissolved or dispersed in the liquid vehicle, the photochromic material is present in any amount effective to impart to the developer the desired color and intensity under appropriate light conditions. Typically, the photochromic material is present in the liquid developer in an amount of from about 1 to about 20 percent by weight, preferably from about 1 to about 10 percent by weight, and more preferably from about 5 to about 10 percent by weight, although the amount can be outside these ranges.

Typical liquid materials suitable as liquid vehicles for polarizable liquid developers include paraffinic and isoparaffinic hydrocarbons, such as Isopar® L, Norpar® 15, Norpar® 16, and the like, available from Exxon Corporation, mineral oil, pentadecane, hexadecane, and the like. The liquid vehicle is present in the liquid developer in a major amount, typically from about 50 to about 99 percent by weight, preferably from about 95 to about 99 percent by weight, and more preferably from about 98 to about 99 percent by weight, although the amount can be outside these ranges.

If desired, the polarizable liquid developers of the present invention can also contain various polymers added to modify the viscosity of the developer or to modify the mechanical properties of the developed or cured image such as adhesion or cohesion. In particular, when the liquid developer of the present invention is intended for use in polarizable liquid development processes, the developer can also include viscosity controlling agents. Examples of suitable viscosity controlling agents include thickeners such as alkylated polyvinyl pyrrolidones, such as Ganex V216, available from GAF; polyisobutylenes such as Vistanex, available from Exxon Corporation, Kalene 800, available from Hardman Company, New Jersey, ECA 4600, available from Paramins, Ontario, and the like; Kraton G-1701, a block copolymer of polystyrene-b-hydrogenated butadiene available from Shell Chemical Company, Polypale Ester 10, a glycol rosin ester available from Hercules Powder Company; and other similar thickeners. In addition, additives such as pigments, including silica pigments such as Aerosil 200, Aerosil 300, and the like available from Degussa, Bentone 500, a treated montmorillonite clay available from NL Products, and the like can be included to achieve the desired developer viscosity. Additives are present in any effective amount, typically from about 1 to about 40 percent by weight in the case of thickeners and from about 0.5 to about 5 percent by weight in the case of pigments and other particulate additives, although the amounts can be outside these ranges.

In addition, liquid developers of the present invention intended for use in polarizable liquid development processes can also contain conductivity enhancing agents. For example, the developers can contain additives such as quaternary ammonium compounds as disclosed in, for example, U.S. Pat. No. 4,059,444, the disclosure of which is totally incorporated herein by reference.

In another embodiment of the present invention, liquid developers comprise a nonaqueous liquid vehicle, a charge control agent, and toner particles comprising a mixture of a resin and a photochromic material. Liquid developers of this embodiment of the present invention can be employed in either electrophoretic development processes or polarizable liquid development processes. When employed in polarizable liquid development processes, the developer generally has the characteristics set forth hereinabove with respect to liquid developers in which the colorant is dissolved or dispersed directly in the liquid vehicle, except that colored toner particles replace the dissolved or dispersed colorant. When the liquid developer is intended for use in electrophoretic development systems, the liquid vehicle must be capable of permitting the toner particles of the developer to migrate through the vehicle to develop electrostatic latent images. Thus, in electrophoretic developers, the liquid vehicle is sufficiently high in resistivity to enhance the development of particles over that of free ions, typically having a resistivity of more than about $5\times10^9$ ohm-cm and preferably more than about $10^{10}$ ohm-cm as measured by determining the average current flowing across a 1.5 millimeter gap at 5 hertz and 5 volts square wave applied potential, although the resistivity can be outside these ranges. In addition, the liquid vehicle is sufficiently low in viscosity to permit the toner particles to migrate toward the electrostatic latent image with sufficient rapidity to enable development of the image within the desired development time. Typically, the liquid vehicle has a viscosity of no more than about 20 centipoise at the operating temperature of the copier or printer, and preferably no more than about 3 centipoise at the machine operating temperature, although the viscosity can be outside these ranges.

Typical liquid materials suitable as liquid vehicles for electrophoretic liquid developers include high purity aliphatic hydrocarbons with, for example, from about 6 to about 25 carbon atoms and preferably with a viscosity of less than 2 centipoise, such as Norpar®12, Norpar®13, and Norpar®15, available from Exxon Corporation, isoparaffinic hydrocarbons such as Isopar® G, H, K, L, M, and V, available from Exxon Corporation, Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like, as well as mixtures thereof. Isoparaffinic hydrocarbons are preferred liquid media, since they are colorless, environmentally safe, and possess a sufficiently high vapor pressure so that a thin film of the liquid evaporates from the contacting surface within seconds at ambient temperatures. The liquid vehicle is present in the liquid developer in a major amount, typically from about 50 to about 99 percent by weight, preferably from about 95 to about 99 percent by weight, and more preferably from about 98 to about 99 percent by weight, although the amount can be outside these ranges.

The toner particles generally comprise polymeric particles containing a photochromic material. Generally, the polymer is relatively insoluble in the liquid vehicle. Typically, the polymer is soluble in the liquid vehicle in amounts of about 5 percent by weight or less of the liquid vehicle at ambient temperature (generally from about 20° to about 30° C.). Examples of suitable polymers include ethylene-vinyl acetate copolymers such as the Elvax® I resins and Elvax 5720 resin, available from E.I. Du Pont de Nemours & Company, copolymers of ethylene and an α,β-ethylenically unsaturated acid selected from acrylic or methacrylic acid, where the acid moiety is present in an amount of from 0.1 to 20 percent by weight, such as the Nucrel® II resins and Nucrel 589 and Nucrel 960 resins, available from E.I. Du Pont de Nemours & Company, polybutyl terephthalates, ethylene ethyl acrylate copolymers such as those available as Bakelite DPD 6169, DPDA 6182 Natural, and DTDA 9169 Natural from Union Carbide Company, ethylene vinyl acetate resins such as DQDA 6479 Natural 7 and DQDA 6832 Natural 7 available from Union Carbide Company, methacrylate resins such as polybutyl methacrylate, polyethyl methacrylate, and polymethyl methacrylate, available under the trade name Elvacite from E.I. Du Pont de Nemours & Company, and others as disclosed in, for example, British Patent 2,169,416, and U.S. Pat. No. 4,794,651, the disclosures of each of which are totally incorporated herein by reference.

The toner particles can be made by any suitable process, such as by a method employing an attritor, as disclosed in, for example, U.S. Pat. Nos. 5,123,962, 5,053,306, and 5,168,022, the disclosures of each of which are totally incorporated herein by reference, or a method employing a microfluidizer, as disclosed in, for example, U.S. Pat. No. 4,783,389, the disclosure of which is totally incorporated herein by reference, or a method employing a piston homogenizer, as disclosed in copending application U.S. Ser. No. 08/098,150, filed Jul. 28, 1993, entitled "Processes for the Preparation of Developer Compositions," with the named inventors Timothy J. Fuller, James R. Larson, and Frank J. Bonsignore, the disclosure of which is totally incorporated herein by reference, or the like.

The photochromic material is present in the toner particles, and the toner particles are contained in the developer, in any amount effective to impart to the developer the desired color and intensity under the appropriate light conditions. Typically, the photochromic material is present in the toner particles in an amount of from about 1 to about 20 percent by weight, preferably from about 1 to about 10 percent by weight, and more preferably from about 5 to about 10 percent by weight, although the amount can be outside these ranges. Typically, the toner particles are present in the liquid developer in an amount of from about 1 to about 20 percent by weight, preferably from about 1 to about 10 percent by weight, and more preferably from about 5 to about 10 percent by weight, although the amount can be outside these ranges.

The liquid developers of the present invention generally can be prepared by any suitable method. For example, the developer can be prepared by heating and mixing the ingredients, followed by grinding the mixture in an attritor until homogeneity of the mixture has been achieved. When the liquid developer comprises a photochromic material dissolved or dispersed directly in the liquid vehicle, the developer can be prepared by simple mixing of the developer ingredients. When the liquid developer comprises polymeric particles dispersed in the liquid vehicle, the polymeric resin imbibes the photochromic material during the grinding process. In a typical procedure, photochromic material, resin, a charge control agent, and the liquid vehicle are charged into an attritor and the mixture is heated, typically to temperatures of from about 200 to about 212° F., typically for about 15 minutes. The heat source is then removed and grinding at ambient temperature is continued, typically for about 2 hours. Water cooling of the exterior of the vessel and continued grinding is then carried out, typically for about four hours, to result in particles ranging in average particle diameter of from about 1 to about 2 microns. Additional information regarding methods of preparing toner particles is disclosed in, for example, U.S. Pat. Nos. 4,476,210, 4,794,651, 4,877,698, 4,880,720, 4,880,432, 4,762,764, 3,729,419, 3,841,893, and 3,968,044, the disclosures of each of which are totally incorporated herein by reference.

The electrophoretic liquid developers of the present invention can also include a charge control agent to help impart a charge to the toner particles. A charge control additive is generally present in the electrophoretic liquid developers of the present invention to impart to the particles contained in the liquid a charge sufficient to enable them to migrate through the liquid vehicle to develop an image. Examples of suitable charge control agents for liquid developers include the lithium, cadmium, calcium, manganese, magnesium and zinc salts of heptanoic acid; the barium, aluminum, cobalt, manganese, zinc, cerium and zirconium salts of 2-ethyl hexanoic acid, (these are known as metal octoates); the barium, aluminum, zinc, copper, lead and iron salts of stearic acid; the calcium, copper, manganese, nickel, zinc and iron salts of naphthenic acid; and ammonium lauryl sulfate, sodium dihexyl sulfosuccinate, sodium dioctyl sulfosuccinate, aluminum diisopropyl salicylate, aluminum resinate, aluminum salt of 3,5 di-t-butyl gamma resorcylic acid. Mixtures of these materials may also be used. Particularly preferred charge control agents include lecithin (Fisher Inc.); OLOA 1200, a polyisobutylene succinimide available from Chevron Chemical Company; basic barium petronate (Witco Inc.); zirconium octoate (Nuodex); aluminum stearate; salts of calcium, manganese, magnesium and zinc with heptanoic acid; salts of barium, aluminum, cobalt, manganese, zinc, cerium, and zirconium octoates; salts of barium, aluminum, zinc, copper, lead, and iron with stearic acid; iron naphthenate; aluminum t-butyl salicylate; and the like, as well as mixtures thereof. The charge control additive may be present in an amount of from about 0.001 to about 3 percent by weight, and preferably from about 0.01 to about 0.8 percent by weight of the developer composition. Other additives, such as charge adjuvants added to improve charging characteristics of the developer, may be added to the developers of the present invention, provided that the objectives of the present invention are achieved. Charge adjuvants such as stearates, metallic soap additives, polybutylene succinimides, and the like are described in references such as U.S. Pat. No. 4,707,429, U.S. Pat. No. 4,702,984, and U.S. Pat. No. 4,702,985, the disclosures of each of which are totally incorporated herein by reference.

In general, images are developed with the liquid electrophoretic developers and the polarizable liquid developers of the present invention by generating an electrostatic latent image and contacting the latent image with the liquid developer, thereby causing the image to be developed. When a liquid electrophoretic developer of the present invention is employed, the process entails generating an electrostatic latent image and contacting the latent image with the developer comprising a liquid vehicle and charged toner particles, thereby causing the charged particles to migrate through the liquid and develop the image. Developers and processes of this type are disclosed in, for example, U.S. Pat. Nos. 4,804,601, 4,476,210, 2,877,133, 2,890,174, 2,899,335, 2,892,709, 2,913,353, 3,729,419, 3,841,893, 3,968,044, 4,794,651, 4,762,764, 4,830,945, 3,976,808, 4,877,698, 4,880,720, 4,880,432, and copending application U.S. Ser. No. 07/300,395, the disclosures of each of which are totally incorporated herein by reference. When a liquid developer of the present invention suitable for polarizable liquid development processes is employed, the process entails generating an electrostatic latent image on an imaging member, applying the liquid developer to an applicator, and bringing the applicator into sufficient proximity with the latent image to cause the image to attract the developer onto the imaging member, thereby developing the image. Developers and processes of this type are disclosed in, for example, U.S. Pat. Nos. 4,047,943, 4,059,444, 4,822,710, 4,804,601, 4,766,049, 4,686,936, 4,764,446, Canadian Patent 937,823, Canadian Patent 926,182, Canadian Patent 942,554, British Patent 1,321,286, and British Patent 1,312,844, the disclosures of each of which are totally incorporated herein by reference. In both of these embodiments, any suitable means can be employed to generate the image. For example, a photosensitive imaging member can be exposed by incident light or by laser to generate a latent image on the member, followed by development of the image and transfer to a substrate such as paper, transparency material, cloth, or the like. In addition, an image can be generated on a dielectric imaging member by electrographic or ionographic processes as disclosed, for example, in U.S. Pat. Nos. 3,564,556, 3,611,419, 4,240,084, 4,569,584, 2,919,171, 4,524,371, 4,619,515, 4,463,363, 4,254,424, 4,538,163, 4,409,604, 4,408,214, 4,365,549, 4,267,556, 4,160,257, 4,485,982, 4,731,622, 3,701,464, and 4,155,093, the disclosures of each of which are totally incorporated herein by reference, followed by development of the image and, if desired, transfer to a substrate. If necessary, transferred images can be fused to the substrate by any suitable means, such as by heat, pressure, exposure to solvent vapor or to sensitizing radiation such as ultraviolet light or the like as well as combinations thereof. Further, the liquid developers of the present invention can be employed to develop electrographic images wherein an electrostatic image is generated directly onto a substrate by electrographic or ionographic processes and then developed, with no subsequent transfer of the developed image to an additional substrate.

The images printed with the dry toners and liquid developers of the present invention are photochromic in that they have a first state corresponding to a first absorption spectrum and a second state corresponding to a second absorption spectrum. Another embodiment of the present invention is directed to a process which comprises (a) generating an electrostatic latent image on an imaging member; (b) developing the latent image by contacting the imaging member with a toner or developer according to the present invention and containing a photochromic material having a first state corresponding to a first absorption spectrum and a second state corresponding to a second absorption spectrum; and (c) thereafter effecting a photochromic change in at least some of the photochromic material in the developed image from the first state to the second state.

The photochromic shift from the first state to the second state can be effected by any method suitable for the photochromic material or materials selected for the marking material. Examples of methods for inducing the photochromic shift include irradiation with radiation of a suitable wavelength, typically from about 200 to about 400 nanometers, although the wavelength can be outside this range. The reverse photochromic effect can be induced by irradiation with visible light, typically in the wavelength range of from about 400 to about 700 nanometers, although the wavelength can be outside this range, or by the application of heat.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

Three toner compositions were prepared by dissolving in dichloromethane a toner resin comprising a bisphenol A fumarate polyester resin (having an onset glass transition temperature ($T_g$) of 55° C. as measured by differential scanning calorimetry, $M_n$=6,200, $M_w$=13,500, $M_n/M_w$=2.18 as measured by gel permeation chromatography), and the photochromic material indicated in the table below. Thereafter, the solvent was removed and the resulting material was dried under vacuum at 75° C. and ground with a mortar and pestle to particles with average particle diameter of about 10 microns. The toner particles thus prepared were used to develop via cascade development an image on a xeroprinting master film having a potential difference of 200 volts between the imaged alphanumeric characters and non-imaged areas. The toner particles preferentially adhered to the imaged areas. Thereafter, the toner particles were transferred to paper using corona charging of opposite sign and were subsequently fused to the paper by placing the paper in an oven at 150° C. for about 1 minute. The entire process was repeated using transparency substrate instead of paper. The images thus formed on paper and transparency stock were exposed to ultraviolet light at 366 nanometers to induce the photochromic effect and subsequently exposed to red light at 600 nanometers to reverse the photochromic effect. The process was repeated several times. The results were as indicated in the table below:

| Photochromic Compound | % by weight dichloromethane: polyester: photochrome | Photochrome Concentration in Solids (remainder being polyester resin) | Color at 600 nm exposure | Color at 366 nm exposure |
|---|---|---|---|---|
| SP1 | 95.0:4.5:0.5 | 10% by weight | light red | purple |
| SP1 | 95.0:2.5:2.5 | 50% by weight | orange | purple |
| SO1 | 95.0:4.5:0.5 | 10% by weight | colorless | blue |

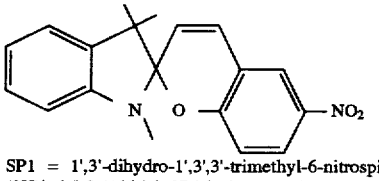

SP1 = 1',3'-dihydro-1',3',3'-trimethyl-6-nitrospiro[2H-1-benzopyran-2,2'-(2H)indole] (Aldrich 27,361-9) (CAS # 1498-88-0)

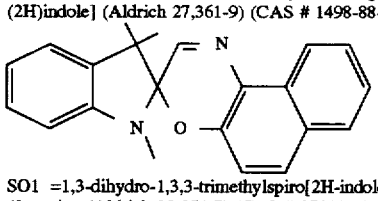

SO1 =1,3-dihydro-1,3,3-trimethylspiro[2H-indole-2,3'-[3H]naphth[2,1-b][1,4]oxazine (Aldrich 32,254-7) (CAS # 27333-47-7)

The images generated on the substrates consisted of the letters A, B, C, D, E, F, G, and H in a row. The images generated with the SO1-containing material were colorless when originally generated. The letters A, B, and C were covered during the entire experiment. The letters D, E, F, G, and H were exposed to ultraviolet light thereafter, causing instantaneous ring opening of the spirooxazine compound and blue color formation. The letters D, E, and F were then covered and the letters G and H were exposed to visible light from a flashgun, causing rapid fading of the blue color and invisibility of these letters.

EXAMPLE II

In a Union Process 1-S Attritor (Union Process Co., Akron, Ohio) is placed 200 grams of a copolymer of ethylene and methacrylic acid (89:11 molar ratio) with a melt index at 190° C. of 100 and an Acid Number of 66, 22 grams of a photochromic material (1,3-dihydro-1,3,3-trimethylspiro[2H-indole-2,3'-[3H]naphth[2,1-b][1,4]oxazine, available from Aldrich Chemical Co., Milwaukee, Wis.), and 1000 grams of Isopar® L (Exxon Corp.). The attritor contents are heated to 100° C., and milled at a rotor speed of 230 rpm with 4.76 mm diameter stainless steel balls for two hours. The attritor is then cooled to room temperature while the milling is continued. Subsequently, 700 grams of Isopar® H is added to the attritor contents and milling is continued at a rotor speed of 330 rpm for 3 hours. The resulting particulate polymer dispersion is then drained to a holding tank. Thereafter, 92 grams of Basic Barium Petronate (Witco Chemical, New York, N.Y.) are added to the dispersion with stirring. Sufficient Isopar® H is also added to the dispersion to result in a 2 percent by weight solids dispersion, and the dispersion is stirred for 3 hours. The electrophoretic developer thus formed is incorporated into a Savin 870 copier and images are generated on paper. It is believed that the images thus generated will be initially colorless, will turn blue upon exposure to ultraviolet light, and will return to a colorless state upon exposure to visible-spectrum light as described in Example I.

EXAMPLE III

A photochromic liquid developer suitable for development of electrostatic latent images is prepared as follows. A copolymer of ethylene (90% by weight) and methacrylic acid (10% by weight) (Nucrel 599, available from E.I. Du Pont de Nemours & Co., Wilmington, Del., 3.90 g), an aluminum stearate charge control agent (Witco 22, available from Witco Chemical Co., Des Plaines, Ill., 0.1 g), a photochromic material (1,3-dihydro-1,3,3-trimethylspiro[2H-indole-2,3'-[3H]naphth[2,1-b][1,4]oxazine, available from Aldrich Chemical Co., Milwaukee, Wis., 1.00 g), and an isoparaffinic hydrocarbon liquid (Isopar® L, available from Noco Lubrication, Tonawanda, N.Y., 170 g) are heated in a Union Process 01 attritor containing 2,400 grams of stainless steel 3/16 inch chrome-coated shot until 200° F. is achieved. After 10 minutes, heating is discontinued and ambient temperature stirring is maintained for 2 hours. Water cooling and stirring are then continued for 4 more hours. The ink is then washed from the shot with 63.1 g of Isopar® L using a strainer, and additional Isopar® L is then added, resulting in a developer with a solids content of about 1 percent by weight. This developer at 1 percent by weight solids and with suitable charge director (lecithin added dropwise until a conductivity of 12 picomhos per centimeter is achieved) can be used for the development of liquid immersion images by incorporating the ink into a Savin 870 photocopier and generating and developing images. It is believed that the images thus generated will be initially colorless, will turn blue upon exposure to ultraviolet light, and will return to a colorless state upon exposure to visible-spectrum light as described in Example I.

EXAMPLE IV

A photochromic liquid developer suitable for development of electrostatic latent images by a polarizable liquid development process is prepared as follows. A photochromic material (1,3-dihydro-1,3,3-trimethylspiro[2H-indole-2,3'-[3H]naphth[2,1-b][1,4]oxazine, available from Aldrich Chemical Co., Milwaukee, Wis., 12 parts by weight), polyvinyl pyrrolidone dispersing agent (PVP-K15, available from GAF Corp., 6 parts by weight), a modified phenolic resin (15 parts by weight), and triethylene glycol monobutyl ether (67 parts by weight) are admixed to form a developer composition. Thereafter, the developer is incorporated into a xerographic imaging test fixture containing a layered imaging member comprising an aluminum substrate, a photogenerating layer of trigonal selenium, 90 percent by weight, dispersed in 10 percent by weight of polyvinyl carbazole, and a charge transport layer containing N,N'-diphenyl-N,N-bis(3-methylphenyl) 1,1'-biphenyl-4,4'-diamine molecules, 55 percent by weight, dispersed in 45 percent by weight of the polycarbonate resinous binder Makrolon, which member has been negatively charged. A latent image on the layered member is curtailed with the developer composition utilizing a gravure roll, wherein the developer is attracted to the latent image by the application of an electric field of about 1,000 volts/cm. Subsequently, the developed images are electrostatically transferred to paper. It is believed that the images thus generated will be initially colorless, will turn blue upon exposure to ultraviolet light, and will return to a colorless state upon exposure to visible-spectrum light as described in Example I.

EXAMPLE V

A photochromic liquid developer suitable for development of electrostatic latent images by a polarizable liquid development process is prepared as follows. A photochromic material (1,3-dihydro-1,3,3-trimethylspiro[2H-indole-2,3'-[3H]naphth[2,1-b][1,4]oxazine, available from Aldrich Chemical Co., Milwaukee, Wis., 12 parts by weight), polyvinyl pyrrolidone dispersing agent (PVP-K1 5, available from GAF Corp., 6 parts by weight), a glycerol ester of hydrogenated rosin binder (Staybelite Ester 5, available from Hercules, Inc., 15 parts by weight), dibutyl phthalate (66.75 parts by weight), and a tetrabutyl ammonium bromide conductivity enhancing agent (0.25 parts by weight) are admixed to form a developer composition. Thereafter, the developer is incorporated into a xerographic imaging test fixture containing a layered imaging member comprising an aluminum substrate, a photogenerating layer of trigonal selenium, 90 percent by weight, dispersed in 10 percent by weight of polyvinyl carbazole, and a charge transport layer containing N,N'-diphenyl-N,N-bis(3-methylphenyl) 1,1'-biphenyl-4,4'-diamine molecules, 55 percent by weight, dispersed in 45 percent by weight of the polycarbonate resinous binder Makrolon, which member has been negatively charged. A latent image on the layered member is curtailed with the developer composition utilizing a gravure roll, wherein the developer is attracted to the latent image by the application of an electric field of about 1,000 volts/cm. Subsequently, the developed images are electrostatically transferred to paper. It is believed that the images thus generated will be initially colorless, will turn blue upon exposure to ultraviolet light, and will return to a colorless state upon exposure to visible-spectrum light as described in Example I.

EXAMPLE VI

In a Union Process 1-S Attritor (Union Process Co., Akron, Ohio) is placed 200 grams of a copolymer of ethylene and methacrylic acid (89:11 molar ratio) with a melt index at 190° C. of 100 and an Acid Number of 66, 22 grams of a photochromic material of the formula

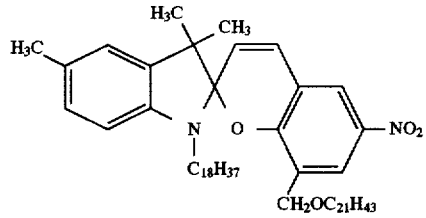

(1'-octadecyl-3',3'-dimethyl-5'-methyl-6-nitro-8-(docosanoyloxymethyl)spiro[2H-1-benzopyran-2,2'-indoline], available from Nippon Kanko-Shikiso Kenkyusho Company, Okayama, Japan), and 1000 grams of Isopar® L (Exxon Corp.). The attritor contents are heated to 100° C., and milled at a rotor speed of 230 rpm with 4.76 mm diameter stainless steel balls for two hours. The attritor is then cooled to room temperature while the milling is continued. Subsequently, 700 grams of Isopar® H is added to the attritor contents and milling is continued at a rotor speed of 330 rpm for 3 hours. The resulting particulate polymer dispersion is then drained to a holding tank. Thereafter, 92 grams of Basic Barium Petronate (Witco Chemical, New York, N.Y.) are added to the dispersion with stirring. Sufficient Isopar® H is also added to the dispersion to result in a 2 percent by weight solids dispersion, and the dispersion is stirred for 3 hours. The electrophoretic developer thus formed is incorporated into a Savin 870 copier and images are generated on paper. It is believed that the images thus generated will be initially colorless, will be rendered visible upon exposure to ultraviolet light, and will return to a colorless state upon exposure to visible-spectrum light.

EXAMPLE VII

A photochromic liquid developer suitable for development of electrostatic latent images is prepared as follows. A copolymer of ethylene (90% by weight) and methacrylic acid (10% by weight) (Nucrel 599, available from E.I. Du Pont de Nemours & Co., Wilmington, Del., 3.90 g), an aluminum stearate charge control agent (Witco 22, available from Witco Chemical Co., Des Plaines, Ill., 0.1 g), a photochromic material (1'-Dodecyl-6-nitro BIPS, where BIPS is Spiro (2H-1-benzopyran-2,2'-indoline, available from Chroma Chemicals, Dayton, Ohio 0.50 g), and an isoparaffinic hydrocarbon liquid (Isopar® L, available from Noco Lubrication, Tonawanda, N.Y., 170 g) are heated in a Union Process 01 attritor containing 2,400 grams of stainless steel 3/16 inch chrome-coated shot until 200° F. is achieved. After 10 minutes, heating is discontinued and ambient temperature stirring is maintained for 2 hours. Water cooling and stirring are then continued for 4 more hours. The ink is then washed from the shot and 63.1 g of Isopar® L using a strainer, and additional Isopar® L is then added, resulting in a developer with a solids content of about 1 percent by weight. This developer at 1 percent by weight solids and with suitable charge director (lecithin added dropwise until a conductivity of 12 picomhos per centimeter is achieved) can be used for the development of liquid immersion images by incorporating the ink into a Savin 870 photocopier and generating developing images. It is believed that the images thus generated will be initially colorless, will be rendered visible upon exposure to ultraviolet light, and will return to a colorless state upon exposure to visible-spectrum light.

EXAMPLE VIII

A photochromic liquid developer suitable for development of electrostatic latent images by a polarizable liquid development process is prepared as follows. A photochromic material (1,3-dihydro-1,3,3-trimethylspiro [2H-indole-2,3'-[3H]naphth[2,1-b]-[1,4]oxazine, available from Aldrich Chemical Company, Milwaukee, Wis., 3 parts by weight), polyvinylpyrrolidone dispersing agent (PVP-K15, available from GAF Corp., 6 parts by weight), a modified phenolic resin (15 parts by weight), and triethylene glycol monobutyl ether (67 parts by weight) are admixed to form a developer composition. Thereafter, the developer is incorporated into a xerographic imaging test fixture containing a layered imaging member comprising an aluminum substrate, a photogenerating layer of trigonal selenium, 90 percent by weight, dispersed in 10 percent by weight polyvinyl carbazole, and a charge transport layer containing N,N'-diphenyl-N,N-bis (3-methylphenyl) 1,1'-biphenyl-4,4'diamine molecules, 55 percent by weight, dispersed in 45 percent by weight of polycarbonate resinous binder Makrolon, which member has been negatively charged. A latent image on the layered member is curtailed with the developer composition utilizing a gravure roll, wherein the developer is attracted to the latent image by the application of an electric field of about 1,000 volts/cm. Subsequently, the developed images are electrostatically transferred to paper. It is believed that the images thus generated will be initially colorless, will be rendered visible upon exposure to ultraviolet light, and will return to a colorless state upon exposure to visible-spectrum light.

EXAMPLE IX

A photochromic liquid developer suitable for development of electrostatic latent images by a polarizable liquid development process is prepared as follows. A photochromic material (1',3'-dihydro-1',3',3'-trimethyl-6-nitrospiro[2H-1-benzopyran-2,2'-(2H)-indolel, available from Aldrich Chemical Company, Milwaukee, Wis., 3 parts by weight), polyvinylpyrrolidone dispersing agent (PVP-15, available from GAF Corp., 6 parts by weight), a glycerol ester of hydrogenated rosin binder (Staybelite Ester 5, available from Hercules, Inc., 15 parts by weight), dibutyl phthalate (66.75 parts by weight), and a tetrabutyl ammonium bromide conductivity enhancing agent (0.25 parts by weight) are admixed to form a developer composition. Thereafter, the developer is incorporated into a xerographic imaging test fixture containing a layered imaging member comprising an aluminum substrate, a photogenerating layer of trigonal selenium, 90 percent by weight, dispersed in 10 percent by weight polyvinyl carbazole, and a charge transport layer containing N,N'-diphenyl-N,N-bis(3-methylphenyl) 1,1'-biphenyl-4,4'diamine molecules, 55 percent by weight, dispersed in 45 percent by weight of polycarbonate resinous binder Makrolon, which member has been negatively charged. A latent image on the layered member is curtailed with the developer composition utilizing a gravure roll, wherein the developer is attracted to the latent image by the application of an electric field of about 1,000 volts/cm. Subsequently, the developed images are electrostatically transferred to paper. It is believed that the images thus generated will be initially colorless, will be rendered visible upon exposure to ultraviolet light, and will return to a colorless state upon exposure to visible-spectrum light.

Other embodiments and modifications of the present invention may occur to those skilled in the art subsequent to a review of the information presented herein. These embodiments and modifications, as well as equivalents thereof, are also included within the scope of this invention.

What is claimed is:

1. A toner composition for the development of electrostatic latent images consisting essentially of a mixture of (1) a first component which is a resin, (2) a second component which is a photochromic material selected from the group consisting of (a) spiropyrans of the formula

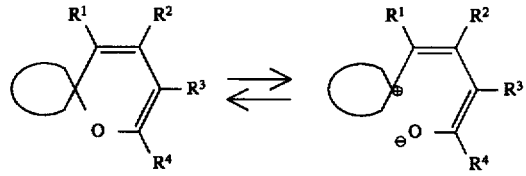

wherein $R_1$, $R_2$, $R_3$, and $R_4$ each, independently of the others, are hydrogen atoms, alkyl groups, aryl groups, arylalkyl groups, silyl groups, nitro groups, cyano groups, halide atoms, amine groups, hydroxy groups, alkoxy groups, aryloxy groups, alkylthio groups, arylthio groups, aldehyde groups, ketone groups, ester groups, amide groups, carboxylic acid groups, or sulfonic acid groups, wherein two or more R groups can be joined together to form a ring, (b) spirooxazines, (c) spirothiopyrans, (d) bisimidozole compounds, (e) bis-tetraphenylpyrrole compounds, (f) hydrozine compounds, (g) aryl disulfide compounds, (h) stilbene compounds, (i) aromatic azo compounds, and (j) mixtures thereof, (3) a third component which is a charge control agent, (4) an optional fourth component which is a colored dye, and (5) an optional fifth component which is a colored pigment.

2. A toner composition according to claim 1 wherein the photochromic material is present in the toner in an amount of from about 1 to about 20 percent by weight.

3. A toner composition according to claim 1 wherein the photochromic material is present in the toner in an amount of from about 5 to about 10 percent by weight.

4. A toner composition according to claim 1 wherein the photochromic material is a spiropyran of the formula

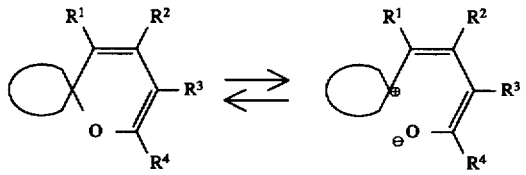

wherein $R_1$, $R_2$, $R_3$, and $R_4$ each, independently of the others, are hydrogen atoms, alkyl groups, aryl groups, arylalkyl groups, silyl groups, nitro groups, cyano groups, halide atoms, amine groups, hydroxy groups, alkoxy groups, aryloxy groups, alkylthio groups, arylthio groups, aldehyde groups, ketone groups, ester groups, amide groups, carboxylic acid groups, or sulfonic acid groups, wherein two or more R groups can be joined together to form a ring.

5. A toner composition according to claim 1 wherein the photochromic material is a spirooxazine.

6. A toner composition according to claim 1 wherein the photochromic material is a spirothiopyran.

7. A toner composition according to claim 1 wherein the photochromic material is selected from the group consisting of 1',3'-dihydro-1',3',3'-trimethyl-6-nitrospiro[2H-1-benzopyran-2,2'-(2H)indole], 1,3-dihydro-1,3,3-trimethylspiro[2H-indole-2,3'-[3H]naphth[2,1-b][1,4] oxazine, and mixtures thereof.

8. A toner composition according to claim 1 wherein the charge control agent is selected from the group consisting of alkyl pyridinium halides, distearyl dimethyl ammonium methyl sulfate, distearyl dimethyl ammonium bisulfate, zinc 3,5-di-tert-butyl salicylate compounds, aluminum 3,5-di-tert-butyl salicylate compounds, and mixtures thereof.

9. A toner composition according to claim 1 wherein the photochromic compound is selected from the group consisting of bisimidazole compounds, bis-tetraphenylpyrrole compounds, hydrazine compounds, aryl disulfide compounds, stilbene compounds, aromatic azo compounds, and mixtures thereof.

10. An imaging process which comprises generating an electrostatic latent image on an imaging member and developing the latent image by contacting the imaging member with a toner according to claim 1.

11. A process which comprises (a) generating an electrostatic latent image on an imaging member; (b) developing the latent image by contacting the imaging member with a toner according to claim 1, said photochromic material in said toner having a first state corresponding to a first absorption spectrum and a second state corresponding to a second absorption spectrum; and (c) thereafter effecting a photochromic change in at least some of the photochromic material in the developed image from the first state to the second state.

12. A process according to claim 11 wherein the photochromic change in the photochromic material from the first state to the second state is effected by irradiation with radiation at a selected wavelength.

13. A process according to claim 12 wherein said radiation is within the ultraviolet wavelength band.

14. A process according to claim 11 wherein the photochromic material in the second state subsequently is caused to undergo another photochromic change, thereby returning it to the first state.

15. A process according to claim 11 wherein the photochromic material in the second state subsequently is caused to undergo another photochromic change effected by irradiation with visible light, thereby returning it to the first state.

16. A process according to claim 11 wherein the photochromic material in the second state subsequently is caused to undergo another photochromic change effected by heating, thereby returning it to the first state.

17. A process according to claim 11 wherein all of the photochromic material in the developed image is caused to shift from the first state to the second state.

18. A method according to claim 11 wherein a first portion of the photochromic material in the developed image is caused to shift from the first state to the second state and a second portion of the photochromic material in the developed image remains in the first state.

19. A toner composition for the development of electrostatic latent images consisting essentially of a mixture of (1) a first component which is a resin, (2) a second component which is a photochromic material selected from the group consisting of bisimidazole compounds; bis-tetraphenylpyrrole compounds; hydrazine compounds; aryl disulfide compounds; stilbene compounds; aromatic azo compounds; spiro[2H-1-benzopyran-2,2'-indoline]; 6-acetyl-1',3'3'-trimethylspiro[2H-1-benzopyran-2,2'-indoline]; 8-allyl-5'-chloro-6-nitro-1',3',3'-trimethylspiro[2H-1-benzopyran-2,2'-indoline]; 8-allyl-3',3'-dimethyl-6'-nitro-1'-phenylspiro[2H-1-benzopyran-2,2'-indoline]; 8-allyl-6-nitro-1',3,3',3'-tetramethylspiro[2H-1-benzopyran-2,2'-indoline]; 8-allyl-6-nitro-1',3',3'-trimethylspiro[2H-1-benzopyran-2,2'-indoline]: 8-allyl-1',3',3'-trimethylspiro[2H-1-benzopyran-2,2'-indoline]; 5'-amino-5,7-dichloro-6-nitro-1',3',3'-trimethylspiro[2H-1-benzopyran-2,2'-indoline]; 6-amino-7-hydroxy-1',3',3'-trimethylspiro[2H-1-benzopyran-2,2'-indoline]; 5'-amino-8-methoxy-6-nitro-1',3',3'-trimethylspiro[2H-1-benzopyran-2,2'-indoline]; 5-amino-8-methoxy-1',3',3'-trimethylspiro[2H-1-benzopyran-2,2'-indoline]; 5'-amino-8-methoxy-1',3',3'-trimethylspiro[2H-1-benzopyran-2,2'-indoline]; 5'-amino-6-nitro-1',3',3'-trimethylspiro[2H-1-benzopyran-2,2'-indoline]; 5'-amino-1',3',3'-trimethylspiro[2H-1-benzopyran-2,2'-indoline]; 6-amino-1',3',3'-trimethylspiro[2H-1-benzopyran-2,2'-indoline]; 8-amino-1',3',3'-trimethylspiro[2H-1-benzopyran-2,2'-indoline]; 1'-amyl-5-bromo- 3',3'-dimethyl-8-methoxy-6-nitrospiro[2H-1-benzopyran-2,2'-indoline]; 1-amyl-3',3'-dimethyl-8-methoxyspiro[2H-1-benzopyran-2,2'-indoline]; 1'-amyl-3',3-dimethyl-6-methoxy-8-nitrospiro[2H-1-benzopyran-2,2'-indoline]; 1'-amyl-3',3-dimethyl-5',6-dinitro-8-methoxyspiro[2H-1-benzopyran-2,2'-indoline]; 1'-amyl-3',3-dimethyl-8-methoxy-5,5',6-trinitrospiro[2H-1-benzopyran-2,2'-indoline]; 1'-amyl-3,3'-dimethyl-6-trinitrospiro[2H-1-benzopyran-2,2'-indoline]; 6-bromo-1'-butyl-3',3'-dimethylspiro[2H-1-benzopyran-2,2'-indoline]; 8-bromo-1'-butyl-3',3'-dimethyl-6-nitrospiro[2H-1-benzopyran-2,2'-indoline]; 8-bromo-5'-chloro-5,7-dimethoxy-6-nitro-1',3',3'-trimethylspiro[2H-1-benzopyran-2,2'-indoline]; 8-bromo-5'-chloro-7-hydroxy-1',3',3'-trimethylspiro[2H-1-benzopyran-2,2'-indoline]: 5-bromo-5'-chloro-8-methoxy-1',3',3'-trimethylspiro[2H-1-benzopyran-2,2'-indoline]; 6-bromo-5'-chloro-8-methoxy-1',3',3'-trimethylspiro[2H-1-benzopyran-2,2'-indoline]; 5-bromo-6'-chloro-8-methoxy-6-nitro-1',3',3',7'-tetramethylspiro[2H-1-benzopyran-2,2'-indoline]; 5-bromo-5'-chloro-6-methoxy-8-nitro-1',3',3'-trimethylspiro[2H-1-benzopyran-2,2'-indoline]; 5-bromo-5'-chloro-8-methoxy-6-nitro-1',3',3'-trimethylspiro[2H-1-benzopyran-2,2'-indoline]; 5-bromo-7'-chloro-8-methoxy-6-nitro-1',3',3'-trimethylspiro[2H-1-benzopyran-2,2'-indoline]; 6-bromo-5'-chloro-8-nitro-1',3',3'-trimethylspiro[2H-1-benzopyran-2,2'-indoline]; 8-bromo-5'-chloro-6-nitro-1',3',3'-trimethylspiro[2H-1-benzopyran-2,2'-indoline]; 5-bromo-4',6'-dichloro-8-methoxy-6-nitro-1',3',3'-trimethylspiro[2H-1-benzopyran-2,2'-indoline]; 5-bromo-4',7'-dichloro-8-methoxy-6-nitro-1',3',3'-trimethylspiro[2H-1-benzopyran-2,2'-indoline]; 5-bromo-5',7'-dichloro-8-methoxy- 6-nitro-1',3',3'-trimethylspiro[2H-1-benzopyran-2,2'-indoline]; 6-bromo-5'-chloro-1',3',3'-trimethylspiro[2H-1-benzopyran-2,2'-indoline]; 5-bromo-3',3'-diethyl-8-methoxy-1'-methyl-6-nitrospiro[2H-1-benzopyran-2,2'-indoline]; 5-bromo-5',8-dimethoxy-6-nitro-1',3',3'-trimethylspiro[2H-1-benzopyran-2,2'-indoline]; 5-bromo-7',8-dimethoxy-6-nitro-1',3',3'-trimethylspiro[2H-1-benzopyran-2,2'-indoline]; 6-bromo-5',8-dimethoxy-1',3',3'-trimethylspiro[2H-1-benzopyran-2,2'-indoline]; 6-bromo-3',3'-dimethyl-1'-ethylspiro[2H-1-benzopyran-2,2'-indoline]; 6-bromo-3',3'-dimethyl-1'-ethyl-8-methoxyspiro[2H-1-benzopyran-2,2'-indoline]; 5-bromo-1',3'-dimethyl-3'-ethyl-6-methoxy-8-nitrospiro[2H-1-benzopyran-2,2'-indoline]; 5-bromo-1',3'-dimethyl-3'-ethyl-8-methoxy-6-nitrospiro[2H-1-benzopyran-2,2'-indoline]; 8-bromo-3',3'-dimethyl-1'-ethyl-6-nitrospiro[2H-1-benzopyran-2,2'-indoline]; 5-bromo-3',3'-dimethyl-1'-isoamyl-8-methoxy-6-nitrospiro[2H-1-benzopyran-2,2'-indoline]; 5-bromo-1',3'-dimethyl-6-methoxy-8-nitro-3'-phenylspiro[2H-1-benzopyran-2,2'-indoline]; 5-bromo-1',3'-dimethyl-8-methoxy-6-nitro-3'-phenylspiro[2H-1-benzopyran-2,2'-indoline]; 5-bromo-3',3'-dimethyl-6-methoxy-8-nitro-1'-phenylspiro[2H-1-benzopyran-2,2'-indoline]; 5-bromo-3',3'-dimethyl-8-methoxy-6-nitro-1'-phenylspiro[2H-1-benzopyran-2,2'-indoline]; 8-bromo-3',3'-dimethyl-6-nitro-1'-propylspiro[2H-1-benzopyran-2,2'-indoline]; 6-bromo-3',3'-dimethyl-1'-propylspiro[2H-1-benzopyran-2,2'-indoline]; 5-bromo-1'-dimethylamino-8-methoxy-3'-methyl-6-nitro-3'-phenylspiro[2H-1-benzopyran-2,2'-indoline]; 5-bromo-5',6-dinitro-8-methoxy-1',3',3'-trimethylspiro[2H-1-benzopyran-2,2'-indoline]; 5-bromo-3',3'-diphenyl-8-methoxy-1'-methyl-6-nitrospiro[2H-1-benzopyran-2,2'-indoline]; 5-bromo- 4',6'-diphenyl-8-methoxy-6-nitro-1',3',3'-trimeihylspiro[2H-1-benzopyran-2,2'-indoline]; 5-bromo-4'-fluoro-8-methoxy-6-nitro-1',3',3'-trimethylspiro[2H-1-benzopyran-2,2'-indoline]; 5-bromo-5'-fluoro-8-methoxy-6-nitro-1',3',3'-trimethylspiro[2H-1-benzopyran-2,2'-indoline]; 8-bromo-7-hydroxy-1',3',3'-trimethylspiro[2H-1-benzopyran-2,2'-indoline]; 5-bromo-8-methoxy-6-nitro-1',3',3',4',7'-pentomethylspiro[2H-1-benzopyran-2,2'-indoline]; 5-bromo-8-methoxy-6-nitro-1',3',3',5',7'-pentamethylspiro[2H-1-benzopyran-2,2'-indoline]; 5-bromo-6-methoxy-8-nitro-5'-phenyl-1',3',3'-trimethylspiro[2H-1-benzopyran-2,2'-indoline]; 5-bromo-6-methoxy-8-nitro-7'-phenyl-1',3',3'-trimethylspiro[2H-1-benzopyran-2,2'-indoline]; 5-bromo-8-methoxy-6-nitro-5'-phenyl-1',3',3'-trimethylspiro[2H-1-benzopyran-2,2'-indoline]; 5-bromo-8-methoxy-6-nitro-7'-phenyl-1',3',3'-trimethylspiro[2H-1-benzopyran-2,2'-indoline]; 5-bromo-8-methoxy-6-nitro-1',3,3',3'-tetramethylspiro[2H-1-benzopyran-2,2'-indoline]; 5-bromo-8-methoxy-6-nitro-1',3',3'5'-tetramethylspiro[2H-1-benzopyran-2,2'-indoline]; 5-bromo-8-methoxy-6-nitro-1',3',3',6'-tetramethylspiro[2H-1-benzopyran-2,2'-indoline]; 5-bromo-8-methoxy-6-nitro-1',3',3',7'-tetramethylspiro[2H-1-benzopyran-2,2'-indoline]; 5-bromo-6-methoxy-8-nitro-1',3',3'-trimethylspiro[2H-1-benzopyran-2,2'-indoline]; 5'-bromo-6-methoxy-8-nitro-1',3',3'-trimethylspiro[2H-1-benzopyran-2,2'-indoline]; 5-bromo-8-methoxy-6-nitro-1',3',3'-trimethylspiro[2H-1-benzopyran-2,2'-indoline]; 5'-bromo-8-methoxy-6-nitro-1',3',3'-trimethylspiro[2H-1-benzopyran-2,2'-indoline]; 6-bromo-8-methoxy-5-nitro-1',3',3'-trimethylspiro[2H-1-benzopyran-2,2'-indoline]; 5-bromo-8-methoxy-6-nitro-1',3',3'-trimethyl-4',6',7'-triphenylspiro[2H-1-benzopyran- 2,2'-indoline]; 5-bromo-8-methoxy-1',3',3'-trimethylspiro[2H-1-benzopyran-2,2'-indoline]; 6-bromo-5'-methoxy-1',3',3'-trimethylspiro[2H-1-benzopyran-2,2'-indoline]; 6-bromo-8-methoxy-1',3',3'-trimethylspiro[2H-1-benzopyran-2,2'-indoline]; 6-bromo-8-nitro-1',3,3',3'-tetramethylspiro[2H-1-benzopyran-2,2'-indoline]; 8-bromo-6-nitro-1',3,3',3'-tetramethylspiro[2H-1-benzopyran-2,2'-indoline]; 5-bromo-6-nitro-4',6',8-trimethoxy-1',3',3'-trimethylspiro[2H-1-benzopyran-2,2'-indoline]; 5-bromo-6-nitro-4',7',8-trimethoxy-1',3',3'-trimethylspiro[2H-1-benzopyran-2,2'-indoline]; 5-bromo-6-nitro-1',3',3'-trimethylspiro[2H-1-benzopyran-2,2'-indoline]; 5'-bromo-6-nitro-1',3',3'-trimethylspiro[2H-1-benzopyran-2,2'-indoline]; 6-bromo-8-nitro-1',3',3'-trimethylspiro[2H-1-benzopyran-2,2'-indoline]; 8-bromo-6-nitro-1',3',3'-trimethylspiro[2H-1-benzopyran-2,2'-indoline]; 6-bromo-5'-nitro-1',3',3'-trimethylspiro[2H-1-benzopyran-2,2'-indoline]; 6-bromo-1',3',3'-trimethylspiro[2H-1-benzopyran-2,2'-indoline]; 1'-butyl-6-chloro-3',3'-dimethyl-8-methoxyspiro[2H-1-benzopyran-2,2'-indoline]; 1'-butyl-3',3'-dimethylspiro[2H-1-benzopyran-2,2'-indoline]; 1'-butyl-3',3'-dimethyl-6,8-dinitrospiro[2H-1-benzopyran-2,2'-indoline]; 1'-butyl-3',3'-dimethyl-8-methoxyspiro[2H-1-benzopyran-2,2'-indoline]; 8-carbomethoxy-5'-chloro-1',3',3'-trimethylspiro[2H-1-benzopyran-2,2'-indoline]; 5'-carbomethoxy-6-nitro-1',3',3'-trimethylspiro[2H-1-benzopyran-2,2'-indoline]; 8-carbomethoxy-6-nitro-1',3',3'-trimethylspiro[2H-1-benzopyran-2,2'-indoline]; 6-carbomethoxy-1',3',3'-trimethylspiro[2H-1-benzopyran-2,2'-indoline]; 8-carbomethoxy-1',3',3'-trimethylspiro[2H-1-benzopyran-2,2'-indoline]; 6-carboxy-8-methoxy-1',3',3'-trimethylspiro[2H-1-benzopyran- 2,2'-indoline]; 5'-carboxy-6-nitro-1',3',3'-trimethylspiro[2H-1-benzopyran-2,2'-indoline]; 6-carboxy-1',3',3'-trimethylspiro[2H-1-benzopyran-2,2'-indoline]; 7-carboxy-1',3',3'-trimethylspiro[2H-1-benzopyran-2,2'-indoline]; 8-carboxy-1',3',3'-trimethylspiro[2H-1-benzopyran-2,2'-indoline]; 5'-chloro-6,8-dibromo-1',3',3'-trimethylspiro[2H-1-benzopyran-2,2'-indoline]; 6'-chloro-5,7-dimethoxy-6-nitro-1',3'3',7'-tetramethylspiro[2H-1-benzopyran-2,2'-indoline]; 5'-chloro-5,7-dimethoxy-6-nitro-1',3',3'-trimethylspiro[2H-1-benzopyran-2,2'-indoline]; 5'-chloro-7,8-dimethoxy-6-nitro-1',3',3'-trimethylspiro[2H-1-benzopyran-2,2'-indoline]; 7'-chloro-5,7-dimethoxy-6-nitro-1',3',3'-trimethylspiro[2H-1-benzopyran-2,2'-indoline]; 5'-chloro-5,7-dimethoxy-1',3',3'-trimethylspiro[2H-1-benzopyran-2,2'-indoline]; 6-chloro-5',8-dimethoxy-1',3',3'-trimethylspiro[2H-1-benzopyran-2,2'-indoline]; 6-chloro-7',8-dimethoxy-1',3',3'-trimethylspiro[2H-1-benzopyran-2,2'-indoline]; 6-chloro-3',3'-dimethyl-1'-ethyl-8-methoxyspiro[2H-1-benzopyran-2,2'-indoline]; 5-chloro-1',3'-dimethyl-8-methoxy-6-nitro-3'-phenylspiro[2H-1-benzopyran-2,2'-indoline]; 6-chloro-3',3'-dimethyl-8-methoxy-1'-phenylspiro[2H-1-benzopyran-2,2'-indoline]; 6-chloro-3',3'-dimethyl-8-nitro-1'-phenylspiro[2H-1-benzopyran-2,2'-indoline]; 5'-chloro-5,6-dinitro-8-methoxy-1',3',3'-trimethylspiro[2H-1-benzopyran-2,2'-indoline]; 5'-chloro-6,6'-dinitro-8-methoxy-1',3',3'-trimethylspiro[2H-1-benzopyran-2,2'-indoline]; 5'-chloro-6,8-dinitro-7-methoxy-1',3',3'-trimethylspiro[2H-1-benzopyran-2,2'-indoline]; 7'-chloro-5,6-dinitro-8-methoxy-1',3',3'-trimethylspiro[2H-1-benzopyran-2,2'-indoline]; 5'-chloro-6,6'-dinitro-1',3',3'-trimethylspiro[2H-1-benzopyran-2,2'-indoline]; 5'-chloro-6,8-dinitro- 1',3',3'-trimethylspiro[2H-1-benzopyran-2,2'-indoline]; 6-chloro-5',8-dinitro-1',3',3'-trimethylspiro[2H-1-benzopyran-2,2'-indoline]; 5'-chloro-7-ethoxy-6-nitro-1',3',3'-trimethylspiro[2H-1-benzopyran-2,2'-indoline]; 5-chloro-8-ethoxy-6-nitro-1',3',3'-trimethylspiro[2H-1-benzopyran-2,2'-indoline]; 5'-chloro-8-ethoxy-6-nitro-1',3',3'-trimethylspiro[2H-1-benzopyran-2,2'-indoline]; 5'-chloro-8-ethoxy-1',3',3'-trimethylspiro[2H-1-benzopyran-2,2'-indoline]; 6-chloro-8-ethoxy-1',3',3'-trimethylspiro[2H-1-benzopyran-2,2'-indoline]; 5'-chloro-8-fluoro-6-nitro-1',3',3'-trimethylspiro[2H-1-benzopyran-2,2'-indoline]; 5'-chloro-8-fluoro-1',3',3'-trimethylspiro[2H-1-benzopyran-2,2'-indoline]; 5'-chloro-6-formyl-1',3',3'-trimethylspiro[2H-1-benzopyran-2,2'-indoline]; 5'-chloro-6-hydroxy-8-methoxy-1',3',3'-trimethylspiro[2H-1-benzopyran-2,2'-indoline]; 5'-chloro-6-iodo-8-nitro-1',3',3'-trimethylspiro[2H-1-benzopyran-2,2'-indoline]; 5'-chloro-8-iodo-6-nitro-1',3',3'-trimethylspiro[2H-1-benzopyran-2,2'-indoline]; 5'-chloro-7-methoxy-6-nitro-1',3',3',5-tetramethylspiro[2H-1-benzopyran-2,2'-indoline]; 5-chloro-8-methoxy-6-nitro-1',3'3'-trimethylspiro[2H-1-benzopyran-2,2'-indoline]; 5'-chloro-6-methoxy-8-nitro-1',3',3'-trimethylspiro[2H-1-benzopyran-2,2'-indoline]; 5'-chloro-7-methoxy-6-nitro-1',3',3'-trimethylspiro[2H-1-benzopyran-2,2'-indoline]; 5'-chloro-8-methoxy-5-nitro-1',3',3'-trimethylspiro[2H-1-benzopyran-2,2'-indoline]; 5'-chloro-8-methoxy-6-nitro-1',3',3'-trimethylspiro[2H-1-benzopyran-2,2'-indoline]; 6-chloro-5'-methoxy-8-nitro-1',3',3'-trimethylspiro[2H-1-benzopyran-2,2'-indoline]; 7'-chloro-6-methoxy-8-nitro-1',3',3'-trimethylspiro[2H-1-benzopyran-2,2'-indoline]; 7'-chloro-8-methoxy-6-nitro-1',3',3'-trimethylspiro[2H-1-benzopyran-2,2'-indoline]; 5'-chloro-6-methoxy-1',3',3'-trimethylspiro[2H-1-benzopyran-2,2'-indoline]; 5-chloro-8-methoxy-1',3',3'-trimethylspiro[2H-1-benzopyran-2,2'-indoline); 5'-chloro-8-methoxy-1',3',3-trimethylspiro[2H-1-benzopyran-2,2'-indoline]; 6-chloro-5'-methoxy-1',3',3'-trimethylspiro[2H-1-benzopyran-2,2'-indoline]; 6-chloro-8-methoxy-1',3',3'-trimethylspiro[2H-1-benzopyran-2,2'-indoline]; 7-chloro-7'-methoxy-1',3',3'-trimethylspiro[2H-1-benzopyran-2,2'-indoline]; 5'-chloro-8-methoxy-1',3',3'-trimethyl-5,6,6'-trinitrospiro[2H-1-benzopyran-2,2'-indoline]; 5'-chloro-6-nitro-1',3',3',5,7-pentamethylspiro[2H-1-benzopyran-2,2'-indoline]; 5'-chloro-6-nitro-1',3',3',5,8-pentamethylspiro[2H-1-benzopyran-2,2'-indoline]; 6-chloro-8-nitro-1',3',3',5,7-pentamethylspiro[2H-1-benzopyran-2,2'-indoline]; 7-chloro-6-nitro-1',3,3',3'-tetramethylspiro[2H-1-benzopyran-2,2'-indoline]; 4'-chloro-6-nitro-1',3',3'-trimethylspiro[2H-1-benzopyran-2,2'-indoline]; 5-chloro-6-nitro-1',3',3'-trimethylspiro[2H-1-benzopyran-2,2'-indoline]; 5'-chloro-6-nitro-1',3',3'-trimethylspiro[2H-1-benzopyran-2,2'-indoline]; 5'chloro-8-nitro-1',3',3'-trimethylspiro[2H-1-benzopyran-2,2'-indoline]; 6'-chloro-6-nitro-1',3',3'-trimethylspiro[2H-1-benzopyran-2,2'-indoline]; 6-chloro-8-nitro-1',3',3'-trimethylspiro[2H-1-benzopyran-2,2'-indoline]; 7-chloro-6-nitro-1',3',3'-trimethylspiro[2H-1-benzopyran-2,2'-indoline]; 7'-chloro-6-nitro-1',3',3'-trimethylspiro[2H-1-benzopyran-2,2'-indoline]; 7-chloro-8-nitro-1',3',3'-trimethylspiro[2H-1-benzopyran-2,2'-indoline]; 8-chloro-6-nitro-1',3',3'-trimethylspiro[2H-1-benzopyran-2,2'-indoline]; 5'-chloro-6-(β-nitrovinyl)-1',3',3'-trimethylspiro[2H-1-benzopyran-2,2'-indoline]; 5'-chloro-1',3',3',5,7-pentamethylspiro[2H-1-benzopyran-2,2'-indoline]; 6-chloro-4',7',8-trimethoxy-1',3',3'-trimethylspiro[2H-1-benzopyran- 2,2'-indoline]; 5-chloro-1',3',3'-trimethylspiro[2H-1-benzopyran-2,2'-indoline; 5'chloro-1',3',3'-trimethylspiro[2H-1-benzopyran-2,2'-indoline]; 6-chloro-1',3',3'-trimethylspiro[2H-1-benzopyran-2,2'-indoline]; 7-chloro-1',3',3'-trimethylspiro[2H-1-benzopyran-2,2'-indoline]; 8-chloro-1',3',3'-trimethylspiro[2H-1-benzopyran-2,2'-indoline]: 6-cyano-1',3',3'-trimethylspiro[2H-1-benzopyran-2,2'-indoline]; 6,8-diallyl-1',3',3'-trimethylspiro[2H-1-benzopyran-2,2'-indoline]; 5,6-dibromo-8-methoxy-1',3',3'-trimethylspiro[2H-1-benzopyran-2,2'-indoline]; 6,8-dibromo-5'-methoxy-1',3',3'-trimethylspiro[2H-1-benzopyran-2,2'-indoline]; 6,8-dibromo-5-nitro-1',3',3'-trimethylspiro[2H-1-benzopyran-2,2'-indoline]; 6,8-dibromo-1',3',3'-trimethylspiro[2H-1-benzopyran-2,2'-indoline]; 4',7'-dichloro-5,7-dimethoxy-6-nitro-1',3',3'-trimethylspiro[2H-1-benzopyran-2,2'-indoline]; 5',8-dichloro-5,7-dimethoxy-6-nitro-1',3',3'-trimethylspiro[2H-1-benzopyran-2,2'-indoline]; 5,6-dichloro-3',3'-dimethyl-8-ethoxy-1'-phenylspiro[2H-1-benzopyran-2,2'-indoline]; 5,7-dichloro-1',3'-dimethyl-6-nitro-3'-phenylspiro[2H-1-benzopyran-2,2'-indoline]; 5,7-dichloro-3',3'-dimethyl-6-nitro-1'-phenylspiro[2H-1-benzopyran-2,2'-indoline]; 4',7'-dichloro-5,6-dinitro-8-methoxy-1',3',3'-trimethylspiro[2H-1-benzopyran-2,2'-indoline]; 4',7'-dichloro-7,8-dinitro-6-methoxy-1',3',3'-trimethylspiro[2H-1-benzopyran-2,2'-indoline]; 5,7-dichloro-5',6-dinitro-1',3',3'-trimethylspiro[2H-1-benzopyran-2,2'-indoline]; 5,7-dichloro-4',6'-diphenyl-6-nitro-1',3',3'-trimethylspiro[2H-1-benzopyran-2,2'-indoline]; 5,6-dichloro-8-ethoxy-1',3',3'-trimethylspiro[2H-1-benzopyran-2,2'-indoline]; 4',7'-dichloro-8methoxy-6-nitro-1',3',3'-trimethylspiro[2H-1-benzopyran- 2,2'-indoline]; 5,7-dichloro-5'-methoxy-6-nitro-1',3',3'-trimethylspiro[2H-1-benzopyran-2,2'-indoline]; 5,7-dichloro-7'-methoxy-6-nitro-1',3',3'-trimethylspiro[2H-1-benzopyran-2,2'-indoline]; 4',7'-dichloro-8-methoxy-1',3',3'-trimethylspiro[2H-1-benzopyran-2,2'-indoline]; 5,6-dichloro-8-methoxy-1',3',3'-trimethylspiro[2H-1-benzopyran-2,2'-indoline]; 5',6-dichloro-8-methoxy-1',3',3'-trimethylspiro[2H-1-benzopyran-2,2'-indoline]; 6,7'-dichloro-8-methoxy-1',3',3'-trimethylspiro[2H-1-benzopyran-2,2'-indoline]; 5,7-dichloro-6-nitro-1',3',3',4',7'-pentamethylspiro[2H-1-benzopyran-2,2'-indoline]; 5,7-dichloro-6-nitro-1',3',3',5',7'-pentamethylspiro[2H-1-benzopyran-2,2'-indoline]; 5,7-dichloro-6-nitro-7'-phenyl-1',3',3'-trimethylspiro[2H-1-benzopyran-2,2'-indoline]; 5,7-dichloro-6-nitro-4',5',6',7'-tetrafluoro-1',3',3'-trimethylspiro[2H-1-benzopyran-2,2'-indoline]; 4',6'-dichloro-6-nitro-1',3',3'-trimethylspiro[2H-1-benzopyran-2,2'-indoline]; 4',7'-dichloro-6-nitro-1',3',3'-trimethylspiro[2H-1-benzopyran-2,2'-indoline]; 5,7-dichloro-6-nitro-1',3',3',5'-tetramethylspiro[2H-1-benzopyran-2,2'-indoline]; 5,5'-dichloro-6-nitro-1',3',3'-trimethylspiro[2H-1-benzopyran-2,2'-indoline]; 5',6-dichloro-8-nitro-1',3',3'-trimethylspiro[2H-1-benzopyran-2,2'-indoline]; 5,7-dichloro-6-nitro-1 ',3',3'-trimethylspiro[2H-1-benzopyran-2,2'-indoline]; 5,8-dichloro-6-nitro-1',3',3'-trimethylspiro[2H-1-benzopyran-2,2'-indoline]; 5',7'-dichloro-6-nitro-1',3',3'-trimethylspiro[2H-1-benzopyran-2,2'-indoline; 5',8-dichloro-6-nitro-1',3',3'-trimethylspiro[2H-1-benzopyran-2,2'-indoline]; 6,8-dichloro-5-nitro-1,3',3'-trimethylspiro[2H-1-benzopyran-2,2'-indoline]; 7,8-dichloro-6-nitro-1',3',3'-trimethylspiro[2H-1-benzopyran-2,2'-indoline]; 5,7-dichloro-6-nitro-1',3',3'-trimethyl-4',6',7'-triphenylspiro[2H-1-benzopyran-2,2'-indoline]; 5',6-dichloro-1',3',3'-trimethylspiro[2H-1-benzopyran-2,2'-indoline]; 5,7-dichloro-1',3',3'-trimethylspiro[2H-1-benzopyran-2,2'-indoline]; 5',7-dichloro-1',3',3'-trimethylspiro[2H-1-benzopyran-2,2'-indoline]; 6,8-dichloro-1',3',3'-trimethylspiro[2H-1-benzopyran-2,2'-indoline]; 7,8dichloro-1',3',3'-trimethylspiro[2H 1-benzopyran-2,2'-indoline]; 4',7'-diethoxy-8-methoxy-1',3',3'-trimethylspiro[2H-1-benzopyran-2,2'-indoline]; 3',3'-diethyl-6-methoxy-1'-methyl-8-nitrospiro[2H-1-benzopyran-2,2'-indoline]; 3',3'-diethyl-8-methoxy-1'-methyl-6-nitrospiro[2H-1-benzopyran-2,2'-indoline]; 3',3'-diethyl-1'-methyl-6-nitrospiro[2H-1-benzopyran-2,2'-indoline]; 1',3'-diethyl-3'-methyl-4',7',8'-trimethoxyspiro[2H-1-benzopyran-2,2'-indoline]; 7-diethylamino-1',3',3'-trimethylspiro[2H-1-benzopyran-2,2'-indoline]; 5,7-dihydroxy-1',3',3'-trimethylspiro[2H-1-benzopyran-2,2'-indoline]; 6,8-diiodo-1',3',3'-trimethylspiro[2H-1-benzopyran-2,2'-indoline]; 5',8'-dimethoxy-3',3'-dimethyl-1'-ethylspiro[2H-1-benzopyran-2,2'-indoline]; 5,7-dimethoxy-3',3'-dimethyl-5',6-dinitro-1'-isoamylspiro[2H-1-benzopyran-2,2'-indoline]; 5,7-dimethoxy-1',3'-dimethyl-6-nitro-3'-phenylspiro[2H-1-benzopyran-2,2'-indoline]; 5,7-dimethoxy3',3'-dimethyl-6-nitro-1'-phenylspiro[2H-1-benzopyran-2,2'-indoline]; 1',8-dimethoxy-5,6-dinitro-3'-methyl-3'-phenylspiro[2H-1-benzopyran-2,2'-indoline]; 4',7'-dimethoxy-6,8-dinitro-1',3',3'-trimethylspiro[2H-1-benzopyran-2,2'-indoline]; 5,7-dimethoxy-6,8-dinitro-1',3',3'-trimethylspiro[2H-1-benzopyran-2,2'-indoline]; 5',8-dimethoxy-5,6-dinitro-1',3',3'-trimethylspiro[2H-1-benzopyran-2,2'-indoline]; 6',8-dimethoxy-5,6-dinitro-1',3',3'-trimethylspiro[2H-1-benzopyran-2,2'-indoline]; 7',8-dimethoxy- 5,6-dinitro-1',3',3'-trimethylspiro[2H-1-benzopyran-2,2'-indoline]; 4',7'-dimethoxy-8-ethoxy-1',3',3'-trimethylspiro[2H-1-benzopyran-2,2'-indoline]; 5',7'-dimethoxy-8-ethoxy-1',3',3'-trimethylspiro[2H-1-benzopyran-2,2'-indoline]; 5,7-dimethoxy-4'-fluoro-6-nitro-1',3',3'-trimethylspiro[2H-1-benzopyran-2,2'-indoline]; 5,7-dimethoxy-5'-fluoro-6-nitro-1',3',3'-trimethylspiro[2H-1-benzopyran-2,2'-indoline]; 1',8-dimethoxy-3'-methyl-6-nitro-3'-phenylspiro[2H-1-benzopyran-2,2'-indoline]; 5,7-dimethoxy-6-nitro-7'-phenyl-1',3',3'-trimethylspiro[2H-1-benzopyran-2,2'-indoline]; 4',7'-dimethoxy-6-nitro-1',3',3'-trimethylspiro[2H-1-benzopyran-2,2'-indoline]; 4',7'-dimethoxy-8-nitro-1',3',3'-trimethylspiro[2H-1-benzopyran-2,2'-indoline]; 5',6-dimethoxy-8-nitro-1',3',3'-trimethylspiro[2H-1-benzopyran-2,2'-indoline]; 5,7-dimethoxy-6-nitro-1',3',3'-trimethylspiro[2H-1-benzopyran-2,2'-indoline]; 5',8-dimethoxy-5-nitro-1',3',3'-trimethylspiro[2H-1-benzopyran-2,2'-indoline]; 5',8-dimethoxy-6-nitro-1',3',3'-trimethylspiro[2H-1-benzopyran-2,2'-indoline]; 6,7'-dimethoxy-8-nitro-1',3',3'-trimethylspiro[2H-1-benzopyran-2,2'-indoline]; 7',8-dimethoxy-5-nitro-1',3',3'-trimethylspiro[2H-1-benzopyran-2,2'-indoline]; 7',8-dimethoxy-6-nitro-1',3',3'-trimethylspiro[2H-1-benzopyran-2,2'-indoline]; 5,7-dimethoxy-6-nitro-1',3',3'-trimethyl-4',6',7'-triphenylspiro[2H-1-benzopyran-2,2'-indoline]; 5,7-dimethoxy-1',3',3'-trimethylspiro[2H-1-benzopyran-2,2'-indoline]; 5',8-dimethoxy-1',3',3'-trimethylspiro[2H-1-benzopyran-2,2'-indoline]; 7',8-dimethoxy-1',3',3'-trimethylspiro[2H-1-benzopyran-2,2'-indoline]; 1',3'-dimethyl-6,8-dinitro-3'-ethylspiro[2H-1-benzopyran-2,2'-indoline]; 3',3'-dimethyl-6,8-dinitro-1'-ethylspiro[2H-1-benzopyran-2,2'-indoline]; 3',3'-dimethyl-5,6-dinitro-1'-hexadecyl-8-methoxyspiro[2H-1-benzopyran-2,2'-indoline]; 3',3'-dimethyl-6,8-dinitro-1'-isoamylspiro[2H-1-benzopyran-2,2'-indoline]; 3',3'-dimethyl-5,6-dinitro-1'-isoamyl-8-methoxyspiro[2H-1-benzopyran-2,2'-indoline]; 3',3'-dimethyl-6,8-dinitro-1'-isoamyl-7-methoxyspiro[2H-1-benzopyran-2,2'-indoline]; 1',3'-dimethyl-5,6-dinitro-8-methoxy-3'-phenylspiro[2H-1-benzopyran-2,2'-indoline]. 1',3'-dimethyl-5',6-dinitro-8-methoxy-3'-phenylspiro[2H-1-benzopyran-2,2'-indoline]; 3,3'-dimethyl-5,6-dinitro-8-methoxy-1'-phenylspiro[2H-1-benzopyran-2,2'-indoline]; 3,3'-dimethyl-6,8-dinitro-7-methoxy-1'-phenylspiro[2H-1-benzopyran-2,2'-indoline]; 3',3'-dimethyl-7,8-dinitro-6-methoxy-1'-phenylspiro[2H-1-benzopyran-2,2'-indoline]; 1',3'-dimethyl-6,8-dinitro-3'-phenylspiro[2H-1-benzopyran-2,2'-indoline]; 3',3'-dimethyl-6,8-dinitro-1'-phenylspiro[2H-1-benzopyran-2,2'-indoline]; 3',3'-dimethyl-6,8-dinitro-1'-propylspiro[2H-1-benzopyran-2,2'-indoline]; 1',3'-dimethyl-3',7'-diphenyl-8-methoxy-6-nitrospiro[2H-1-benzopyran-2,2'-indoline]; 3',3'-dimethyl-8-ethoxy-1'-phenylspiro[2H-1-benzopyran-2,2'-indoline]; 1',3'-dimethyl-3'-ethylspiro[2H-1-benzopyran-2,2'-indoline]; 3',3'-1-dimethyl-1'-ethylspiro[2H-1-benzopyran-2,2'-indoline]; 1',3'-dimethyl-3'-ethyl-8-methoxyspiro[2H-1-benzopyran-2,2'-indoline]; 3',3'-dimethyl-1'-ethyl-8-methoxyspiro[2H-1-benzopyran-2,2'-indoline]; 1',3'-dimethyl-3'-ethyl-6-methoxy-8-nitrospiro[2H-1-benzopyran-2,2'-indoline]; 1',3'-dimethyl-3'-ethyl-8-methoxy-5-nitrospiro[2H-1-benzopyran-2,2'-indoline]; 1',3'-dimethyl-3'-ethyl-8-methoxy-6-nitrospiro[2H-1-benzopyran-2,2'-indoline]; 3',3'-dimethyl-1'-ethyl-8-methoxy-6-nitrospiro[2H-1-benzopyran-2,2'-indoline]; 1',3'-dimethyl-3'-ethyl-6-nitrospiro[2H-1-benzopyran-2,2'-indoline]; 3',3'-dimethyl- 1'-ethyl-6-nitrospiro[2H-1-benzopyran-2,2'-indoline]; 3',3'-dimethyl-1'-ethyl-8-nitrospiro[2H-1-benzopyran-2,2'-indoline]; 3',3'-dimethyl-1'-hexadecyl-6-nitrospiro[2H-1-benzopyran-2,2'-indoline]; 3',3'-dimethyl-1'-(β-hydroxyethyl)-6-nitrospiro[2H-1-benzopyran-2,2'-indoline]; 3,3'-dimethyl-1'-isoamyl-8-methoxy-5,5',6-trinitrospiro[2H-1-benzopyran-2,2'-indoline]; 3',3'-dimethyl-1'-isoamyl-6-nitrospiro[2H-1-benzopyran-2,2'-indoline]; 3',3'-dimethyl-1-isoamyl-5',6,8-trinitrospiro[2H-1-benzopyran-2,2'-indoline]; 3',3'-dimethyl-1'-isopropyl-8-methoxy-6-nitrospiro[2H-1-benzopyran-2,2'-indoline]; 1',3'-dimethyl-6-methoxy-8-nitro-3'-phenylspiro[2H-1-benzopyran-2,2'-indoline]; 1',3'-dimethyl-8-methoxy-6-nitro-3'-phenylspiro[2H-1-benzopyran-2,2'-indoline]; 3',3'-dimethyl-6-methoxy-8-nitro-1'-phenylspiro[2H-1-benzopyran-2,2'-indoline]; 3',3'-dimethyl-7-methoxy-6-nitro-1'-phenylspiro[2H-1-benzopyran-2,2'-indoline]; 3',3'-dimethyl-8-methoxy-5-nitro-1-phenylspiro[2H 1-1-benzopyran-2,2'-indoline]; 3',3'-dimethyl-8-methoxy-6-nitro-1'-phenylspiro[2H-1-benzopyran-2,2'-indoline]; 3',3'-dimethyl-8-methoxy-6-nitro-1'-propylspiro[2H-1-benzopyran-2,2'-indoline]; 1',3'-dimethyl-8-methoxy-3'-phenylspiro[2H-1-benzopyran-2,2'-indoline]; 3',3'-dimethyl-8-methoxy-1'-phenylspiro[2H-1-benzopyran-2,2'-indoline]; 3',3'-dimethyl-8-methoxy-1'-propylspiro[2H-1-benzopyran-2,2'-indoline]; 1',3'-dimethyl-6-nitro-3'-phenylspiro[2H-1-benzopyran-2,2'-indoline]; 1',3'-dimethyl-8-nitro-3'-phenylspiro[2H-1-benzopyran-2,2'-indoline]; 3 ',3'-dimethyl-6-nitro-1'-phenylspiro[2H-1-benzopyran-2,2'-indoline]; 3',3'-dimethyl-1-phenylspiro[2H-1-benzopyran-2,2'-indoline]; 3',3'-dimethyl-1'-propylspiro[2H-1-benzopyran-2,2'-indoline]; 1'-dimethylamino-5,6-dinitro- 8-methoxy-3'-methyl-3'-phenylspiro[2H-1-benzopyran-2,2'-indoline]; 1'-dimethylamino-8-methoxy-3'-methyl-6-nitro-3'-phenylspiro[2H-1-benzopyran-2,2'-indoline]; 1'-dimethylamino-3'-1-methyl-6-nitro-3'-phenylspiro[2H-1-benzopyran-2,2'-indoline]; 5,6-dinitro-8-methoxy-1',3',3',4',7'-pentamethylspiro[2H-1-benzopyran-2,2'-indoline]; 5,6-dinitro-8-methoxy-7'-phenyl-1',3',3'-trimethylspiro[2H-1-benzopyran-2,2'-indoline]; 5,6-dinitro-8-methoxy-1',3,3',3'-tetramethylspiro[2H-1-benzopyran-2,2'-indoline]; 5,6-dinitro-8-methoxy-1',3',3',5'-tetramethylspiro[2H-1-benzopyran-2,2'-indoline]; 5,6'-dinitro-8-methoxy-1',3',3'-trimethylspiro[2H-1-benzopyran-2,2'-indoline]. 5,6-dinitro-8-methoxy-1',3',3'-trimethylspiro[2H-1-benzopyran-2,2'-indoline]; 5',8-dinitro-6-methoxy-1',3',3'-trimethylspiro[2H-1-benzopyran-2,2'-indoline]; 6,7'-dinitro-8-methoxy-1 ',3',3'-trimethylspiro[2H-1-benzopyran-2,2'-indoline]; 6,8-dinitro-5'-methoxy-1',3',3'-trimethylspiro[2H-1-benzopyran-2,2'-indoline]; 6,8-dinitro-7-methoxy-1',3',3'-trimethylspiro[2H-1-benzopyran-2,2'-indoline]; 5,6-dinitro-8-methoxy-1',3',3'-trimethyl-4',6',7'-triphenylspiro[2H-1-benzopyran-2,2'-indoline]; 6,8-dinitro-5'-phenyl-1',3',3'-trimethylspiro[2H-1-benzopyran-2,2'-indoline]; 6,8-dinitro-1',3,3',3'-tetramethylspiro[2H-1-benzopyran-2,2'-indoline]; 6,8-dinitro-1',3',3',7'-tetramethylspiro[2H-1-benzopyran-2,2'-indoline]; 5',6-dinitro-1',3',3'-trimethylspiro[2H-1-benzopyran-2,2'-indoline]; 6,8-dinitro-1',3',3'-trimethylspiro[2H-1-benzopyran-2,2'-indoline]; 4',6'-diphenyl-8-methoxy-6-nitro-1',3',3'-trimethylspiro[2H-1-benzopyran-2,2'-indoline]; 3',3'-diphenyl-1'-methyl-6-nitrospiro[2H-1-benzopyran-2,2'-indoline]; 4',6'-diphenyl-6-nitro-1',3',3'-trimethylspiro[2H-1-benzopyran-2,2'-indoline]; 5',7'-diphenyl-6-nitro-1',3',3-trimethylspiro[2H-1-benzopyran-2,2'-indoline]; 6-ethoxy-8-nitro-1',3',3'-trimethylspiro[2H-1-benzopyran-2,2'-indoline]; 8-ethoxy-6-nitro-1',3',3'-trimethylspiro[2H-1-benzopyran-2,2'-indoline]; 8-ethoxy-1',3',3',4',7'-pentamethylspiro[2H-1-benzopyran-2,2'-indoline]; 8-ethoxy-5'-phenyl-1',3',3'-trimethylspiro[2H-1-benzopyran-2,2'-indoline]; 8-ethoxy-7'-phenyl-1',3',3'-trimethylspiro[2H-1-benzopyran-2,2'-indoline]; 8-ethoxy-1',3',3'-trimethylspiro[2H-1-benzopyran-2,2'-indoline]; 8-ethoxymethyl-6-nitro-1',3'3'-trimethylspiro[2H-1-benzopyran-2,2'-indoline]; 3'-ethyl-8-methoxy-3'-methyl-1'- phenylspiro[2H-1-benzopyran-2,2'-indoline]; 3'-ethyl-3'-methyl-6-nitro-1'-phenylspiro[2H-1-benzopyran-2,2'-indoline], 8-ethyl-6-nitro-1',3',3'-trimethylspiro[2H-1-benzopyran-2,2'-indoline]; 4'-fluoro-8-methoxy-6-nitro-1',3',3'-trimethylspiro[2H-1-benzopyran-2,2'-indoline]; 5'-fluoro-6-methoxy-8-nitro-1',3',3'-trimethylspiro[2H-1-benzopyran-2,2'-indoline], 5'-fluoro-8-methoxy-6-nitro-1',3',3'-trimethylspiro[2H-1-benzopyran-2,2'-indoline]; 4'-fluoro-6-nitro-1',3',3'-trimethylspiro[2H-1-benzopyran-2,2'-indoline]; 5'-fluoro-6-nitro-1',3',3'-trimethylspiro[2H-1-benzopyran-2,2'-indoline]; 6-fluoro-8-nitro-1',3',3'-trimethylspiro[2H-1-benzopyran-2,2'-indoline]; 8-fluoro-6-nitro-1',3',3'-trimethylspiro[2H-1-benzopyran-2,2'-indoline]; 7-fluoro-1',3',3'-trimethylspiro[2H-1-benzopyran-2,2'-indoline]; 8-fluoro-1',3',3'-trimethylspiro[2H-1-benzopyran-2,2'-indoline]; 8-formyl-7-hydroxy-1',3',3'-trimethylspiro[2H-1-benzopyran-2,2'-indoline]; 6-formyl-8-methoxy-1',3',3'-trimethylspiro[2H-1-benzopyran-2,2'-indoline]; 6-formyl-1',3',3'-trimethylspiro[2H-1-benzopyran-2,2'-indoline]; 8-formyl-1',3',3'-trimethylspiro[2H-1-benzopyran-2,2'-indoline]; 1',3',3',5,5',7-hexamethyl-6-nitrospiro[2H-1-benzopyran-2,2'-indoline]; 1',3',3',5,7,8-hexamethyl-6-nitrospiro[2H-1-benzopyran-2,2'-indoline]; 5'-(β-hydroxyethyl)-8-methoxy-6-nitro-1',3',3'-trimethylspiro[2H-1-benzopyran-2,2'-indoline]; 5'-(β-hydroxyethyl)-8-methoxy-1',3',3'-trimethylspiro[2H-1-benzopyran-2,2'-indoline]; 5'-(β-hydroxyethyl)-6-nitro-1',3',3'-trimethylspiro[2H-1-benzopyran-2,2'-indoline]; 5'-(β-hydroxyethyl)-1',3',3'-trimethylspiro[2H-1-benzopyran-2,2'-indoline]; 6-hydroxy-8-methoxy-1',3',3'-trimethylspiro[2H-1-benzopyran-2,2'-indoline]; 7-hydroxy-5'-nitro-1',3',3'-trimethylspiro[2H-1-benzopyran-2,2'-indoline]; 7-hydroxy-6-nitro-1',3',3'-trimethylspiro[2H-1-benzopyran-2,2'-indoline]; 6-hydroxy-1',3',3'-trimethylspiro[2H-1-benzopyran-2,2'-indoline]; 8-hydroxy-1',3',3'-trimethylspiro[2H-1-benzopyran-2,2'-indoline]; 8-hydroxymethyl-6-nitro-1',3',3'-trimethylspiro[2H-1-benzopyran-2,2'-indoline]; 6-iodo-8-nitro-1',3',3'-trimethylspiro[2H-1-benzopyran-2,2'-indoline]; 8-iodo-6-nitro-1',3',3'-trimethylspiro[2H-1-benzopyran-2,2'-indoline]; 1-methoxy-3'-methyl-6-nitro-3'-phenylspiro[2H-1-benzopyran-2,2'-indoline]; 5'-methoxy-6-nitro-1',3',3',5,7-pentamethylspiro[2H-1-benzopyran-2,2'-indoline]; 5'-methoxy-6-nitro-1',3',3',5,8-pentamethylspiro[2H-1-benzopyran-2,2'-indoline; 7'-methoxy-6-nitro-1',3',3',5,7-pentamethylspiro[2H-1-benzopyran-2,2'-indoline]; 7'-methoxy-6-nitro-1',3',3',5,8-pentamethylspiro[2H-1-benzopyran-2,2'-indoline]; 6-methoxy-8-nitro-5'-phenyl-1',3',3'-trimethylspiro[2H-1-benzopyran-2,2'-indoline]; 6-methoxy-8-nitro-7'-phenyl-1',3',3'-trimethylspiro[2H-1-benzopyran-2,2-indoline]; 7-methoxy-6-nitro-7'-phenyl-1',3',3'-trimethylspiro[2H-1-benzopyran- 2,2'-indoline]; 8-methoxy-5-nitro-5'-phenyl-1',3',3'-trimethylspiro[2H-1-benzopyran-2,2'-indoline]; 8-methoxy-5-nitro-7'-phenyl-1',3',3'-trimethylspiro[2H-1-benzopyran-2,2'-indoline]; 8-methoxy-6-nitro-3-phenyl-1',3',3'-trimethylspiro[2H-1-benzopyran-2,2'-indoline]; 8-methoxy-6-nitro-5'-phenyl-1',3',3'-trimethylspiro[2H-1-benzopyran-2,2'-indoline]; 8-methoxy-6-nitro-7'-phenyl-1',3',3'-trimethylspiro[2H-1-benzopyran-2,2'-indoline]; 6-methoxy-8-nitro-1',3,3',3'-tetramethylspiro[2H-1-benzopyran-2,2'-indoline]; 6-methoxy-8-nitro-1',3',3',5'-tetramethylspiro[2H-1-benzopyran-2,2'-indoline]; 6-methoxy-8-nitro-1',3',3',6'-tetramethylspiro[2H-1-benzopyran-2,2'-indoline]; 6-methoxy-8-nitro-1',3',3',7'-tetramethylspiro[2H-1-benzopyran-2,2'-indoline]; 7-methoxy-6-nitro-1',3,3',3'-tetramethylspiro[2H-1-benzopyran-2,2'-indoline]; 7-methoxy-6-nitro-1',3',3',5'-tetramethylspiro[2H-1-benzopyran-2,2'-indoline]; 8-methoxy-5-nitro-1',3,3',3'-tetramethylspiro[2H-1-benzopyran-2,2'-indoline]; 8-methoxy-5-nitro-1',3',3',6'-tetramethylspiro[2H-1-benzopyran-2,2'-indoline]; 8-methoxy-5-nitro-1',3',3',7'-tetramethylspiro[2H-1-benzopyran-2,2'-indoline]; 8-methoxy-6-nitro-1',3,3',3'-tetramethylspiro[2H-1-benzopyran-2,2'-indoline]; 8-methoxy-6-nitro-1',3',3',4'-tetramethylspiro[2H-1-benzopyran-2,2'-indoline]; 8-methoxy-6-nitro-1',3',3',5'-tetramethylspiro[2H-1-benzopyran-2,2'-indoline]; 8-methoxy-6-nitro-1',3',3',6'-tetramethylspiro[2H-1-benzopyran-2,2'-indoline]; 8-methoxy-6-nitro-1',3',3',7'-tetramethylspiro[2H-1-benzopyran-2,2'-indoline]; 8-methoxy-6-nitro-1',3',3'-triethylspiro[2H-1-benzopyran-2,2'-indoline]; 5'-methoxy-6-nitro-1',3',3'-trimethylspiro[2H-1-benzopyran-2,2'-indoline]; 5'-methoxy-8-nitro- 1',3',3'-trimethylspiro[2H-1-benzopyran-2,2'-indoline]; 6-methoxy-8-nitro-1',3',3'-trimethylspiro[2H-1-benzopyran-2,2'-indoline]; 7-methoxy-6-nitro-1',3',3'-trimethylspiro[2H-1-benzopyran-2,2'-indoline]; 7-methoxy-6-nitro-1',3',3'-trimethylspiro[2H-1-benzopyran-2,2'-indoline]; 7'-methoxy-8-nitro-1',3',3'-trimethylspiro[2H-1-benzopyran-2,2'-indoline]; 8-methoxy-5-nitro-1',3',3'-trimethylspiro[2H-1-benzopyran-2,2'-indoline]; 8-methoxy-5'-nitro-1',3',3'-trimethylspiro[2H-1-benzopyran-2,2'-indoline]; 8-methoxy-6-nitro-1',3',3'-trimethylspiro[2H-1-benzopyran-2,2'-indoline]; 7-methoxy-6-nitro-1',3',3'-trimethyl-4',6',7'-triphenylspiro[2H-1-benzopyran-2,2'-indoline]; 8-methoxy-6-nitro-1',3',3'-trimethyl-4',6',7'-triphenylspiro[2H-1-benzopyran-2,2'-indoline]; 8-methoxy-1',3',3',4',7'-pentamethylspiro[2H-1-benzopyran-2,2'-indoline]; 8-methoxy-5'-phenyl-1',3',3'-trimethylspiro[2H-1-benzopyran-2,2'-indoline]8-methoxy-7'-phenyl-1'3',3'-trimethylspiro[2H-1-benzopyran-2,2'-indoline]; 8-methoxy-1',3,3',3'-tetramethylspiro[2H-1-benzopyran-2,2'-indoline]; 8-methoxy-4',6,7'-trichloro-1',3',3'-trimethylspiro[2H-1-benzopyran-2,2'-indoline]; 5'-methoxy-1',3',3'-trimethylspiro[2H-1-benzopyran-2,2'-indoline]; 6-methoxy-1',3',3'-trimethylspiro[2H-1-benzopyran-2,2'-indoline]; 7-methoxy-1',3',3'-trimethylspiro[2H-1-benzopyran-2,2'-indoline]; 8-methoxy-1',3',3'-trimethylspiro[2H-1-benzopyran-2,2'-indoline]; 8-methoxy-1',3',3'-trimethyl-5,5',6-trinitrospiro[2H-1-benzopyran-2,2'-indoline]; 6-nitro-1',3',3',5,7-pentamethylspiro[2H-1-benzopyran-2,2'-indoline]; 6-nitro-1',3',3',5,8-pentamethylspiro[2H-1-benzopyran-2,2'-indoline]; 6-(o-nitrophenylazo)-1',3',3'-trimethylspiro[2H-1-benzopyran-2,2'-indoline]; 6-(p-nitrophenylazo)-1',3',3'-trimethylspiro[2H-1-benzopyran- 2,2'-indoline]; 6-nitro-5'-phenyl-1',3',3'-trimethylspiro[2H-1-benzopyran-2,2'-indoline]; 6-nitro-7'-phenyl-1',3',3'-trimethylspiro[2H-1-benzopyran-2,2'-indoline]; 8-nitro-5'-phenyl-1',3',3'-trimethylspiro[2H-1-benzopyran-2,2'-indoline]; 8-nitro-7'-phenyl-1'3',3'-trimethylspiro[2H-1-benzopyran-2,2'-indoline]; 6-nitro-8-piperidinomethyl-1',3',3'-trimethylspiro[2H-1-benzopyran-2,2'-indoline]; 7-nitro-5,5',6,8-tetrachloro-1',3',3'-trimethylspiro[2H-1-benzopyran-2,2'-indoline]; 6-nitro-4',5',6',7'-tetrafluoro-1',3',3'-trimethylspiro[2H-1-benzopyran-2,2'-indoline]; 6-nitro-1',3,3',3'-tetramethylspiro[2H-1-benzopyran-2,2'-indoline]; 6-nitro-1',3',3',5'-tetramethylspiro[2H-1-benzopyran-2,2'-indoline]; 6-nitro-1',3',3',6'-tetramethylspiro[2H-1-benzopyran-2,2'-indoline]; 6-nitro-1',3',3',7'-tetramethylspiro[2H-1-benzopyran-2,2'-indoline]; 6-nitro-1',3',3',8-tetramethylspiro[2H-1-benzopyran-2,2'-indoline]; 8-nitro-1',3,3',3'-tetramethylspiro[2H-1-benzopyran-2,2'-indoline]; 8-nitro-1',3',3',6'-tetramethylspiro[2H-1-benzopyran-2,2'-indoline]; 8-nitro-1',3',3',7'- tetramethylspiro[2H-1-benzopyran-2,2'-indoline]; 5-nitro-5',6,8-trichloro-1',3',3'-trimethylspiro[2H-1-benzopyran-2,2'-indoline]; 6-nitro-5,5',7-trichloro-1',3',3'-trimethylspiro[2H-1-benzopyran-2,2'-indoline]; 6-nitro-5,5',8-trichloro-1',3',3'-trimethylspiro[2H-1-benzopyran-2,2'-indoline]; 6-nitro-5,7,7'-trichloro-1',3',3'-trimethylspiro[2H-1-benzopyran-2,2'-indoline]; 6-nitro-5',7,8-trichloro-1',3',3'-trimethylspiro[2H-1-benzopyran-2,2'-indoline]; 7-nitro-5,6,8-trichloro-1',3',3'-trimethylspiro[2H-1-benzopyran-2,2'-indoline]; 5-nitro-4',7',8-trimethoxy-1',3',3'-trimethylspiro[2H-1-benzopyran-2,2'-indoline]; 6-nitro-4',6',8-trimethoxy-1',3',3'-trimethylspiro[2H-1-benzopyran-2,2'-indoline]; 6-nitro-4',7',8-trimethoxy- 1',3',3'-trimethylspiro[2H-1-benzopyran-2,2'-indoline]; 8-nitro-4',6,7'-trimethoxy-1',3',3'-trimethylspiro[2H-1-benzopyran-2,2'-indoline], 5-nitro-1',3',3'-trimethylspiro[2H-1-benzopyran-2,2'-indoline]; 5'-nitro-1',3',3'-trimethylspiro[2H-1-benzopyran-2,2'-indoline]; 6-nitro-1',3',3'-trimethylspiro[2H-1-benzopyran-2,2'-indoline]; 7-nitro-1',3',3'-trimethylspiro[2H-1-benzopyran-2,2'-indoline]; 8-nitro-1',3',3'-trimethylspiro[2H-1-benzopyran-2,2'-indoline]; 6-(β-nitrovinyl)-1',3',3'-trimethylspiro[2H-1-benzopyran-2,2'-indoline]; 6-nitro-1',3',3'trimethyl-4',6',7'-triphenylspiro[2H-1-benzopyran-2,2'-indoline]; 1',3',3',5,7-pentamethylspiro[2H-1-benzopyran-2,2'-indoline]; 1',3',3',6,8-pentomethylspiro[2H-1-benzopyran-2,2'-indoline]; 7'-phenyl-1',3',3'-trimethylspiro[2H-1-benzopyran-2,2'-indoline]; 6-phenylazo-1',3',3'-trimethylspiro[2H-1-benzopyran-2,2'-indoline]; 1',3,3',3'-tetramethylspiro[2H-1-benzopyran-2,2'-indoline]; 1',3',3',5'-tetramethylspiro[2H-1-benzopyran-2,2'-indoline]; 1',3',3',6-tetramethylspiro[2H-1-benzopyran-2,2'-indoline]; 1',3',3',7-tetramethylspiro[2H-1-benzopyran-2,2'-indoline]; 1',3',3',8-tetramethylspiro[2H-1-benzopyran-2,2'-indoline]; 5,6,8-trichloro-1',3',3'-trimethylspiro[2H-1-benzopyran-2,2'-indoline]; 4',6',8-trimethoxy-1',3',3'-trimethylspiro[2H-1-benzopyran-2,2'-indoline]; 4',7',8-trimethoxy-1',3',3'-trimethylspiro[2H-1-benzopyran-2,2'-indoline]; 5',7',8-trimethoxy-1',3',3'-trimethylspiro[2H-1-benzopyran-2,2'-indoline], 1',3',3'-trimethylspiro[2H-1-benzopyran-2,2'-indoline]; 1',3',3'-trimethyl-5',6,8-trinitrospiro[2H-1-benzopyran-2,2'-indoline]; 1',3',3'-trimethyl-4',6',7'-triphenylspiro[2H-1-benzopyran-2,2'-indoline]; spiro[2H-1-benzopyran-2,2'-[1H]-benzo[g]indoline]; 8-methoxy-6-nitro-1',3',3'-trimethylspiro[2H-1-benzopyran-2,2'-[1H]-benzo[g]indoline]; 6-nitro-1',3',3'-trimethylspiro[2H-1-benzopyran-2,2'-[1H]-benzo[g]indoline]; spiro[2H-benzopyran-2,2,-[1H]-benzo[e]indoline]; 6-nitro-1'3',3'-trimethylspiro[2H-benzopyran-2,2,-[1H]-benzo[e]indoline]; spiro[indoline-2,3'-[3H]-naphtho[2,1-b]pyran]; 8'-bromo-1,3,3-trimethylspiro[indoline-2,3'-[3H]-naphtho[2,1-b]pyran]; 1-butyl-3,3-dimethylspiro[indoline2,3'-[3H]-naphtho(2,1-b]pyran]; 1-butyl-3,3-dimethyl-8-nitrospiro[indoline-2,3'-[3H]-naphtho[2,1-b]pyran]; 5'-carboxy-5-chloro-1,3,3-trimethylspiro[indoline-2,3'-[3H]-naphtho[2,1-b]pyran]; 5'-carboxy-1,3,3-trimethylspiro[indoline-2,3'-[3H]-naphtho[2,1-b]pyran]; 5-chloro-1,3,3-trimethylspiro[indoline-2,3'-[3H]-naphtho[2,1-b]pyran]; 5-chloro-8'-nitro-1,3,3-trimethylspiro[indoline-2,3'-[3H]-naphtho[2,1-b]pyran]; 4,7-dimethoxy-1,3,3-trimethylspiro[indoline-2,3'-[3H]-naphtho[2,1-b]pyran]; 1,3-dimethyl-3-ethylspiro[indoline-2,3'-[3H]-naphtho[2,1-b]pyran]; 3,3-dimethyl-1-ethylspiro[indoline2,3'-[3H]-naphtho[2,1-b]pyran]; 3,3-dimethyl-1-ethyl-8'-nitrospiro[indoline-2,3'-[3H]-naphtho[2,1-b]pyran]; 3,3-dimethyl-1-propylspiro[indoline-2,3'-[3H]-naphtho[2,1-b]pyran]; 3,3-dimethyl-1-propyl-8'-nitrospiro[indoline-2,3'-[3H]-naphtho[2,1-b]pyran]; 9'-hydroxy-1,3,3-trimethylspiro[indoline-2,3'-[3H]-naphtho[2,1-b]pyran]; 5-(β-hydroxyethyl)-1,3,3-trimethylspiro[indoline-2,3'-[3H]-naphtho[2,1-b]pyran]; 5-methoxy-8'-nitro-1,3,3-trimethylspiro[indoline-2,3'-[3H]-naphtho[2,1-b]pyran]; 5'-methoxy-8'-nitro-1,3,3-trimethylspirolindoline-2,3'-[3H]-naphtho2,1-b]pyran]; 5'-methoxy-10'-nitro-1,3,3-trimethylspiro[indoline-2,3'-[3H]-naphtho[2,1-b]pyran]; 5-methoxy-1,3,3-trimethylspiro[indoline-2,3'-[3H]-naphtho[2,1-b]pyran]; 5'-methoxy-1,3,3-trimethylspiro[indoline-2,3'-[3]-naphtho[2,1-b]pyran]; 7-nitro-1,3,3-trimethylspiro[indoline-2,3'-[3H]-naphtho[2,1-b]pyran]; 8'-nitro-1,3,3-trimethylspiro[indoline-2,3'-[3H]-naphtho[2,1-b]pyran]; 10'-nitro-1,3,3-trimethylspiro[indoline-2,3'-[3H]-naphtho[2,1-b]pyran]; 1,3,3,4,7-pentamethylspiro[indoline-2,3'-[3H]-naphtho[2,1-b]pyran]; 1,3,3,5,7-pentamethylspiro[indoline-2,3'-[3H]-naphtho[2,1-b]pyran]; 5-phenyl-1,3,3-trimethylspiro[indoline-2,3'-[3H]-naphtho[2,1-b]pyran]; 7-phenyl-1,3,3-trimethylspiro[indoline-2,3'-[3H]-naphtho[2,1-b]pyran]; 1,2',3,3-tetramethylspiro[indoline-2,3'-[3H]-naphtho[2,1-b]pyran]; 1,3,3,5-tetramethylspiro[indoline-2,3'-[3H]-naphtho[2,1-b]pyran]; 1,3,3,7-tetramethylspiro[indoline-2,3'-[3H]-naphtho[2,1-b]pyran]; 1,3,3,-trimethylspiro[indoline-2,3'-3H]-naphtho[2,1-b]pyran]; spiro[indoline-2,2-[2H]-phenanthro[2,1-b]pyran]; 1,3,3,-trimethylspiro[indoline-2,2'-[2H]-phenanthro[2,1-b]pyran]; spiro[3H-anthra[2,1-b]pyran-3,2'-indoline]; 1',3',3'-trimethylspiro[3H-anthra[2,1-b]pyran-3,2'-indoline]; spiro[indoline-2,3'-(3H]-phenanthro[3,4-b]pyran]; 1,3,3-trimethylspiro[indoline-2,3'-(3H]-phenanthro[3,4-b]pyran]; spiro[indoline-2,2'-[2H]-naphtho[1,2-b]pyran]; 6'-chloro-1,3,3-trimethylspiro[indoline-2,2'-[2H]-naphtho[1,2-b]pyran]; 6'-nitro-1,3,3-trimethylspiro[indoline-2,2'-[2H]-naphtho[1,2-b]pyran]; 1,3,3-trimethylspiro[indoline-2,2'-[2H]-naphtho[1,2-b]pyran]; spiro (indoline-2,2'-[2H]-naphtho[2,3-b]pyran]; 10'-nitro-1,3,3-trimethylspiro[indoline-2,2'-[2H]-naphtho[2,3-b]pyran]; 1,3,3-trimethylspiro[indoline-2,2'-[2H]-naphtho[2,3-b]pyran]; spiro[2H-1-benzopyran-2,2'-benzothiazoline]; 6-acetamido-3,3'-dimethyl-6-nitrospiro[2H-1-benzopyran-2,2'-benzothiazoline]; 6'-amino- 3,3'-dimethyl-6-nitrospiro[2H-1-benzopyran-2,2'-benzothiazoline]; 6-bromo3,3'-dimethylspiro[2H-1-benzopyran-2,2'-benzothiazoline]; 6-bromo-3,3'-dimethyl-6'-methoxyspiro[2H-1-benzopyran-2,2'-benzothiazoline]; 6'-bromo-3,3'-dimethyl-8-methoxy-6-nitrospiro 2H-1-benzopyran-2,2'-benzothiazoline]; 6-bromo-3,3'-dimethyl-6'-methylthiospiro[2H-1-benzopyran-2,2'-benzothiazoline]; 6-bromo-3,3'-dimethyl-6'-nitrospiro[2H-1-benzopyran-2,2'-benzothiazoline]; 8-bromo-3,3'-dimethyl-6-nitrospiro[2H-1-benzopyran-2,2'-benzothiazoline]; 6-bromo-3'-methylspiro[2H-1-benzopyran-2,2'-benzothiazoline]; 3'-butyl-6-nitro-3-phenylspiro[2H-1-benzopyran-2,2'-benzothiazoline]; 8-carbethoxy-3,3'-1-dimethylspiro[2H-1-benzopyran-2,2'-benzothiazoline]; 8-carbethoxy-3,3'-dimethyl-6-nitrospiro[2H-1-benzopyran-2,2'-benzothiazoline]; 8-carboxy-3,3'-dimethylspiro[2H-1-benzopyran-2,2'-benzothiazoline]; 6'-carboxy-3,3'-dimethyl-8methoxy-6-nitrospiro[2H-1-benzopyran-2,2'-benzothiazoline]; 8-carboxy-3,3'-dimethyl-6-nitrospiro[2H-1-benzopyran-2,2'-benzothiazoline]; 6'-chloro-3,3'-dimethyl-8-methoxy-6-nitrospiro[2H-1-benzopyran-2,2'-benzothiazoline]; 6-chloro-3,3'-dimethyl-8-nitrospiro[2H-1-benzopyran-2,2'-benzothiazoline]; 3-(p-chlorophenyl)-8-methoxy-3'-methyl-6-nitrospiro[2H-1-benzopyran-2,2'-benzothiazoline]; 6'-cyano-3,3'-dimethyl-8-methoxy-6-nitrospiro[2H-1-benzopyran-2,2'-benzothiazoline]; 6,6'-dibromo-3,3'-dimethylspiro[2H-1-benzopyran-2,2'-benzothiazoline]; 6',8-dimethoxy-3,3'- dimethylspiro[2H-1-benzopyran-2,2'-benzothiazoline]; 6',8-dimethoxy-3,3'-dimethyl-6,7'-dinitrospiro[2H-1-benzopyran-2,2'-benzothiazoline]; 6',8-dimethoxy-3,3'-dimethyl-6-nitrospiro[2H-1-benzopyran-2,2'-benzothiazoline]; 6',8-dimethoxy-3'-ethyl-3-methyl-6-nitrospiro[2H-1-benzopyran-2,2'-benzothiazoline]; 3,3'-dimethylspiro[2H-1-benzopyran-2,2'-benzothiazoline]; 3,3'-dimethyl-6,6'-dinitrospiro[2H-1-benzopyran-2,2'-benzothiazoline]; 3,3'-dimethyl-6,6'-dinitro-8-methoxyspiro[2H-1-benzopyran-2,2'-benzothiazoline]; 3,3'-dimethyl-6'-hydroxy-8-methoxy-6-nitrospiro[2,2'-benzopyran-2,2'-benzothiazoline]; 3,3'-dimethyl-5'-isobutyramido-6-nitrospiro[2H-1-benzopyran-2,2'-benzothiazoline]; 3,3'-dimethyl-5'-methocrylamido-6-nitrospiro[2H-1-benzopyran-2,2'-benzothiazoline]; 3,3'-dimethyl-8-methoxyspiro 2H-1-benzopyran-2,2'-benzothiazoline]; 3,3'-dimethyl-8-methoxy-6'-methylthio-6-nitrospiro[2H-1-benzopyran-2,2'-benzothiazoline]; 3,3'-dimethyl-6'-methoxy-6-nitrospiro[2H-1-benzopyran-2,2'-benzothiazoline]; 3,3'-dimethyl-8-methoxy-5-nitrospiro[2H-1-benzopyran-2,2'-benzothiazoline]; 3,3'-dimethyl-8-methoxy-6-nitrospiro[2H-1-benzopyran-2,2'-benzothiazoline]; 3,3'-dimethyl-6'-methylthio-6-nitrospiro[2H-1-benzopyran-2,2'-benzothiazoline]; 3,3'-dimethyl-6-nitrospiro[2H-1-benzopyran-2,2'-benzothiazoline]; 3,3'-dimethyl-8-nitrospiro[2H-1-benzopyran-2,2'-benzothiazoline]; 3'-ethyl-8-methoxy-3-methylspiro[2H-1-benzopyran-2,2'-benzothiazoline]; 3-ethyl-8-methoxy-3'-methyl-6-nitrospiro[2H-1-benzopyran-2,2'-benzothiazoline]; 3'-ethyl-6'-methoxy-3-methyl-6-nitrospiro[2H-1-benzopyran-2,2'-benzothiazoline]; 3'-ethyl-8-methoxy-3-methyl-6-nitrospiro[2H-1-benzopyran-2,2'-benzothiazoline]; 3-ethyl-3'-methyl-6-nitrospiro[2H-1-benzopyran-2,2'-benzothiazoline]; 3'-ethyl-3-methyl-6-nitrospiro[2H-1-benzopyran-2,2'-benzothiazoline]; 3'-ethyl-8-methoxy-6-nitro-3-phenylspiro[2H-1-benzopyran-2,2'-benzothiazoline]; 3'-ethyl-6-nitrospiro[2H-1-benzopyran-2,2'-benzothiazoline]; 3'-ethyl-6-nitro-3-phenylspiro[2H-1-benzopyran-2,2'-benzothiazoline]; 3-isopropyl-8-methoxy-3'-methyl-6-nitrospiro[2H-1-benzopyran-2,2'-benzothiazoline]; 3'-isopropyl-8-methoxy-3methyl-6-nitrospiro[2H-1-benzopyran-2,2'-benzothiazoline]; 7-methoxy-3'-methylspiro[2H-1-benzopyran-2,2'-benzothiazoline]; 8-methoxy-3'-methyl-6-nitro-3-phenylspiro[2H-1-benzopyran-2,2'-benzothiazoline]; 8-methoxy-3'-methyl-6-nitro-3-propylspiro[2H-1-benzopyran-2,2'-benzothiazoline]; 3'-methylspiro[2H-1-benzopyran-2,2'-benzothiazoline], 3'-methyl-6-nitrospiro[2H-1-benzopyran-2,2'-benzothiazoline]; 3'-methyl-6-nitro-3-phenylspiro[2H-1-benzopyran-2,2'-benzothiazoline]; 3'-methyl-6-nitro-3-propylspiro[2H-1-benzopyran-2,2'-benzothiazoline]; 6-nitro-3-phenyl-3'-propylspiro[2H-1-benzopyran-2,2'-benzothiazoline]; spiro[benzothiazoline-2,3,'-[3H]-naphtho[2,1-b]pyran]; 2',3-dimethylspiro[benzothiazoline-2,3,'-[3H]-naphtho[2,1-b]pyran]; 2',3-dimethyl-6-methoxyspiro[benzothiazoline-2,3,'-[3H]-naphtho[2,1-b]pyran]; 3-ethylspiro[benzothiazoline-2,3,'-[3H]-naphtho[2,1-b]pyran]; 3-ethyl-2'-methylspiro[benzothiazoline-2,3,'-[3H]-naphtho[2,1-b]pyran]; 3-methylspiro[benzothiazoline-2,3,'-[3H)-naphtho[2,1-b]pyran]; spiro[2H-1-benzopyran-2,2'-benzoxazoline]; 8-bromo-3'-methyl-6-nitrospiro[2H-1-benzopyran-2,2'-benzoxazoline]; 5'-chloro-3,3'-dimethyl-6-nitrospiro[2H-1-benzopyran-2,2'-benzoxazoline]; 6-chloro-3,3'-dimethyl-8-nitrospiro[2H-1-benzopyran-2,2'-benzoxazoline]; 3,3'-dimethyl-6-methoxy-8-nitrospiro[2H-1-benzopyran-2,2'-benzoxazoline]; 3,3'-dimethyl-8-methoxy-6-nitrospiro[2H-1-benzopyran-2,2'-benzoxazoline]; 3,3'-dimethyl-8-methoxy-6-nitro-5'-phenylspiro[2H-1-benzopyran-2,2'-benzoxazoline]; 3,3'-dimethyl-6-nitrospiro[2H-1-benzopyran-2,2'-benzoxazoline]; 3,3'-dimethyl-8-nitrospiro[2H-1-benzopyran-2,2'-benzoxazoline]; 3,3'-dimethyl-6-nitro-5'-phenylspiro[2H-1-benzopyran-2,2'-benzoxazoline]; 3-ethyl-3'-methyl-6-nitrospiro[2H-1-benzopyran-2,2'-benzoxazoline]; 8-methoxy-6-nitro-3,3',5',7'-tetramethylspiro[2H-1-benzopyran-2,2'-benzoxazoline]; 8-methoxy-6-nitro-3,3',5'-trimethylspiro[2H-1-benzopyran-2,2'-benzoxazoline]; 6-nitro-3,3',5'-trimethylspiro[2H-1-benzopyran-2,2'-benzoxazoline]; 8-nitro-3,3',5'-trimethylspiro[2H-1-benzopyran-2,2'-benzoxazoline]; spiro[2H-1-benzopyran-2,2'-naphth[2,3-dioxazoline]; 3,3'-dimethyl-8-methoxy-6-nitrospiro[2H-1-benzopyran-2,2'-naphth[2,3-d]oxazoline]; 3,3'-dimethyl-6-nitrospiro[2H-1-benzopyran-2,2'-naphth[2,3-d]oxazoline]; spiro[2H-1-benzopyran-2,2'-naphth[2,1-d]oxazoline]; 3,3'-dimethyl-8-methoxy-6-nitrospiro[2H-1-benzopyran-2,2'-naphth[2,1-dioxazoline]; 2,2'-spirobi[2H-1-benzopyran]; 3-amyl-2,2'-spirobi[2H-1-benzopyran]; 3-amyl-6'-bromo-2,2'-spirobi[2H-1-benzopyran]; 3-amyl-6-bromo-6'-methyl-2,2'-spirobi[2H-1-benzopyran]; 3-amyl-6'-bromo-6-methyl-2,2'-spirobi[2H-1-benzopyran]; 3-amyl-6,6'-dibromo-2,2'-spirobi[2H-1-benzopyran]; 3-amyl-6,6'-dimethyl-2,2'-spirobi[2H-1-benzopyran]; 3-amyl-6-methyl-2,2'-spirobi[2H-1-benzopyran]; 5bromo-8,8'-dimethoxy-6-nitro-3'-phenyl-2,2'-spirobi[2H-1-benzopyran]; 6-bromo-6'-nitro-3-phenyl-2,2'-spirobi[2H-1-benzopyran]; 6-bromo-3'-phenyl-2,2'-spirobi[2H-1-benzopyran]; 3-benzyl-2,2'-spirobi[2H-1-benzopyran]; 3-butyl-2,2'-spirobi[2H-1-benzopyran]; 6-chloro-6'-nitro-3-phenyl-2,2'-spirobi[2H-1-benzopyran]; 8-chloro-6-nitro-3'-phenyl-2,2'-spirobi[2H-1-benzopyran]; 6,6'-dibromo-3,3'-dimethylene-2,2'-spirobi[2H-1-benzopyran]; 8,8'-dimethoxy- 6'-nitro-3-phenyl-2,2'-spirobi[2H-1-benzopyran]; 3,3'-dimethyl-2,2'-spirobi[2H-1-benzopyran]; 6,6-dimethyl-3',3'-dimethylene-2,2'-spirobi[2H-1-benzopyran]; 3,3'-dimethylene-2,2'-spirobi[2H-1-benzopyran]; 6,6'-dinitro-3,3'-diphenyl-2,2'-spirobi[2H-1-benzopyran]; 3,3'-diphenyl-2,2'-spirobi[2H-1-benzopyran]; 3-ethyl-2,2'-spirobi[2H-1-benzopyran], 8-fluoro-6-nitro-3'-phenyl-2,2'-spirobi[2H-1-benzopyran]; 8-iodo-6-nitro-3'-phenyl-2,2'-spirobi[2H-1-benzopyran]; 8'-methoxy-3-methyl-6-nitro-2,2'-spirobi[2H-1-benzopyran]; 8-methoxy-6-nitro-3'-phenyl-2,2'-spirobi[2H-1-benzopyran]; 8-methoxy-6'-nitro-3-phenyl-2,2'-spirobi[2H-1-benzopyran]; 8-methoxy-8'-nitro-3-phenyl-2,2'-spirobi[2H-1-benzopyran]; 8'-methoxy-6-nitro-3-phenyl-2,2'-spirobi[2H-1-benzopyran]; 3-methyl-2,2'-spirobi[2H-1-benzopyran]; 3-methyl-6-nitro-2,2'-spirobi[2H-1-benzopyran]; 6-nitro-3'-phenyl-2,2'-spirobi[2H-1-benzopyran]; 3-phenyl-2,2'-spirobi[2H-1-benzopyran]; 3,3'-tetromethylene-2,2'-spirobi[2H-1-benzopyran]; 3,3'-trimethylene-2,2'-spirobi[2H-1-benzopyran]; 3,3'-spirobi[3H-naphtho[2,1-b]pyran]; 2-amyl-3,3'-spirobi[3H-naphtho[2,1-b]pyran]; 2-benzyl-3,3'-spirobi[3H-naphtho[2,1-b]pyran]; 2-butyl-3,3'-spirobi[3H-naphtho[2,1-b]pyran]; 2-chloro-3,3'-spirobi[3H-naphtho[2,1-b]pyran]; 2-chloro-8,8'-dinitro-3,3'-spirobi[3H-naphtho2,1-b]pyran]; 2-decyl-3,3'-spirobi[3H-naphtho[2,1-b]pyran]; 8,8'-dibromo-3,3'-spirobi[3H-naphtho[2,1-b]pyran]; 2,2'-dicarboethoxy-3,3'-spirobi[3H-naphtho[2,1-b]pyran]; 2,2'-dicarbomethoxy-3,3'-spirobi[3H-naphtho[2,1-b]pyran]; 2,2'-diethyl-3,3'-spirobi[3H-naphtho[2,1-b]pyran]; 5,5'-dimethoxy-3,3'-spirobi[3H-naphtho[2,1-b]pyran], 5,5'-dimethoxy-8,8'-dinitro-3,3'-spirobi[3H-naphtho[2,1-b]pyran]; 5,5'-dimethoxy-10,10'-dinitro-3,3'-spirobi[3H-naphtho[2,1-b]

pyran], 9,9'-dimethoxy-8,8'-dinitro-3,3'-spirobi[3H-naphtho[2,1-b]pyran]; 2,2'-dimethyl-3,3'-spirobi[3H-naphtho[2,1-b]pyran]; 2,2'-dimethyl-8,8'-dinitro-3,3'-spirobi[3H-naphtho[2,1-b]pyran]; 5,5'-dimethyl-10,10'-dinitro-3,3'-spirobi[3H-naphtho[2,1-b]pyran]; 9,9'-dimethyl-8,8'-dinitro-3,3'-spirobi[3H-naphtho[2,1-b]pyran]; 9,9-dimethyl-7,7'-dinitro-3,3'-spirobi[3H-naphtho[2,1-b]pyran]; 2-(γ,γ-dimethylallyl)-3,3'-spirobi[3H-naphtho[2,1-b]pyran]; 2,2'-dimethylene-3,3'-spirobi[3H-naphtho[2,1-b]pyran]; 7,7'-dinitro-3,3'-spirobi[3H-naphtho[2,1-b]pyran]; 8,8'-dinitro-3,3'-spirobi[3H-naphtho[2,1-b]pyran]; 9,9'-dinitro-3,3'-spirobi[3H-naphtho[2,1-b]pyran]; 10,10'-dinitro-3,3'-spirobi[3H-naphtho[2,1-b]pyran]; 8,8'-dinitro-2-methyl-3,3'-spirobi[3H-naphtho[2,1-b]pyran]; 8,8'-dinitro-2,2'-1(2"-methyl)trimethylene-3,3'-spirobi[3H-naphtho[2,1-b]pyran]; 8,8'-dinitro-2-phenyl-3,3'-spirobi[3H-naphtho[2,1-b]pyran]; 8,8'-dinitro-2,2'-trimethylene-3,3'-spirobi[3H-naphtho[2,1-b]pyran]; 2,2'-diphenyl-3,3'-spirobi[3H-naphtho[2,1-b]pyran]; 2-ethyl-3,3'-spirobi[3H-naphtho[2,1-b]pyran]; 2-heptyl-3,3'-spirobi[3H-naphtho[2,1-b]pyran]; 2-hexyl-3,3'-spirobi[3H-naphtho[2,1-b]pyran]; 2-isobutyl-3,3'-spirobi[3H-naphtho[2,1-b]pyran]; 2-isopropyl-3,3'-spirobi[3H-naphtho[2,1-b]pyran]; 2-methyl-3,3'-spirobi[3H-naphtho[2,1-b]pyran]; 2,2'-(2"-methyl)trimethylene-3,3'-spirobi[3H-naphtho[2,1-b]pyran]; 8'-nitro-2-phenyl-3,3'-spirobi[3H-naphtho[2,1-b]pyran]; 2-octyl-3,3'-spirobi[3H-naphtho[2,1-b]pyran]; 2-phenyl-3,3'-spirobi[3H-naphtho[2,1-b]pyran]; 2-(β-phenylethyl)-3,3'-spirobi[3H-naphtho[2,1-b]pyran]; 2-propyl-3,3'-spirobi[3H-naphtho[2,1-b]pyran]; 2,2'-tetramethylene-3,3'-spirobi[3H-naphtho[2,1-b]pyran]; 2,2'-trimethylene- 3,3'-spirobi[3H-naphtho[2,1-b]pyran]; 2,2'-spirobi[2H-naphtho[1,2-b]pyran]; 3-amyl-2,2'-spirobi[2H-naphtho[1,2-b]pyran]; 6,6'-dichloro-2,2'-spirobi[2H-naphtho[1,2-b]pyran]; 7,7'-dinitro-2,2'-spirobi[2H-naphtho[1,2-b]pyran]; 8,8'-dinitro-2,2'-spirobi[2H-naphtho[1,2-b]pyran]; 9,9'-dinitro-2,2'-spirobi[2H-naphtho[1,2-b]pyran]; 10,10'-dinitro-2,2'-spirobi[2H-naphtho[1,2-b]pyran]; 3-phenyl-2,2'-spirobi[2H-naphtho[1,2-b]pyran]; 2,2'-spirobi[2H-naphtho[2,3-b]pyran]; spiro[2H-1-benzopyran-2,3'-[3H]-naphtho[2,1-b]pyran]; 2'-amylspiro[2H-1-benzopyran-2,3'-[3H]-naphtho[2,1-b]pyran]; 3-amylspiro[2H-1-benzopyran-2,3'-[3H]-naphtho[2,1-b]pyran]; 3-amyl-6-bromospiro[2H-1-benzopyran-2,3'-[3H 1-naphtho[2,1-b]pyran]; 3-amyl-7-chlorospiro[2H-1-benzopyran-2,3'-[3H]-naphtho[2,1-b]pyran]; 3-amyl-6-hydroxyspiro[2H-1-benzopyran-2,3'-[3H]-naphtho[2,1-b]pyran], 3-amyl-6-methoxyspiro[2H-1-benzopyran-2,3'-[3H]-naphtho[2,1-b]pyran]; 3-amyl-7-methoxyspiro[2H-1-benzopyran-2,3'-[3H]-naphtho[2,1-b]pyran]; 3-amyl-6-methylspiro[2H-1-benzopyran-2,3'-[3H]-naphtho[2,1-b]pyran]; 3-amyl-7-methylspiro[2H-1-benzopyran-2,3'-[3H]-naphtho[2,1-b]pyran]; 3-amyl-6-nitrospiro[2H-1-benzopyran-2,3'-[3H]-naphtho[2,1-b]pyran]; 2'-benzylspiro[2H-1-benzopyran-2,3'-[3H]-naphtho[2,1-b]pyran]; 3-benzylspiro[2H-1-benzopyran-2,3'-[3H]-naphtho[2,1-b]pyran]; 6-bromospiro[2H-1-benzopyran-2,3'-[3H]-naphtho[2,1-b]pyran]; 6-bromo-8-methoxy-3-methyl-8'-nitrospiro[2H-1-benzopyran-2,3'-[3H]-naphtho[2,1-b]pyran]; 8'-bromo-8-methoxy-3-phenylspiro[2H-1-benzopyran-2,3'-[3H]-naphtho[2,1-b]pyran]; 6-bromo-3-methyl-8'-nitrospiro[2H-1-benzopyran-2,3'-[3H]-naphtho[2,1-b]pyran]; 6-bromo-8'-nitro-3-phenylspiro[2H-1-benzopyran-2,3'-[3H]-naphtho[2,1-b]pyran]; 8'-bromo-3-phenylspiro[2H-1-benzopyran-2,3'-[3H]-naphtho[2,1-b]pyran], 6-chloro-8-methoxy-3-methyl-8'-nitrospiro[2H-1-benzopyran-2,3'-[3H]-naphtho[2,1-b]pyran]; 6-chloro-3-methylspiro[2H-1-benzopyran-2,3'-[3H]-naphtho[2,1-b]pyran]; 6-chloro-3-methyl-8'-nitrospiro[2H-1-benzopyran-2,3'-[3H]-naphtho[2,1-b]pyran]; 8-chloro-3-methyl-8'-nitrospiro[2H-1-benzopyran-2,3'-[3H]-naphtho[2,1-b]pyran]; 6-chloro-8'-nitro-3-phenylspiro[2H-1-benzopyran-2,3'-[3H]-naphtho[2,1-b]pyran]; 7-diethylamino-3-methyl-8'-nitrospiro[2H-1-benzopyran-2,3'-[3H]-naphtho[2,1-b]pyran]; 5,7-dimethoxy-8'-nitro-3-phenylspiro[2H-1-benzopyran-2,3'-[3H]-naphtho[2,1-b]pyran]; 2',3-dimethylspiro[2H-1-benzopyran-2,3'-[3H]-naphtho[2,1-b]pyran]; 2',3'-dimethylenespiro[2H-1-benzopyran-2,3'-[3H]-naphtho[2,1-b]pyran]; 6-fluoro-3-methyl-8'-nitrospiro[2H-1-benzopyran-2,3'-[3H]-naphtho[2,1-b]pyran]; 2-isopropylspiro[2H-1-benzopyran-2,3'-[3H]-naphtho[2,1-b]pyran]; 3-isopropylspiro[2H-1-benzopyran-2,3'-[3H]-naphtho[2,1-b]pyran]; 8-methoxy-2'-methylspiro[2H-1-benzopyran-2,3'-[3H]-naphtho[2,1-b]pyran]; 8-methoxy-2'-methyl-8'-nitrospiro[2H-1-benzopyran-2,3'-[3H]-naphtho[2,1-b]pyran]; 8-methoxy-3-methyl-6-nitrospiro[2H-1-benzopyran-2,3'-[3H]-naphtho[2,1-b]pyran]; 8-methoxy-3-methyl-8'-nitrospiro[2H-1-benzopyran-2,3'-[3H]-naphtho[2,1-b]pyran]; 7-methoxy-2'-methyl-4-phenylspiro[2H-1-benzopyran-2,3'-13H]-naphtho[2,1-b]pyran]; 7-methoxy-3-methyl-4-phenylspiro[2H-1-benzopyran-2,3'-[3H]-naphtho[2,1-b]pyran]; 8-methoxy-8'-nitro-3-phenylspiro[2H-1-benzopyran-2,3'-[3H]-naphtho[2,1-b]pyran]; 2'-methylspiro[2H-1-benzopyran-2,3'-[3H]-naphtho[2,1-b]pyran]; 3-methylspiro[2H-1-benzopyran-2,3'-(3H]-naphtho[2,1-b]pyran]; 6-methylspiro[2H-1-benzopyran-2,3'-[3H]-naphtho[2,1-b]pyran]; 3-methyl-6-nitrospiro[2H-1-benzopyran-2,3'-[3H]-naphtho[2,1-b]pyran]; 2'-methyl-4-phenylspiro[2H-1-benzopyran-2,3'-[3H]-naphtho[2,1-b]pyran]; 8'-nitro-3-(o-nitrophenyl)spiro[2H-1-benzopyran-2,3'-[3H]-naphtho[2,1-b]pyran]; 8'-nitro-3-phenylspiro[2H-1-benzopyran-2,3'-[3H]-naphtho[2,1-b]pyran]; 2'-octylspiro[2H-1-benzopyran-2,3'-[3H]-naphtho[2,1-b]pyran]; 2'-phenylspiro[2H-1-benzopyran-2,3'-[3H]-naphtho[2,1-b]pyran]; 3-phenylspiro[2H-1-benzopyran-2,3'-[3H]-naphtho[2,1-b]pyran]; 2'-(β-phenylethyl)spiro[2H-1-benzopyran-2,3'-[3H]-naphtho[2,1-b]pyran]; 3-(β-phenylethyl)spiro[2H-1-benzopyran-2,3'-[3H]-naphtho[2,1-b]pyran]; 2',3-trimethylenespiro[2H-1-benzopyran-2,3'-[3H]-naphtho[2,1-b]pyran]; spiro[2H-1-benzopyran-2,2'-[2H]-naphtho 1,2-b]pyran]; 3-amylspiro[2H-1-benzopyran-2,2'-[2H]-naphtho[1,2-b]pyran]; 3'-amylspiro[2H-1-benzopyran-2,2'-[2H]-naphtho[1,2-b]pyran]; 3-amyl-6-bromospiro[2H-1-benzopyran-2,2'-[2H]-naphtho[1,2-b]pyran]; 3-amyl-6-methoxyspiro[2H-1-benzopyran-2,2'-[2H]-naphtho[1,2-b]pyran]; 3-amyl-6-methylspiro[2H-1-benaphtho[2,2'-[2H]-naphtho[1,2-b]pyran]; 3-amyl-6-nitrospiro[2H-1-benzopyran-2,2'-[2H]-naphtho[1,2-b]pyran]; 6'-chloro-8-methoxy-3-phenylspiro[2H-1-benzopyran-2,2'-[2H]-naphtho[1,2-b]pyran]; 3'-methyl-4'-phenylspiro[2H-1-benzopyran-2,2'-[2H3-naphtho[1,2-b]pyran]; 3-phenylspiro[2H-1-benzopyran-2,2'-[2H]-naphtho[1,2-b]pyran]; 3'-phenylspiro[2H-1-benzopyran-2,2'-[2H]-naphtho[1,2-b]pyran]; spiro[3H-anthraceno[2,1-b]pyran-3,2'-[2H]-1-benzopyran]; spiro[2H-1-benzopyran-2,2'-[2'H]phenanthreno[2,1-b]pyran]; spiro[3H-anthraceno[2,1-b]pyran-3,3'-[3H]naphtho[2,1-b]pyran]; spiro[3H-naphtho[2,1-b]pyran-3,2'-[2'H]phenanthreno[2,1-b]pyran]; 2,2'-spirobi[2H-phenanthreno[2,1-b]pyran]; spiro[4H-1-benzopyran-4,3'-[3H]naphtho[2,1-b]pyran]; 2,3-diphenyl-7-methoxyspiro[4H-1-benzopyran-4,3'-[3H]naphtho[2,1-b]pyran]; 2,3-diphenyl-7-methoxy-8'-nitrospiro[4H-1-benzopyran-4,3'-[3H]naphtho[2,1-b]pyran]; 2,3-diphenyl-8'-nitrospiro[4H-1-benzopyran-4,3'-[3H]naphtho[2,1-b]pyran]; 7-methoxy-3-methyl-8'-nitro-2-phenylspiro[4H-1-benzopyran-4,3'-[3H]naphtho[2,1-b]pyran]; 6-methoxy-3-methyl-2-phenylspiro

[4H-1-benzopyran-4,3'-[3H]naphtho[2,1-b]pyran]; 7-methoxy-3-methyl-2-phenylspiro[4H-1-benzopyran-4,3'-[3H]naphtho[2,1-b]pyran]; 3-(p-methoxyphenyl)-8'-nitro-2-phenylspiro[4H-1-benzopyran-4,3'-[3H]naphtho[2,1-b]pyran]; 3-methyl-2-phenylspiro[4H-1-benzopyran-4,3'-[3H]naphtho[2,1-b]pyran]; spiro[2H-naphtho[1,2-b]pyran-2,3'-[3H]-naphtho[2,1-b]pyran]; 2'-amylspiro[2H-naphtho[1,2-b]pyran-2,3'-[3H]-naphtho[2,1-b]pyran]; 3-amylspiro[2H-naphtho[1,2-b]pyran-2,3'-[3H]-naphtho[2,1-b]pyran]; 2',3-dimethyl-4-phenylspiro[2H-naphtho[1,2-b]pyran-2,3'-[3H]-naphtho[2,1-b]pyran]; 2'-3-dimethylenespiro[2H-naphtho[1,2-b]pyran-2,3'-[3H]-naphtho[2,1-b]pyran]; 2'-methyl-4-phenylspiro[2H-naphtho[1,2-b]pyran-2,3'-[3H]-naphtho[2,1-b]pyran]; 3-methyl-4-phenylspiro[2H-naphtho[1,2-b]pyran-2,3'-[3H]-naphtho[2,1-b]pyran]; 2'-phenylspiro[2H-naphtho[1,2-b]pyran-2,3'-[3H]-naphtho[2,1-b]pyran]; 3-phenylspiro[2H-naphtho[1,2-b]pyran-2,3'-[3H]-naphtho[2,1-b]pyran]; 4-phenylspiro[2H-naphtho 1,2-b]pyran-2,3'-[3H]-naphtho[2,1-b]pyran]; 2',3-trimethylenespiro[2H-naphtho[1,2-b]pyran-2,3'-[3H]-naphtho[2,1-b]pyran]; spiro[4H-napththo[1,2-b]pyran- 4,3'-[3H]naphtho[2,1-b]pyran]; 3-methyl-8'-nitro-2-phenylspiro[4H-napththo[1,2-b]pyran-4,3'-[3H]naphtho[2,1-b]pyran]; spiro[2H-1-benzopyran-2,9'-xanthene]; 6,8-dinitrospiro[2H-1-benzopyran-2,9'-xanthene]; 3'-hydroxy-6-nitrospiro[2H-1-benzopyran-2,9'-xanthene]; 6-nitrospiro[2H-1-benzopyran-2,9'-xanthene]; 8-nitrospiro[2H-1-benzopyran-2,9'-xanthene]; spiro[3H-naphtho[2,1-b]pyran-3,9'-xanthene]; 2-methylspiro[3H-naphtho[2,1-b]pyran-3,9'-xanthene]; 8-nitrospiro[3H-naphtho[2,1-b]pyran-3,9'-xanthene]; spiro[3H-naphtho[2,1-b]pyran-3,2'-[2H]pyran; 4',6'-diphenylspiro[3H-naphtho[2,1-b]pyran-3,2'-[2H]pyran; spiro[indoline-2,2'-pyrano[3,2-H]quinoline]; 6-bromo-1,3,3-trimethylspiro[indoline-2,2'-pyrano[3,2-H]quinoline]; 5-chloro-1,3,3,6'-tetramethylspiro[indoline-2,2'-pyrano[3,2-H]quinoline]; 5-chloro-1,3,3,9'-tetramethylspiro[indoline-2,2'-pyrano[3,2-H]quinoline]; 5-chloro-1,3,3-trimethylspiro[indoline-2,2'-pyrano[3,2-H]quinoline]; 3,3-dimethyl-1-ethylspiro[indoline-2,2'-pyrano[3,2-H]quinoline]; 3,3-dimethyl-1-propylspiro[indoline-2,2'-pyrano[3,2-H]quinoline]; 1-ethyl-3,3,6'-trimethylspiro[indoline-2,2'-pyrano[3,2-H]quinoline]; 5-fluoro-1,3,3,6'-tetramethylspiro[indoline-2,2'-pyrano[3,2-H]quinoline]; 5-fluoro-1,3,3-trimethylspiro[indoline-2,2'-pyrano[3,2-H]quinoline]; 1,3,3,6',7-pentamethylspiro indoline-2,2'-pyrano[3,2-H]quinoline]; 1,3,3,7,9'-pentamethylspiro[indoline-2,2'-pyrano[3,2-H]quinoline]; 1-propyl-3,3,6'-trimethylspiro[indoline-2,2'-pyrano[3,2-H]quinoline]; 1,3,3,7-tetramethylspiro[indoline-2,2'-pyrano[3,2-H]quinoline]; 1,3,3,9'-tetramethylspiro[indoline-2,2'-pyrano[3,2-H]quinoline]; spiro[indoline-2,3'-[3H]-naphtho[2,1-b]-1,4-oxazine]; 5-chloro-1,3,3-trimethylspiro[indoline- 2,3'-[3H]-naphtho[2,1-b]-1,4-oxazine]1,3,3-trimethylspirolindoline-2,3'-[3H]-naphtho[2,1-b]-1,4-oxazine]; spiro[indoline-2,2'-[2H]-pyrano[3,4-b]pyridine], 5'-hydroxymethyl-1,3,3,8'-tetramethylspiro[indoline-2,2'-[2H]-pyrano[3,4-b]pyridine]; spiro[indoline-2,2'-[2H]-pyrano[3,2-b]pyridine]; 5-chloro-1,3,3-trimethylspiro[indoline-2,2'-[2H]-pyrano[3,2-b]pyridine]; spiro[indoline-2,2'-[2H]-pyrano[3,2-c]quinoline]; 1,3,3,5'-tetramethylspiro[indoline-2,2'-[2H]-pyrano[3,2-c]quinoline]; spiro[2H-1,4-benzoxazine-2,2'-indoline]; 1',3',3'-trimethylspiro[2H-1,4-benzoxazine-2,2'-indoline]; spiro[2H-1-benzopyran-2,2'-[2H]quinoline]; 6-bromo-3-isopropyl-1'-methylspiro[2H-1-benzopyran-2,2'-[2H]quinoline]; 6-bromo-1'-methylspiro[2H-1-benzopyran-2,2'-[2H]quinoline]; 3,3'-dimethylene-1'-methylspiro[2H-1-benzopyran-2,2'-[2H]quinoline]; 1'-ethylspiro[2H-1-benzopyran-2,2'-[2H]quinoline]; 1'-ethyl-6-nitrospiro[2H-1-benzopyran-2,2'-[2H]quinoline]; 1'-ethyl-8-nitrospiro[2H-1-benzopyran-2,2'-[2H]quinoline]; 6-methoxy-1'-methylspiro[2H-1-benzopyran-2,2'-[2H]quinoline]; 7-methoxy-1'-methylspiro[2H-1-benzopyran-2,2'-[2H]quinoline]; 1'-methylspiro[2H-1-benzopyran2,2'-(2H]quinoline]; 1'-methyl-6-nitrospiro[2H-1-benzopyran-2,2'-[2H1quinoline]; 1'-methyl-3,3'-trimethylenespiro[2H-1-benzopyran-2,2'-[2H]quinoline]; 6-nitro-1',3,3'-trimethylspiro[2H-1-benzopyran-2,2'-[2H]quinoline]; spiro[3H-naphtho2,1-b]pyran-3,2'-[2H]quinoline]; 2-isopropyl-1'-methylspiro[3H-naphtho[2,1-b]pyran-3,2'-2H]quinoline]: 1'-methylspiro[3H-naphtho[2,1-b]pyran-3,2'-[2H quinoline]; spiro[2H-1-benzopyran-2,2'-[2H]pyridine]; 6-bromo-1'-methylspiro[2H-1-benzopyran-2,2'-[2H]pyridine]; 1',3-dimethyl-6-nitrospiro[2H-1-benzopyran-2,2'-[2H]pyridine]; 6,8-dinitro-1'-methyl-3-phenylspiro[2H-1-benzopyran-2,2'-2H]pyridine]; 1'-ethylspiro[2H-1-benzopyran-2,2'-[2H]pyridine]; 3-ethyl-1'-methyl-6-nitrospiro[2H-1-benzopyran-2,2'-[2H]pyridine]; 1'-ethyl-6-nitrospiro[2H-1-benzopyran-2,2'-[2H]pyridine]; 1'-ethyl-8-nitrospiro[2H-1-benzopyran-2,2'-[2H]pyridine]; 7-methoxy-1'-methylspiro[2H-1-benzopyran-2,2'-[2H]pyridine]; 1'-methylspiro[2H-1-benzopyran-2,2'-[2H]pyridine]; 1'-methyl-6-nitrospiro[2H-1-benzopyran-2,2'-2H]pyridine]; spiro[3H-naphtho[2H]pyran-3,2'-[2H]pyridine]; 1'-methylspiro[3H-naphtho[2,1-b]pyran-3,2'-[2H]pyridine]; 1',4',6'-triphenylspiro[3H-naphtho[2,1-b]pyran-3,2'-[2H]pyridine]; spiro[acridine-9,2'-[2H]benzopyran]; 8'-methoxy-10-methylspiro[9H-acridine-9,2'-[2H]benzopyran]; 10-methylspiro[9H-acridine-9,2'-[2H benzopyran]; spiro[9H-acridine-9,3'-[3H]naphtho[2,1-b]pyran]; 10-methylspiro[9H-acridine-9,3'-[3H]naphtho[2,1-b]pyran], spiro[indoline-2,2'-[2H]pyrano[2,3-b]indole]; 5-chloro-1,3,3,9'-tetramethylspiro[indoline-2,2'-[2H]pyrano[2,3-b]indole]; spiro[indoline-2,2'-[2H]pyrano[3,2-b]indole]; 5-chloro-1,3,3-trimethylspiro[indoline-2,2'-[2H pyrano[3,2-b]indole]; spiro[indoline-2,2'-[2H]pyrano[2,3-b]benzofuran]; 1,3,3-trimethylspiro[indoline-2,2'-(2H]pyrano[2,3-b]benzofuran]; spiro[indoline-2,2'-[2H]pyrano[3,2-b]benzofuran]; 5-chloro-1,3,3-trimethylspiro[indoline-2,2'-[2H]pyrano[3,2-b]benzofuran]; spiro[2H-1-benzothieno[2,3-b]pyran-2,2'-indoline]; 5'-chloro-1',3',3'-trimethylspiro[2H-1-benzothieno[2,3-b]pyran-2,2'-indoline]; spiro[2H]-1-benzothieno[3,2-b]pyran-2,2'-indoline]; 5'-chloro-1',3',3'-trimethylspiro[2H]-1-benzothieno[3,2-b]pyran-2,2'-indoline]; spiro[3H-naphtho[2,1-b]pyran-3,9'-thioxonthene]; 4'-chloro-8-nitrospiro[3H-naphtho[2,1-b]pyran-3,9'-thioxanthene]; spiro[2H,8H-benzo[1,2-b:-3,4-b']dipyran-8-2'-indoline]-2-one; 1',3',3',4-tetramethylspiro[2H,8H-benzo[1,2-b:-3,4-b']dipyran-8-2'-indoline)-2-one; spiro[2H-1-benzopyran-2,2'-oxazoline]; 3'-methyl-6-nitro-5'-phenylspiro[2H-1-benzopyran-2,2'-oxazoline], spiro[2H-1-benzothiopyran-2,2'-indoline]; 1,3',3'-trimethylspiro[2H-1-benzothiopyran-2,2'-indoline]; spiro[3H-naphtho[2,1-b]pyran-3,2'-thiazoline]; 4',5'-dihydro-2,3'-dimethylspiro[3H-naphtho2,1-b]pyran-3,2'-thiazoline]; m-dithiino[5,4b:5,6-b']bis[1]benzopyranspiro[3H-naphtho[2,1-b]pyran-3,2'-thiazoline]; 6H,8H-thiopyrano[4,3-b:4,5-b'bis[1]benzopyranspiro[3H-naphtho[2,1-b]pyran-3,2'-thiazoline]; 6H,8H-bisnaphtho 1',2':5,6]pyrano[3,2-c:2',3'-d]thiopyranspiro[3H-naphtho[2,1-b]pyran-3,2'-thiazoline]; spiro[2H-1-benzopyran-2,1'-isoindoline]; 6-nitro-2',3',3'- trimethylspiro[2H-1-benzopyran-2,1'-isoindoline]; spiro[indoline-2,3'-[3H]pyrano-[3,2-a]xanthene]-12'-one; 5-chloro-3',12'-dihydro-1,3,3-trimethylspiro[indoline-2,3'-[3H]pyrano-[3,2-a]xanthene]-12'-one; and mixtures thereof. (3) a third component which is a charge control agent. (4) an optional fourth component which is a colored dye, and (5) an optional fifth component which is a colored pigment.

20. A toner composition according to claim 1 wherein the photochromic material is of the formula

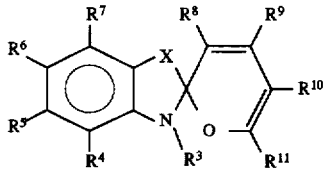

or

-continued

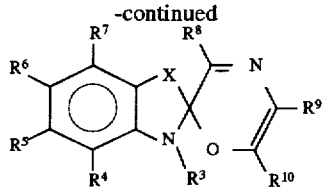

wherein X is a sulfur atom, a selenium atom, an oxygen atom, a $—CH_2—$ group, a $—CHR^1—$ group, or a $—CR^1R^2—$ group, and wherein $R^1$, $R^2$, $R^3$, $R^4$, $R^5$, $R^6$, $R^7$, $R^8$, $R^9$, $R^{10}$, and $R^{11}$ each, independently of the others, are hydrogen atoms, alkyl groups, aryl groups, arylalkyl groups, silyl groups, nitro groups, cyano groups, halide atoms, amine groups, hydroxy groups, alkoxy groups, aryloxy groups, alkylthio groups, arylthio groups, aldehyde groups, ketone groups, ester groups, amide groups, carboxylic acid groups, and sulfonic acid groups, wherein two or more R groups can be joined together to form a ring.

* * * * *